US011414810B2

(12) United States Patent
Kim et al.

(10) Patent No.: US 11,414,810 B2
(45) Date of Patent: Aug. 16, 2022

(54) CLOTHES TREATMENT APPARATUS

(71) Applicant: LG ELECTRONICS INC., Seoul (KR)

(72) Inventors: Jaehyung Kim, Seoul (KR); Semin Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 46 days.

(21) Appl. No.: 16/957,881

(22) PCT Filed: Dec. 7, 2018

(86) PCT No.: PCT/KR2018/015456
§ 371 (c)(1),
(2) Date: Jun. 25, 2020

(87) PCT Pub. No.: WO2019/112354
PCT Pub. Date: Jun. 13, 2019

(65) Prior Publication Data

US 2021/0363683 A1 Nov. 25, 2021

(30) Foreign Application Priority Data

Dec. 8, 2017 (KR) ..... 10-2017-0168513

(51) Int. Cl.
*D06F 58/12* (2006.01)
*D06F 58/10* (2006.01)
(Continued)

(52) U.S. Cl.
CPC ..... *D06F 58/12* (2013.01); *B06B 1/14* (2013.01); *D06F 58/10* (2013.01); *D06F 58/20* (2013.01); *D06F 69/00* (2013.01)

(58) Field of Classification Search
CPC ..... D06F 58/12; D06F 58/10; D06F 58/20; D06F 69/00; D06F 73/00; D06F 73/02;
(Continued)

(56) References Cited

U.S. PATENT DOCUMENTS 7,103,996 B2 * 9/2006 Hapke ..... D06F 73/02 38/1 A
7,137,211 B2 * 11/2006 Johnson ..... D06F 58/10 34/381
(Continued)

FOREIGN PATENT DOCUMENTS

EP 2385168 A2 11/2011
KR 10-1997-0027428 6/1997
(Continued)

OTHER PUBLICATIONS

International Search Report and Written Opinion dated Mar. 28, 2019 in International Application No. PCT/KR2019/015456 (10 pages.).
(Continued)

*Primary Examiner* — Ismael Izaguirre
(74) *Attorney, Agent, or Firm* — Birch, Stewart, Kolasch & Birch, LLP

(57) ABSTRACT

A clothes treatment apparatus comprises: a frame; a hanger body configured to move with respect to the frame and provided to hang clothes or clothes hangers; a vibration module that generates vibrations by comprising at least one eccentric portion that rotates around at least one predetermined rotational axis in such a way that the weight is off-center, and that is connected to the hanger body to transmit the vibrations; and at least one elastic member that exerts an elastic force on the vibration module when the vibration module vibrates, wherein the angular speed of the eccentric portion is changeable.

20 Claims, 33 Drawing Sheets

(51) Int. Cl.

| | |
|---|---|
| ***D06F 58/20*** | (2006.01) |
| ***D06F 69/00*** | (2006.01) |
| ***B06B 1/14*** | (2006.01) |

(58) Field of Classification Search
CPC .... B06B 1/14; B06B 1/10; B06B 1/12; B06B 1/16
See application file for complete search history.

(56) References Cited

U.S. PATENT DOCUMENTS

| | | | | |
|---|---|---|---|---|
| 8,296,967 | B2 | 10/2012 | Kim et al. | |
| 9,359,710 | B2 * | 6/2016 | Lee | D06F 58/12 |
| 2003/0223309 | A1 | 12/2003 | Hapke | |
| 2006/0037209 | A1 | 2/2006 | Johnson et al. | |
| 2010/0146805 | A1 | 6/2010 | Kim et al. | |
| 2012/0232780 | A1 | 9/2012 | Delson et al. | |
| 2013/0086830 | A1 * | 4/2013 | Moon | D06F 58/10 38/1 A |

FOREIGN PATENT DOCUMENTS

| | | | |
|---|---|---|---|
| KR | 10-0166924 | B1 | 6/1997 |
| KR | 10-2012-0078278 | A | 7/2012 |
| KR | 10-2014-0112386 | A | 9/2014 |
| KR | 10-2015-0011214 | A | 1/2015 |
| KR | 10-2017-0010877 | A | 1/2017 |
| KR | 10-2016-0123737 | | 3/2017 |
| SU | 1442582 | A1 | 12/1998 |
| WO | WO 2015/006467 | A1 | 1/2015 |

OTHER PUBLICATIONS

European Search Report, dated Aug. 18, 2021, issued in Patent Application No. 18885620.7 (12 pages).
Indian Office Action issued in Application No. 202017028235 dated Feb. 25, 2021 (6 pages).
Russian Notice of Allowance dated Nov. 27, 2020 in Application No. 2020122223 (10 pages).

* cited by examiner

| | mode1 | mode2 |
|---|---|---|
| Motion |   |   |
| X(w) |  |  |
| w |  |  |

CLOTHES TREATMENT APPARATUS

TECHNICAL FIELD

The present disclosure relates to a structure for vibrating clothes in a clothes treatment apparatus.

BACKGROUND

A clothes treatment apparatus refers to all kinds of apparatuses for maintaining or treating clothes, such washing, drying, and dewrinkling them, at home or at a laundromat. Examples of clothes treatment apparatuses include a washer for washing clothes, a dryer for drying clothes, a washer-dryer which performs both washing and drying functions, a refresher for refreshing clothes, and a steamer for removing unnecessary wrinkles in clothes.

More specifically, the refresher is a device used for keeping clothes crisp and fresh, which performs functions like drying clothes, providing fragrance to clothes, preventing static cling on clothes, removing wrinkles from clothes, and so on. The steamer is generally a device that provides steam to clothes to remove wrinkles from them, which can remove wrinkles from clothes in a more delicate way, without the hot plate touching the clothes like in traditional irons. There is a known clothes treatment apparatus equipped with both the refresher and steamer functions, that functions to remove wrinkles and smells from clothes put inside it by using steam and hot air.

There is also a known clothes treatment apparatus that functions to smooth out wrinkles in clothes by vibrating (reciprocating) a hanging bar for clothes in a predetermined direction.

Technical Problem

A first aspect of the present disclosure is to allow the hanging bar to move in a vibrating motion by adjusting it to various vibration frequencies and amplitudes when the hanging bar vibrates.

A problem with the conventional art is that amplitude is maintained even if the vibration frequency of the hanging bar is changed, thus putting stress on items. A second aspect of the present disclosure is reduce the stress on items caused by a change of frequency by solving this problem.

Another problem with the conventional art is that, when vibration frequency is increased on the presumption that amplitude is maintained when the hanging bar is shaken, this will create a physical limitation (e.g., frictional force) and require an excessive amount of energy to generate vibrations, and therefore the maximum vibration frequency cannot reach more than a certain level. A third aspect of the present disclosure is to solve this problem.

A further problem with the conventional art is that, if amplitude is kept high when the hanger body is shaken at a high vibration frequency, this will cause excessive stress on clothes, even making clothes fall off the hanging bar or causing damage to clothes. A fourth aspect of the present disclosure is to significantly increase vibration frequency without clothes falling off or getting damaged by solving this problem.

A further problem with the conventional art is that unnecessary vibrations occur in other directions than the direction of vibration when the hanging bar is vibrated. A fifth aspect of the present disclosure is to minimize unnecessary vibrations by solving this problem.

SUMMARY

In order to address the aforementioned aspects, a clothes treatment apparatus according to an exemplary embodiment of the present disclosure comprises: a frame; a hanger body configured to move with respect to the frame and provided to hang clothes or clothes hangers; a vibration module that generates vibrations by comprising at least one eccentric portion that rotates around at least one predetermined rotational axis in such a way that the weight is off-center, and that is connected to the hanger body to transmit the vibrations; and at least one elastic member that exerts an elastic force on the vibration module when the vibration module vibrates, wherein the angular speed of the eccentric portion is changeable.

Two or more different angular speeds may be maintained for a predetermined time or longer.

The clothes treatment apparatus may be configured to perform a first mode in which the vibration frequency of the hanger body is relatively low and the amplitude is relatively large and a second mode in which the vibration frequency of the hanger body is relatively high and the amplitude is relatively small, by changing and controlling the angular speed.

The vibration frequency for the first mode may be preset to be closer to the natural vibration frequency than the vibration frequency for the second mode.

The amplitude of vibration of the hanger body in a steady state may be preset to have a peak value when the angular speed has a specific value greater than zero.

One end of the elastic member may be fixed to the vibration module. The clothes treatment apparatus may further comprise a supporting member fixed to the frame, to which the other end of the elastic member is fixed.

The at least one elastic member may comprise: a first elastic member that elastically deforms when the vibration module moves to one side in the vibration direction; and a second elastic member that elastically deforms when the vibration module moves to the other side.

The at least one eccentric portion may comprise: a first eccentric portion that rotates around a predetermined first rotational axis in such a way that the weight is off-center; and a second eccentric portion that rotates around a predetermined second rotational axis, which is the same as or parallel to the first rotational axis, in such a way that the weight is off-center.

The vibration module may be configured in such a way as to rotate around a predetermined center axis where the position relative to the frame is fixed. The first rotational axis and the second rotational axis may be placed apart from each other, in opposite directions with respect to the center axis.

The hanger body may be configured to move with respect to the frame in a predetermined vibration direction. The elastic member may be configured to elastically deform or regain elasticity when the hanger body moves in the vibration direction.

Advantageous Effects

Through the above means to solve the problems, the vibration pattern of the hanger body can be varied only by changing the angular speed of the eccentric portion, and therefore clothes treatment can be done more efficiently and the hanger body can have a vibration pattern that suits the user's preferences, clothing types, and so on.

The vibrating motion of the hanger body can be made in two or more steady states by maintaining the two or more angular speeds for a predetermined time or longer.

A first mode in which the vibration frequency of the hanger body is relatively low and the amplitude is relatively large and a second mode in which the vibration frequency of the hanger body is relatively high and the amplitude is relatively small are provided. Hence, clothes can be vibrated slowly with a large amplitude through the first mode, or clothes may be vibrated fast, rather than being shaken off, with a small amplitude through the second mode. Moreover, even with an increase of the vibration frequency of the hanger body, there will be less stress on items, clothes will not fall off or get damaged, and the amount of energy consumed to generate vibrations will be significantly reduced. Furthermore, the maximum vibration frequency of the hanger body can be greatly increased without physical limitations.

The hanger body can be adjusted to various vibration frequencies and amplitudes, since the amplitude of vibration of the hanger body in a steady state is preset to have a peak value when the angular speed has a specific value greater than zero.

The first mode allows for larger amplitude and the second mode allows for high vibration frequency without stress on items, since the vibration frequency for the first mode is preset to be closer to the natural vibration frequency than the vibration frequency for the second mode.

It is possible to minimize unnecessary vibrations occurring in a direction intersecting the vibration direction of the hanger body by including the first eccentric portion and the second eccentric portion.

Since the first rotational axis and the second rotational axis are spaced apart from the center axis in opposite directions, the vibration module is off-centered to one side of the center axis, thereby reducing the risk of putting stress on the structure.

BRIEF DESCRIPTION OF THE DRAWINGS

FIGS. 3*a* to 7*d* are conceptual diagrams showing the operating principle of the vibration module 50 of FIG. 1: FIGS. 3*a* and 3*b* are views showing the operating principle of the vibration module 150 according to a first exemplary embodiment; FIGS. 7*a* to 7*d* are views showing the operating principle of the vibration module 550 according to a fifth exemplary embodiment.

DETAILED DESCRIPTION OF THE EMBODIMENTS

Figure 1:
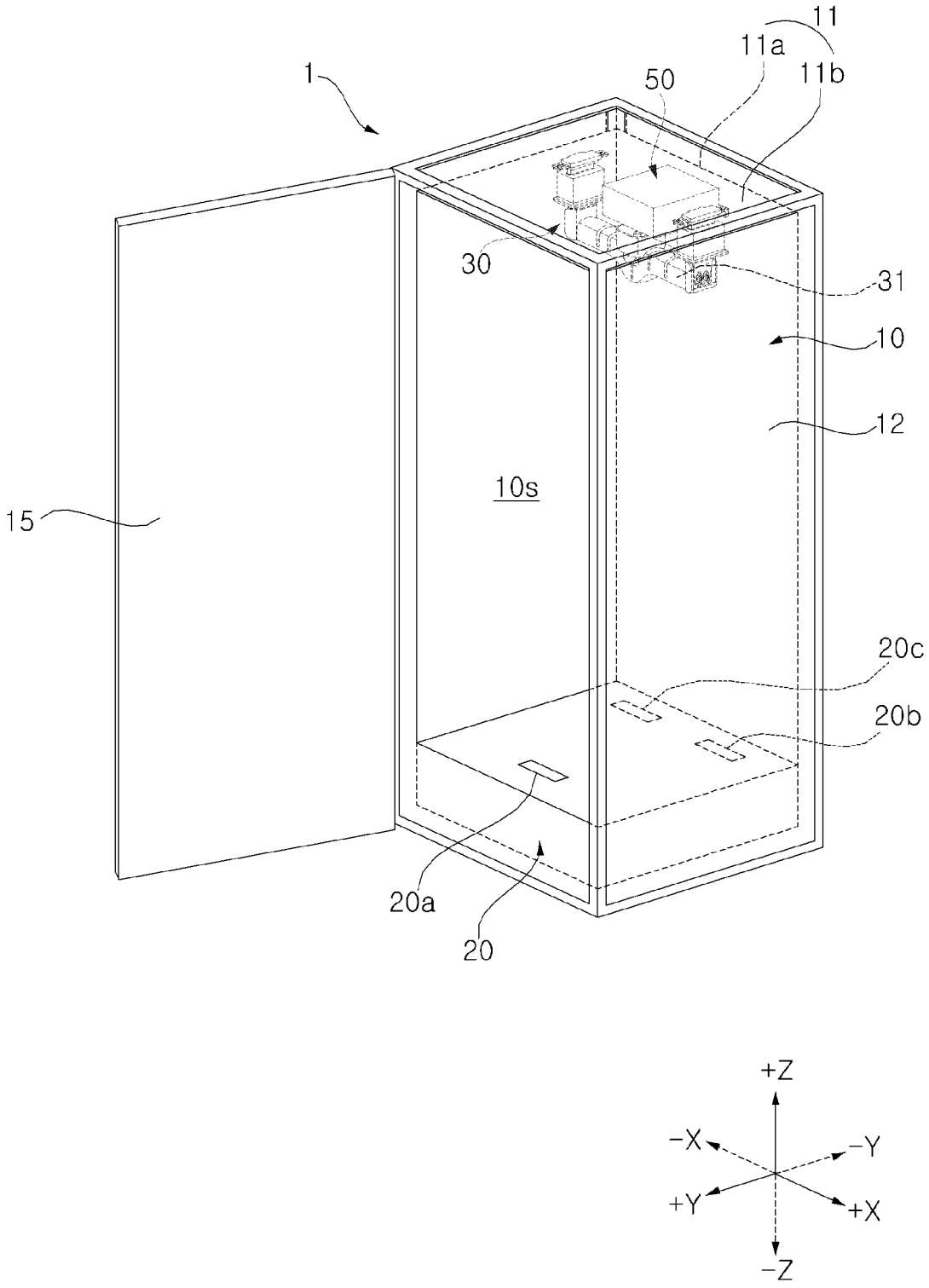
FIG. 1 is a perspective view of a clothes treatment apparatus 1 according to an exemplary embodiment of the present disclosure.

To explain the present disclosure, a description will be made below with respect to a spatial orthogonal coordinate system where X, Y, and Z axes are orthogonal to each other. Each axis direction (X-axis direction, Y-axis direction, and Z-axis direction) refers to two directions in which each axis runs. Each axis direction with a '+' sign in front of it (+X-axis direction, +Y-axis direction, and +Z-axis direction) refers to a positive direction which is one of the two directions in which each axis runs. Each axis direction with a '-' sign in front of it (−X-axis direction, −Y-axis direction, and −Z-axis direction) refers to a negative direction which is the other of the two directions in which each axis runs.

The terms mentioned below to indicate directions such as "front(+Y)/back(−Y)/left(+X)/right(−X)/up(+Z)/down(−Z)" are defined by the X, Y, and Z coordinate axes, but they are merely used for a clear understanding of the present disclosure, and it is obvious that the directions may be defined differently depending on where the reference is placed.

The terms with ordinal numbers such as "first", "second", "third", etc. added to the front are used to describe constituent elements mentioned below, are intended only to avoid confusion of the constituent elements, and are unrelated to the order, importance, or relationship between the constituent elements. For example, an embodiment including only a second component but lacking a first component is also feasible.

The singular forms used herein are intended to include plural forms as well, unless the context clearly indicates otherwise.

A clothes treatment apparatus 1 according to an exemplary embodiment of the present disclosure comprises a frame 10 placed on a floor on the outside or fixed to a wall on the outside. The frame 10 has a treatment space 10*s* for storing clothes. The clothes treatment apparatus 1 comprises a supply part 20 for supplying at least one among air, steam, a deodorizer, and an anti-static agent to clothes. The clothes treatment apparatus 1 comprise a hanger module 30, 230, and 430 provided to hang clothes or clothes hangers. The hanger module 30, 230, and 430 is supported by the frame 10. The clothes treatment apparatus 1 comprises a vibration module 50, 150, 250, 350, 450, and 550 for generating vibration. The vibration module 50, 150, 250, 350, 450, and 550 vibrates the hanger module 30, 230, and 430. The clothes treatment apparatus 1 comprises at least one elastic member 60, 260, 460, and 560 configured to elastically deform or regain its elasticity when the hanger module 30, 230, and 430 moves. The elastic member 60, 260, 460, and 560 is configured to elastically deform or regain its elasticity when the vibration module 50, 150, 250, 350, 450, and 550 moves. The clothes treatment apparatus 1 comprises a supporting member 270, 470, and 570 for supporting one end of the elastic member 60, 260, 460, and 560. The supporting member 270, 470, and 570 may movably support the vibration module 50, 150, 250, 350, 450, and 550. The supporting member 270, 470, and 570 may be fixed to the frame 10. The clothes treatment apparatus 1 may comprise a control part (not shown) for controlling the operation of the supply part 20. The control part may control whether to operate the vibration module 50, 150, 250, 350, 450, and 550 or not and its operating pattern. The clothes treatment apparatus 1 may further comprise a clothes recognition sensor (not shown) for sensing clothes contained inside the treatment space 10*s*.

Referring to FIG. 1, the frame 10 forms the external appearance. The frame 10 has the treatment space 10*s* in which clothes are stored. The frame 10 comprises a top frame 11 forming the top side, a side frame 12 forming the left and right sides, and a rear frame (not shown) forming the rear side. The frame 10 comprises a base frame (not shown) forming the bottom side.

The frame 10 may comprise an interior frame 11*a* forming the inner side and an exterior frame 11*b* forming the outer side. The inner side of the interior frame 11*a* forms the treatment space 10*s*. A configuration space 11*s* is formed between the interior frame 11*a* and the exterior frame 11*b*. The vibration module 50, 150, 250, 350, 450, and 550 may be disposed within the configuration space 11*s*. The elastic member 60, 260, 460, and 560 and the supporting member 270, 470, and 570 may be disposed within the configuration space 11*s*.

The treatment space 10*s* is a space in which air (for example, hot air), steam, a deodorizer, and/or an anti-static agent is applied to clothes so as to change physical or chemical properties of the clothes. Clothes treatment may be done on the clothes in the treatment space 10*s* by various methods—for example, applying hot air to the clothes in the treatment space 10 to dry the clothes, removing wrinkles on the clothes with steam, spraying a deodorizer to clothes to give them a fragrance, spraying an anti-static agent to clothes to prevent static cling on them.

At least part of the hanger module 30, 230, and 430 is disposed within the treatment space 10*s*. A hanger body 31, 231, and 431 is disposed within the treatment space 10*s*. One side of the treatment space 10*s* is open so that clothes can be taken in and out, and the open side is opened or closed by a door 15. When the door 15 is closed, the treatment space 10*s* is separated from the outside, and when the door 15 is opened, the treatment space 10*s* is exposed to the outside.

Referring to FIG. 1, the supply part 20 may supply air into the treatment space 10*s*. The supply part 20 may circulate the air in the treatment space 10*s* while supplying it. Specifically, the supply part 20 may draw in air from inside the treatment space 10*s* and discharge it into the treatment space 10*s*. The supply part 20*s* may supply outside air into the treatment space 10*s*.

The supply part 20 may supply air that has undergone a predetermined treatment process into the treatment space 10*s*. For example, the supply part 20 may supply heated air into the treatment space 10*s*. The supply part 20 also may supply cooled air into the treatment space 10*s*. Moreover, the supply part 20 may supply untreated air into the treatment space 10*s*. Further, the supply part 20 may add steam, a deodorizer, or an anti-static agent to air and supply the air into the treatment space 10*s*.

The supply part 20 may comprise an air intake opening 20*a* through which air is drawn in from inside the treatment space 10*s*. The supply part 20 may comprise an air discharge opening 20*b* through which air is discharged into the treatment space 10*s*. The air drawn in through the air intake opening 20*a* may be discharged through the air discharge opening 20*b* after a predetermined treatment. The supply part 20 may comprise a steam spout 20*c* for spraying steam into the treatment space 10*s*. The supply part 20 may comprise a heater (not shown) for heating drawn-in air. The supply part 20 may comprise a filter (not shown) for filtering drawn-in air. The supply part 20 may comprise a fan (not shown) for pressurizing air.

The air and/or steam supplied by the supply part 20 is applied to the clothes stored in the treatment space 10*s* and affects the physical or chemical properties of the clothes. For example, the tissue structure of the clothes is relaxed by hot air or steam, so that the wrinkles are smoothed out, and an unpleasant odor is removed as odor molecules trapped in the clothes react with steam. In addition, the hot air and/or steam generated by the supply part 20 may sterilize bacteria present in the clothes.

Referring to FIG. 1, FIG. 10, FIG. 13, FIG. 14, and FIG. 19, the hanger module 30, 230, and 430 may be disposed above the treatment space 10*s*. The hanger module 30, 230, and 430 is provided to hang clothes or clothes hangers. The hanger module 30, 230, and 430 is supported by the frame 10. The hanger module 30, 230, and 430 is movable. The hanger module 30, 230, and 430 is connected to the vibration module 50, 150, 250, 350, 450, and 550 and receives vibrations from the vibration module 50, 150, 250, 350, 450, and 550.

The hanger module 30, 230, and 430 comprises a hanger body 31, 231, and 431 provided to hang clothes or clothes hangers. In this exemplary embodiment, the hanger body 31, 231, and 431 may be formed with locking grooves 31*a* for hanging clothes hangers, and, in another exemplary embodiment, the hanger body 31, 231, and 431 may be formed with hooks (not shown) or the like so that clothes are hung directly on them.

The hanger body 31, 231, and 431 is supported by the frame 10. The hanger body 31, 231, and 431 may be connected to the frame 10 through a hanger moving portion 33 and a hanger supporting portion 35. The hanger body 31, 231, and 431 is configured to move with respect to the frame 10. The hanger body 31, 231, and 431 is configured to move (vibrate) with respect to the frame 10 in a predetermined vibration direction (+X, −X). The hanger body 31, 231, and 431 may vibrate with respect to the frame 10 in the vibration direction (+X, −X). The hanger body 31, 231, and 431 reciprocates in the vibration direction (+X, −X) by the vibration module 50, 150, 250, 350, 450, and 550. The hanger module 30, 230, and 430 reciprocates while hanging in an upper portion of the treatment space 10*s*.

The hanger body 31, 231, and 431 may extend longitudinally in the vibration direction (+X, −X). A plurality of locking grooves 31*a* may be disposed on the upper side of the hanger body 31, 231, and 431, spaced apart from each other, in the vibration direction (+X, −X). The locking grooves 31*a* may extend in a direction (+Y, −Y) intersecting the vibration direction (+X, −X).

The hanger module 30, 230, and 430 may comprise a hanger moving portion 33 which movably supports the hanger body 31, 231, and 431. The hanger moving portion 33 is movable in the vibration direction (+X, −X). The hanger moving portion 33 may be made of a flexible material so as to make the hanger body 31, 231, and 431 move. The hanger moving portion 33 may comprise an elastic member that is elastically deformable when the hanger body 31, 231, and 431 moves. The upper end of the hanger moving portion 33 is fixed to the frame 10, and the lower end is fixed to the hanger body 31, 231, and 431. The hanger moving portion 33 may extend vertically. The upper end of the hanger moving portion 33 rests on a hanger supporting portion 35. The hanger moving portion 33 connects the hanger supporting portion 35 and the hanger body 31, 231, and 431. The hanger moving portion 33 is configured to vertically penetrate a hanger guide portion 37. The length of a horizontal cross-section of the hanger moving portion 33 in the vibration direction (+X, −X) is shorter than its length in the direction (+Y, −Y) perpendicular to the vibration direction (+X, −X).

The hanger module 30, 230, and 430 comprises a hanger supporting portion 35 fixed to the frame 10. The hanger supporting portion 35 secures the hanger moving portion 33 to the frame 10. The hanger supporting portion 35 may be fixed to the interior frame 11*a*. The upper end of the hanger moving portion 33 may be locked and hung on the hanger supporting portion 35. The hanger supporting portion 35 may be formed in the shape of a horizontal plate, and the hanger moving portion 33 may be configured to penetrate the hanger supporting portion 35.

The hanger module 30, 230, and 430 may further comprise a hanger guide portion 37 for guiding the position of the hanger moving portion 33. The hanger guide portion 37 is fixed to the frame 10. The gap between the upper side of the hanger guide portion 37 and the hanger moving portion 33 may be sealed. The lower side of the hanger guide portion 37 has an upward recess formed in it, and the hanger moving portion 33 may move in the vibration direction (+X, −X) within the upward recess of the hanger guide portion 37.

The vibration module 50, 150, 250, 350, 450, and 550 comprises a hanger driving unit 258, 458, and 558 connected to the hanger module 30, 230, and 430. The hanger body 31, 231, and 431 comprises a hanger driven unit 231*b* and 431*b* connected to the hanger driving unit 258, 458, and 558.

Figure 10:
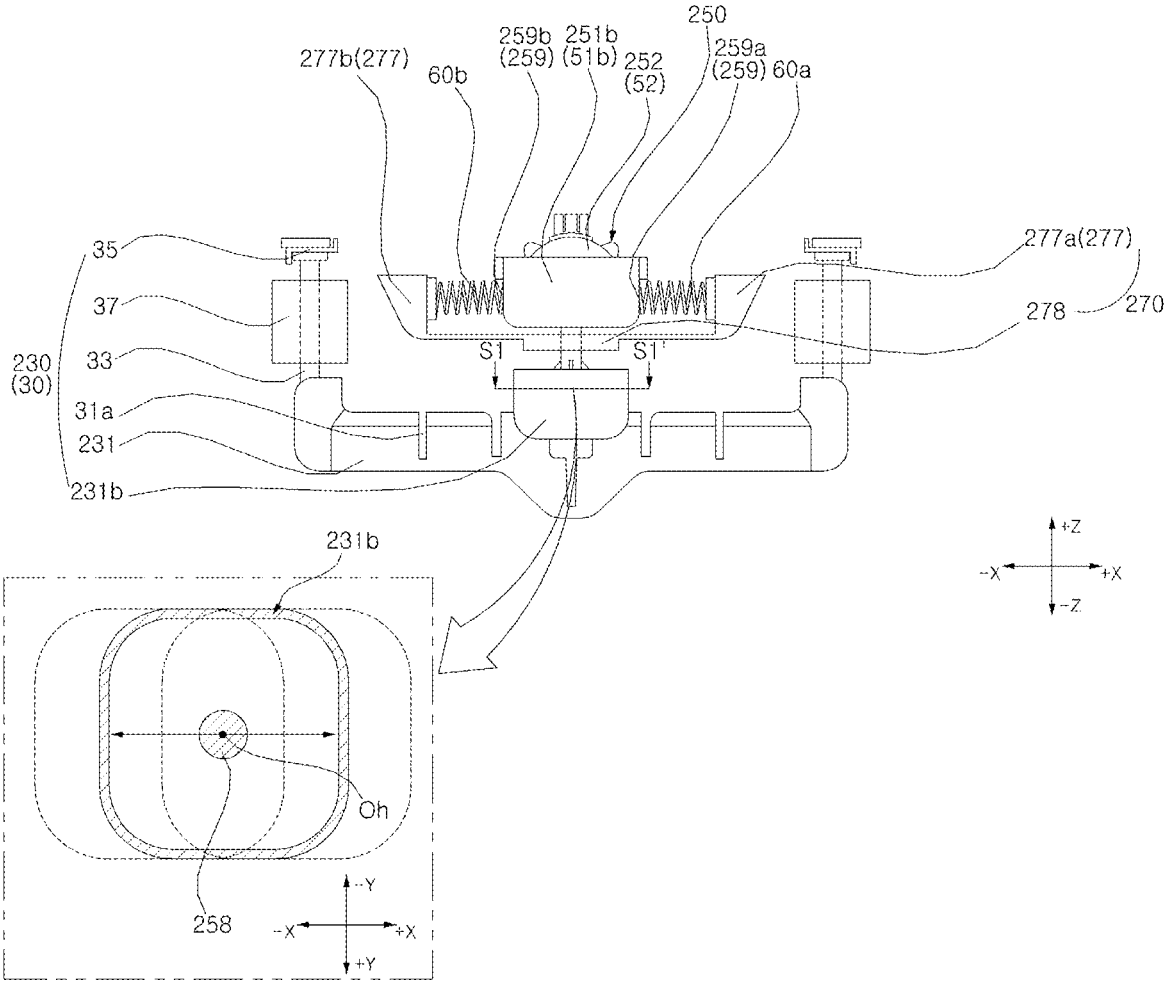
FIG. 10 is an elevation view of the vibration module 250, elastic member 260, supporting member 270, and hanger module 230 according to the structural example of FIG. 9 and a partial cross-sectional view of the hanger driving unit 258 and hanger driven unit 231*b*, horizontally taken along the line S1-S1'.

Referring to FIG. 10, the hanger driving unit 258 and hanger driven unit 231*b* according to an exemplary embodiment will be described below. The hanger driving unit 258 connects and holds together the vibration module 150 and 250 and the hanger body 231. The hanger driving unit 258 may connect and hold together the lower side of the vibration module 150 and 250 and the center of the hanger body 231. Therefore, the vibration module 150 and 250 and the hanger body 231 vibrate as a single unit.

The hanger driving unit 258 according to the exemplary embodiment may extend in parallel with a center axis Oc. The hanger driving unit 258 may be in the shape of a bar. The hanger driving unit 258 may extend along a predetermined connection axis Oh to be described later. The hanger driving unit 258 may be disposed on the connection axis Oh. The hanger driven unit 231*b* may be in the shape of a casing that is open at the top. The hanger driving unit 258 is fixed to the hanger driven unit 231*b*. The upper end of the hanger driving unit 258 is fixed to the vibration module 150 and 250, and the lower end is fixed to the hanger driven unit 231*b*. When the hanger driving unit 258, while fixed to the hanger driven unit 231*b*, reciprocates in the vibration direction (+X, −X) of the vibration module 150 and 250, the hanger body 231 reciprocates in the vibration direction (+X, −X), integrally with the vibration module 150 and 250. In the partial cross-sectional view of FIG. 10, the direction in which the hanger driving unit 258 linearly reciprocates is indicated by an arrow, and therefore the range of movement of the hanger driven unit 231*b* vibrating in the left-right direction (+X, −X) is indicated by a dotted line.

Figure 13:
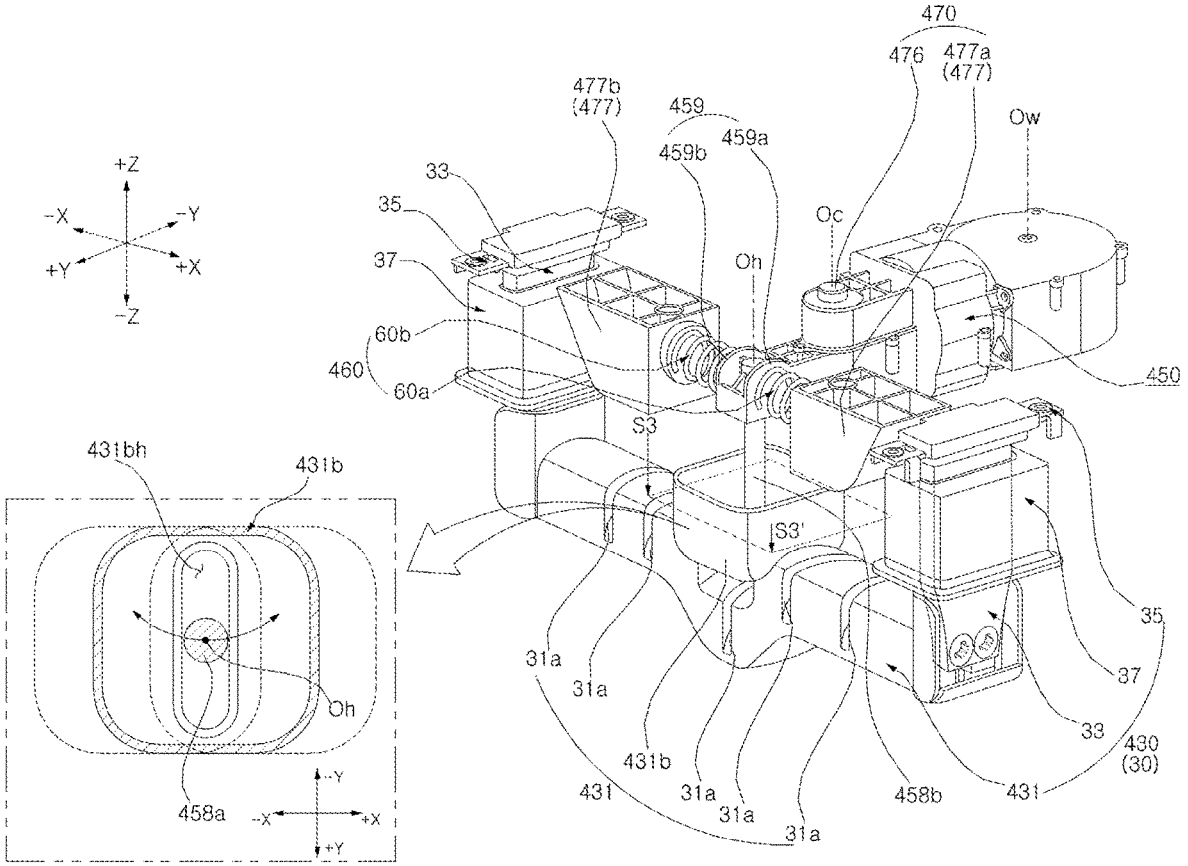
FIG. 13 is a perspective view showing the vibration module 450, elastic member 460, supporting member 470, and hanger module 430 according to the structural example of FIG. 11 and a partial cross-sectional view of the hanger driving unit 458 and hanger driven unit 431*b*, horizontally taken along the line S3-S3'.
Figure 14:
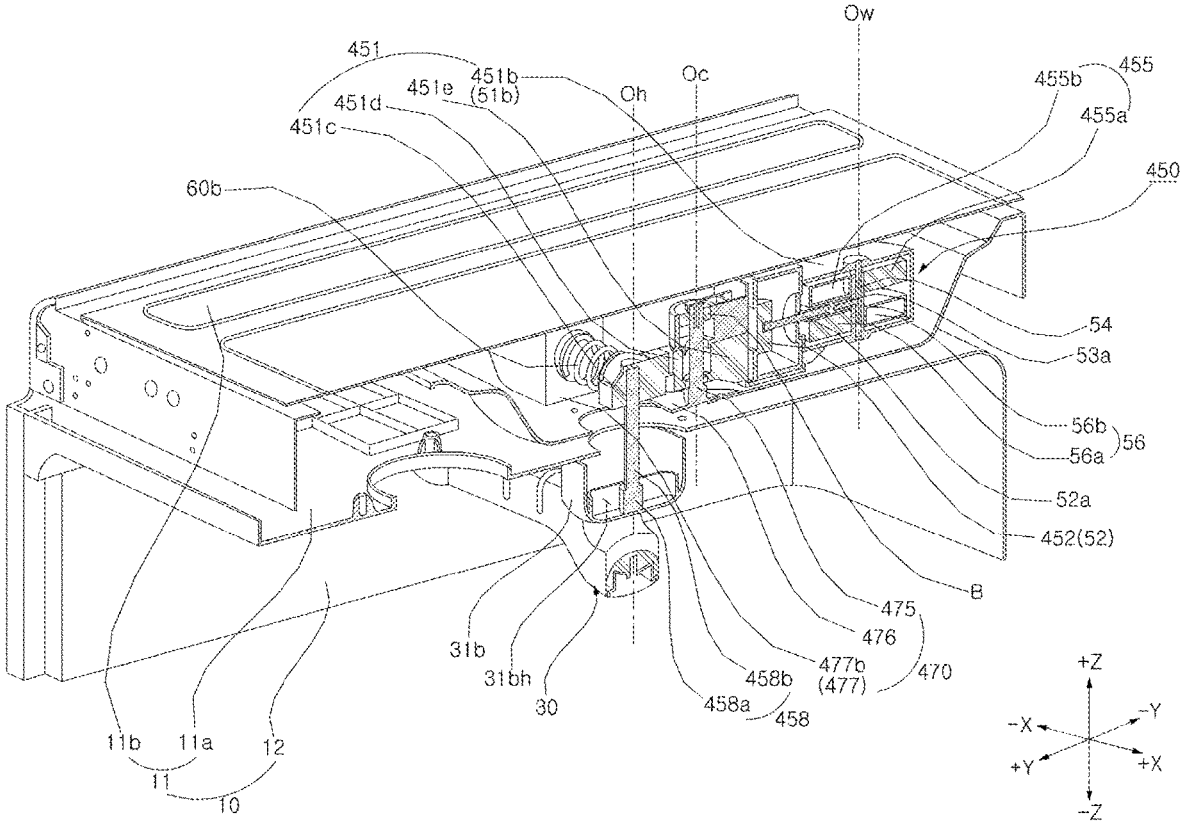
FIG. 14 is a vertical cross-sectional view of the structural example of FIG. 11, taken along the line S2-S2'.
Figure 19:
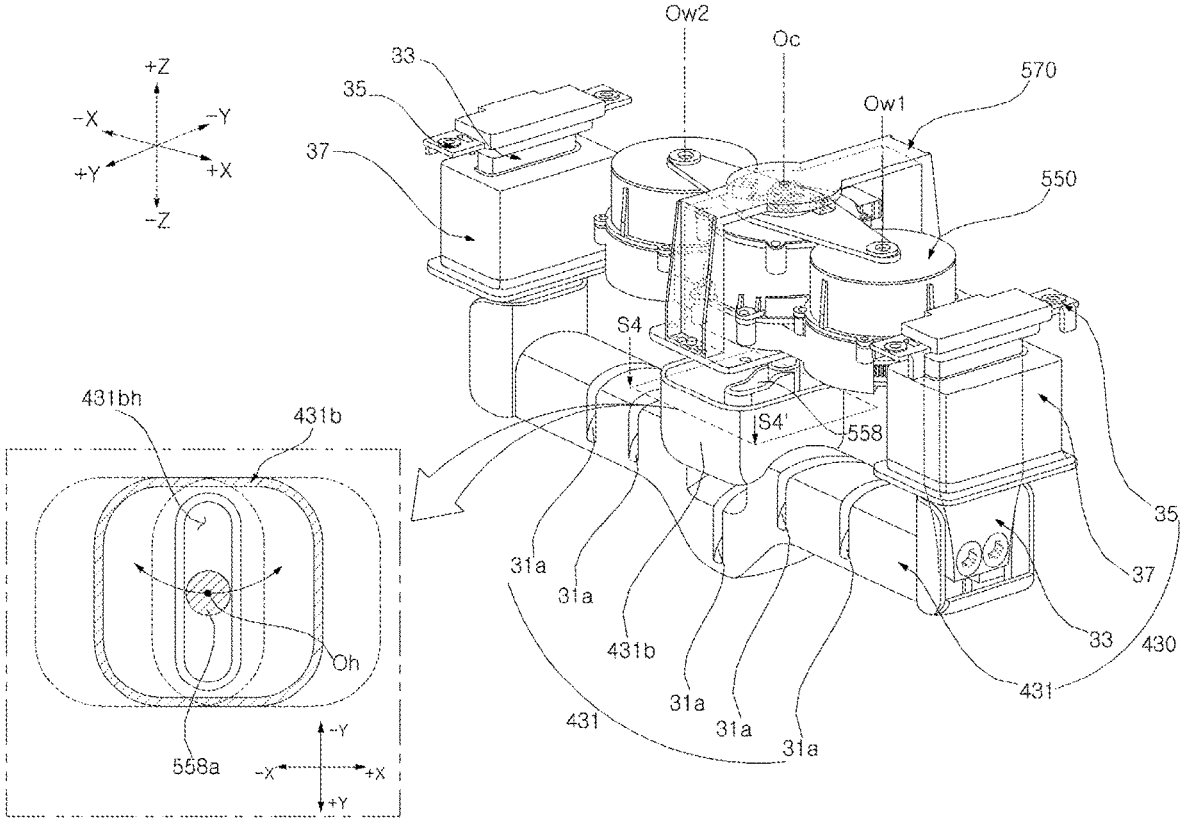
FIG. 19 is an elevation view of the vibration module 550, elastic member 560, supporting member 570, and hanger module 430 according to the structural example of FIG. 17 and a partial cross-sectional view of the hanger driving unit 558 and hanger driven unit 431*b*, horizontally taken along the line S4-S4'.
Figure 20:
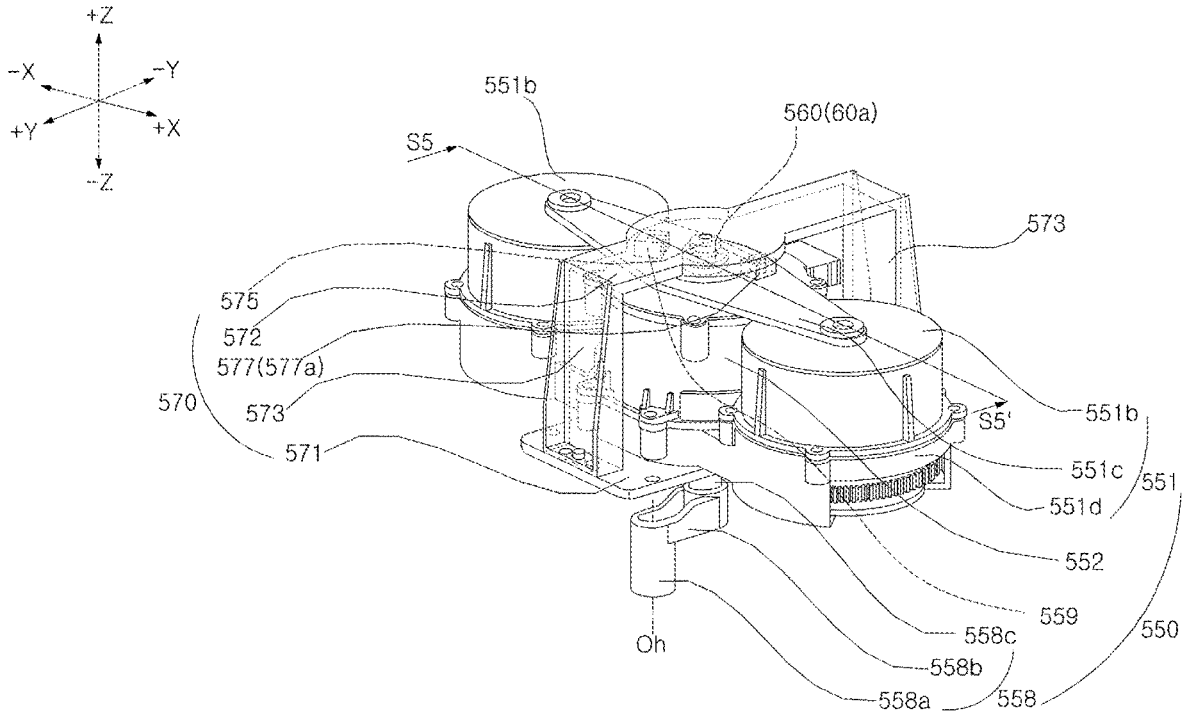
FIG. 20 is a perspective view of the vibration module 550, elastic member 560, and supporting member 570 according to the structural example of FIG. 19 when combined together.
Figure 21:
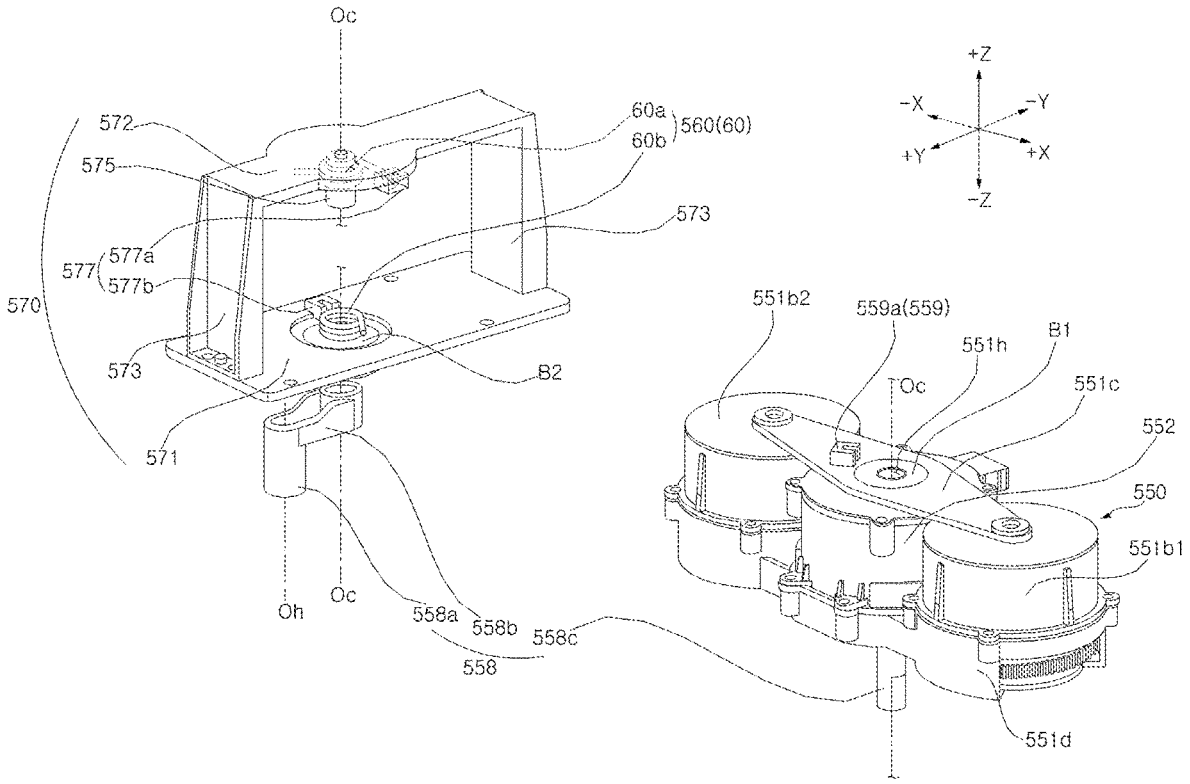
FIG. 21 is a perspective view of the vibration module 550, elastic member 560, and supporting member 570 according to the structural example of FIG. 20 when separated from one another.
Figure 22:
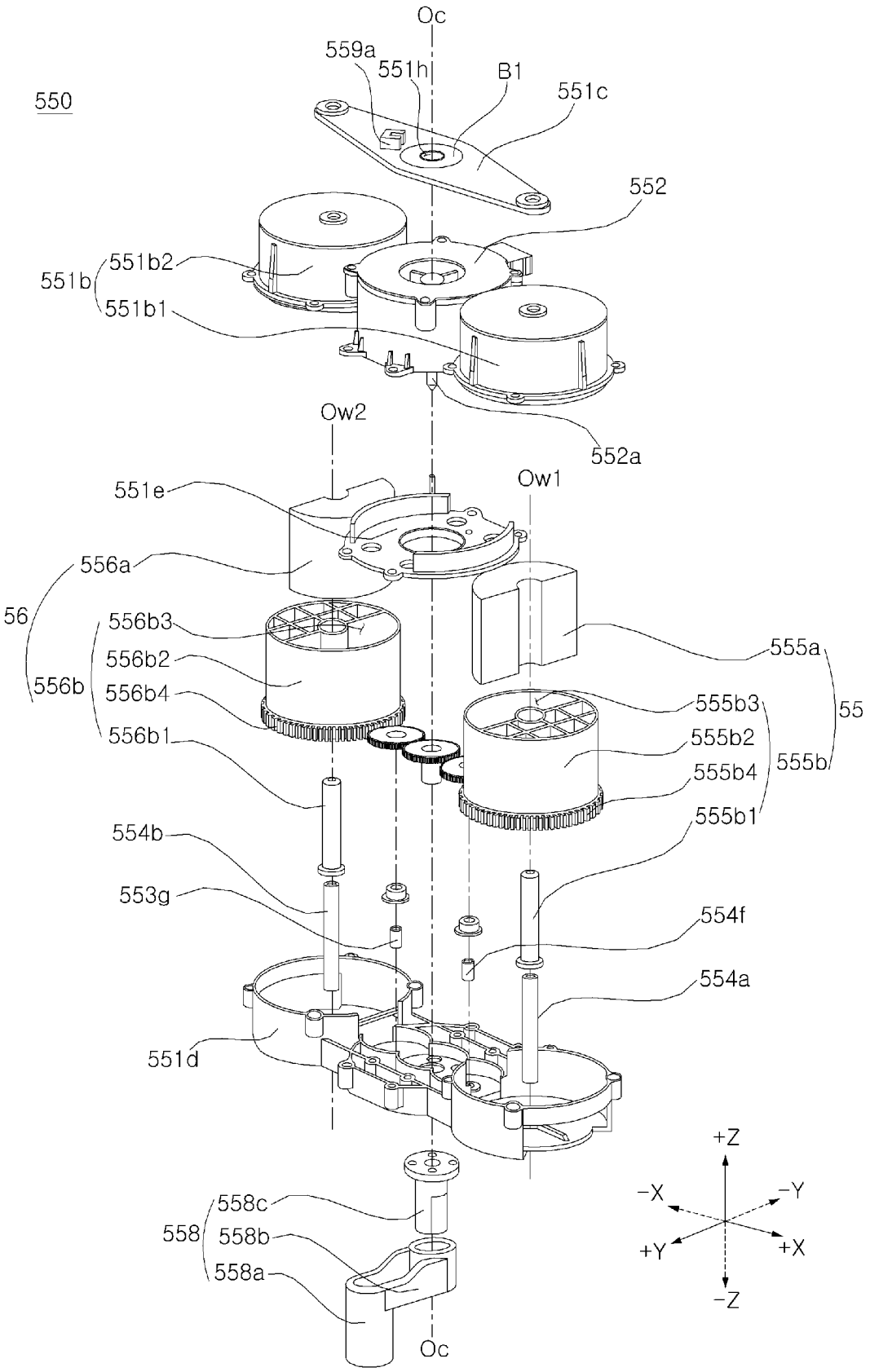
FIG. 22 is an exploded perspective view of the vibration module 550 according to the structural example of FIG. 21.
Figure 23:
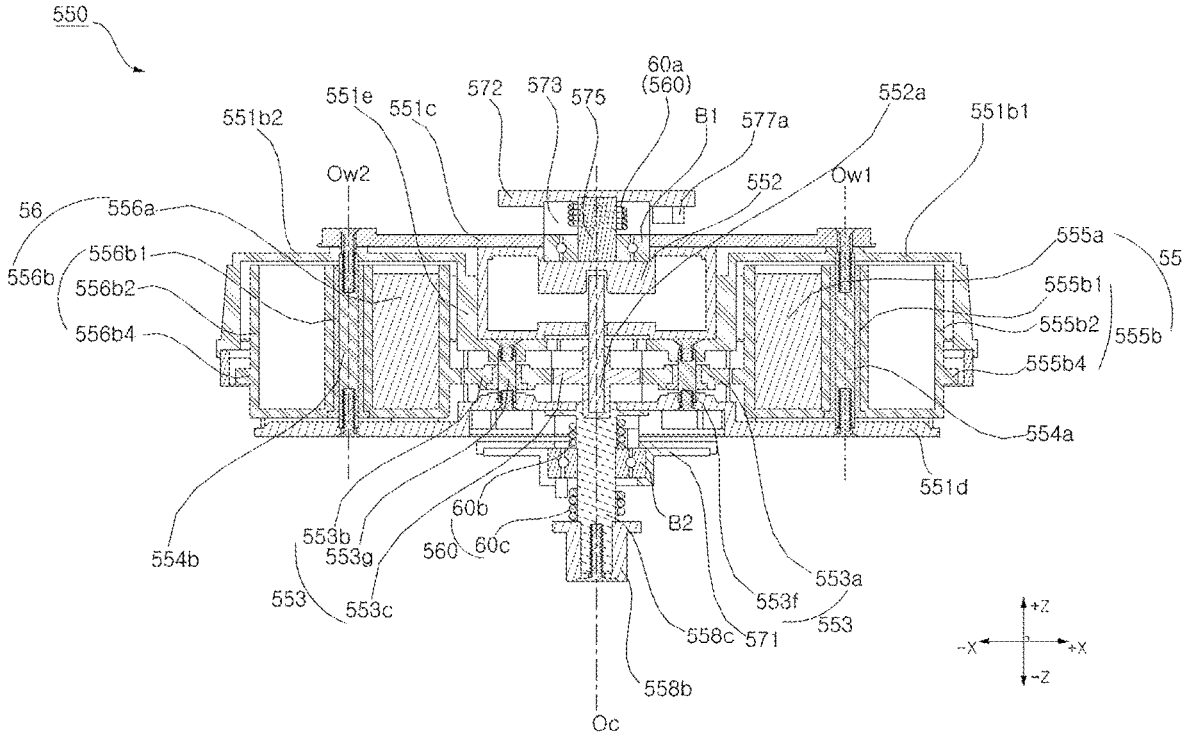
FIG. 23 is a vertical cross-sectional view of the vibration module 550, elastic member 560, and supporting member 570 of FIG. 20, taken along the line S2-S2'.

Referring to FIG. 13, FIG. 14, and, FIG. 19, the hanger driving unit 458 and 558 and hanger driven unit 431*b* according to another exemplary embodiment will be described below. Either the hanger driving unit 458 and 558 or the hanger driven unit 431*b* has a slit that extends in the direction (+Y, −Y) intersecting the vibration direction (+X, −X), and the other has a protruding portion that protrudes in parallel with the center axis Oc to be described later and is inserted into the slit. In this exemplary embodiment, the hanger driven unit 431*b* has a slit 431*bh* that extends in the direction (+Y, −Y), and the hanger driving unit 458 and 558 comprises a protruding portion 458*a* and 558*a* that protrudes downward and is inserted into the slit 431*bh*. Although not shown, another example may be given in which the hanger driven unit has a slit that extends in the direction (+Y, −Y) and the hanger driving unit comprises a protruding portion that protrudes upward and is inserted into the slit of the hanger driving unit.

The protruding portion 458*a* and 558*a* according to the another exemplary embodiment protrudes in parallel with the center axis Oc. The protruding portion 458*a* and 558*a* extends along a predetermined connection axis Oh to be described later. The protruding portion 458*a* and 558*a* is disposed on the connection axis Oh. The slit 431*bh* is formed longitudinally in the direction (+Y, −Y) perpendicular to the vibration direction (+X, −X) of the hanger module 430. When the protruding portion 458*a* and 558*a* rotates with respect to the center axis Oc while inserted in the slit 431*bh*, the protruding portion 458*a* and 558*a* moves relative to the slit 431*bh* in the perpendicular direction (+Y, −Y), causing the hanger body 431 to reciprocate in the vibration direction (+X, −X). In the partial cross-sectional views of FIG. 13 and FIG. 19, the direction in which the protruding portion 458*a* and 558*a* inserted in the slit 431*bh* moves in an arc (rotates) within a predetermined range is indicated by an arrow, and therefore the range of movement of the hanger driven unit 431*b* vibrating in the left-right direction (+X, −X) is indicated by a dotted line.

Referring to FIGS. 3*a* to 14 and FIGS. 19 to 24, the elastic member 60, 260, 460, and 560 is configured to elastically deform or regain its elasticity when the vibration module 50, 150, 250, 350, 450, and 550 vibrates. The elastic member 60, 260, 460, and 560 is configured to elastically deform or regain its elasticity when a vibrating body 251, 451, and 551 vibrates. The elastic member 60, 260, 460, and 560 is configured to elastically deform or regain its elasticity when the hanger body 31, 231, and 431 moves in the vibration direction (+X, −X). The elastic member 60, 260, 460, and 560 may restrict the vibration of the vibration module 50, 150, 250, 350, 450, and 550 to a predetermined range.

The elastic member 60, 260, 460, and 560 exerts an elastic force on the vibration module 50, 150, 250, 350, 450, and 550 when the vibration module 50, 150, 250, 350, 450, and 550 vibrates. The vibration pattern (amplitude and vibration frequency) of the vibration module 50, 150, 250, 350, 450, and 550 may be determined by putting together the elastic force of at least one elastic member 60, 260, 460, and 560 and the centrifugal force of at least one eccentric portion 55 and 56. The vibration pattern (amplitude and vibration frequency) of the vibration module 50, 150, 250, 350, 450, and 550 may be determined by putting together the elastic force of at least one elastic member 60, 260, 460, and 560, the centrifugal force of at least one eccentric portion 55 and 56, and the damping force c·dx/dt determined by factors like structure, clothes, etc.

One end of the elastic member 60, 260, 460, and 560 is fixed to the vibration module 50, 150, 250, 350, 450, and 550, and the other end is fixed to a supporting member 270, 470, and 570. The elastic member 60, 260, 460, and 560 60, 260, 460, and 560 may comprise a spring or a mainspring. The supporting member 270, 470, and 570 may comprise a tension spring, a compression spring, or a torsion spring.

Referring to FIGS. 3*a* to 4*d* and FIGS. 8 to 10, an elastic member 60 and 260 according to first and second exemplary embodiments is configured to elastically deform or regain its elasticity when the vibration module 150 and 250 reciprocates in the vibration direction (+X, −X). The elastic member 60 and 260 may restrict the vibration of the vibration module 50 and 150 to a predetermined distance range. In the first and second exemplary embodiments, the elastic member 60 and 260 may comprise a compression spring or a tension spring.

Referring to FIGS. 5*a* to 7*d*, FIGS. 11 to 14, and FIGS. 17 to 23, an elastic member 60, 460, and 560 according to third to fifth exemplary embodiments is configured to elastically deform or regain its elasticity when the vibration module 350, 450, and 550 rotates around the center axis Oc. The elastic member 60, 460, and 560 may restrict the vibration of the vibration module 350, 450, and 550 to a predetermined angular range. In the third and fifth exemplary embodiments, the elastic member 60, 460, and 560 may comprise a torsion spring.

The at least one elastic member 60 may comprise a plurality of elastic members 60*a* and 60*b*. The plurality of elastic members 60*a* and 60*b* may comprise a first elastic member 60*a* that elastically deforms when the vibration module 50, 150, 250, 350, 450, and 550 moves to one side in the vibration direction (+X, −X), and a second elastic member 60*b* that elastically deforms when it moves to the other side.

Referring to FIGS. 8 to 14 and FIGS. 17 to 23, the supporting member 270, 470, and 570 is fixed to the frame 10. The supporting member 270, 470, and 570 may be fixed to the interior frame 11*a*. The supporting member 270, 470, and 570 may support the elastic member 60, 260, 460, and 560. One end of the elastic member 60, 260, 460, and 560 is fixed to the vibration module 50, 150, 250, 350, 450, and 550, and the other end of the elastic member 60, 260, and 460, and 560 is fixed to the supporting member 270, 470, and 570.

Figure 8:
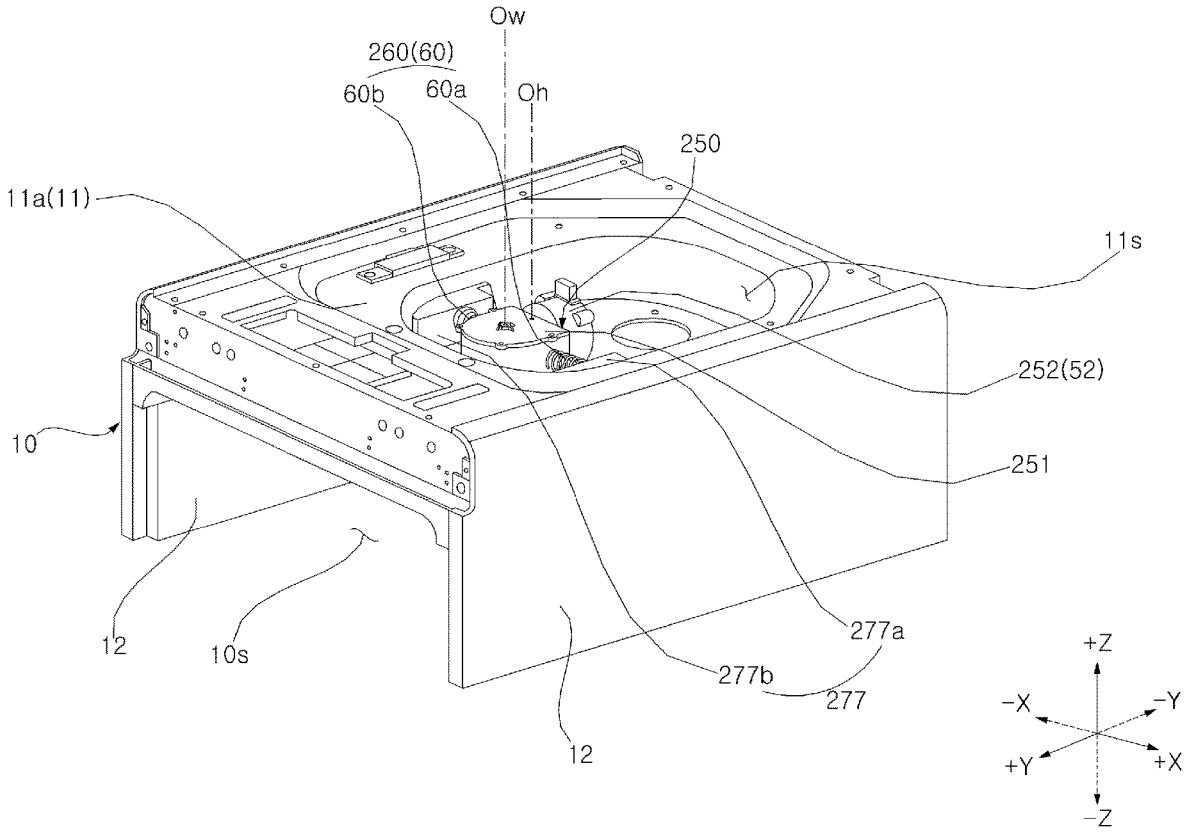
FIG. 8 is a partial perspective view showing a structural example of the vibration module 250, elastic member 260, and supporting member 270 according to the second exemplary embodiment in FIGS. 4*a* to 4*d*, from which the exterior frame 11*b* is omitted.
Figure 9:
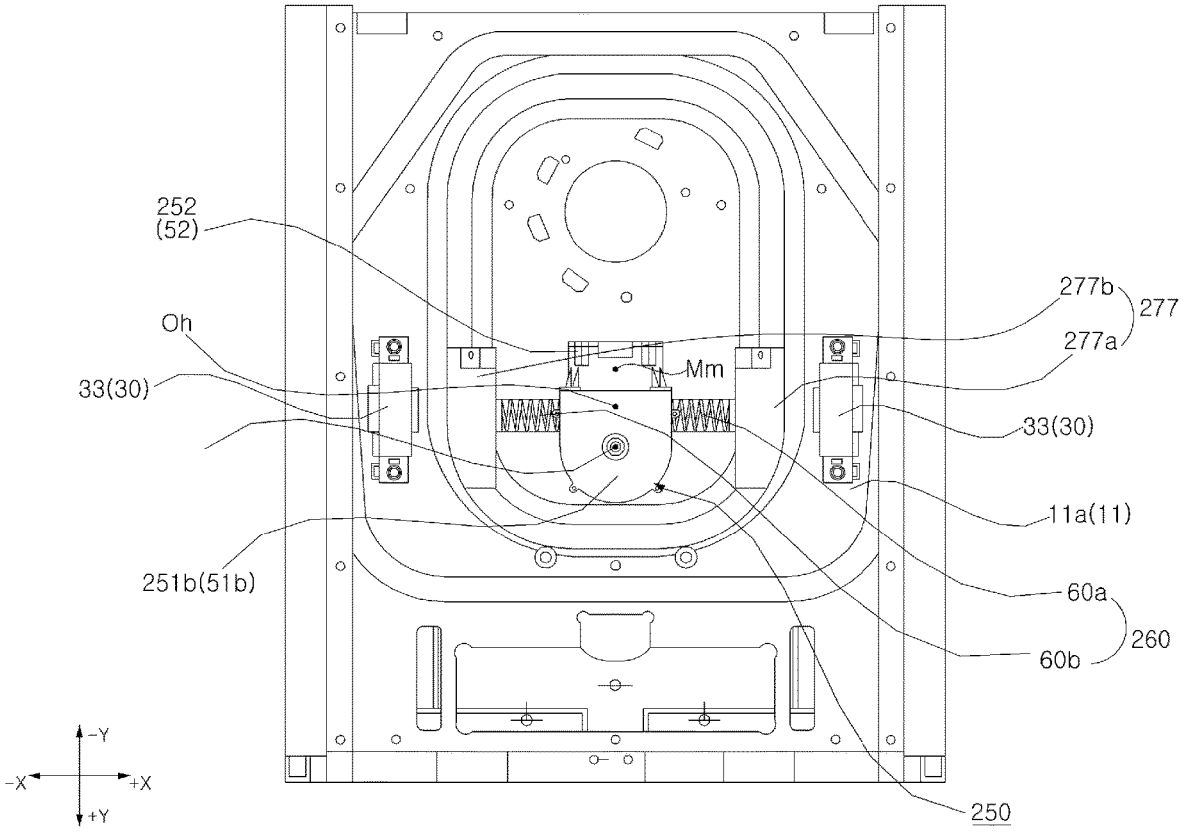
FIG. 9 is a top elevation view of the structural example of FIG. 8.

Referring to FIGS. 8 to 10, the supporting member 270 according to the first and second exemplary embodiments does not need to support the vibration module 250. The vibration module 250 may be supported by the hanger module 230. The supporting member 270 may slidably support the vibration module 250. The supporting member 270 may guide the vibration direction (+X, −X) of the vibration module 250. The supporting member 270 may function as a guide that restricts the movement of the vibration module 250 in a direction other than a predetermined direction (+X, −X).

Referring to FIGS. 11 to 14 and FIGS. 17 to 23, the supporting member 470 and 570 according to the third to fifth exemplary embodiments supports the vibration module 450 and 550. The vibration module 450 and 550 may be supported by the interior frame 11*a*. The vibration module 450 and 550 may be fixed to the frame 10 by the supporting member 470 and 570. The supporting member 470 and 570 movably supports the vibration module 450 and 550. The supporting member 470 and 570 rotatably supports the vibration module 450 and 550. The supporting member 470 and 570 supports the vibration module 450 and 550 in such a way as to make it movable around the center axis Oc. The supporting member 470 and 570 supports the vibrating body 451 and 551. The vibrating body 451 and 551 may be connected to the frame 10 by the supporting member 470 and 570.

Referring to FIGS. 3*a* to 8, FIG. 11, and FIG. 17, the vibration module 50, 150, 250, 350, 450, and 550 will be briefly described below. The vibration module 50, 150, 250, 350, 450, and 550 generates vibration. The vibration module 50, 150, 250, 350, 450, and 550 moves (vibrates) the hanger body 31, 231, and 431. The vibration module 50, 150, 250, 350, 450, and 550 is connected to the hanger body 31, 231, and 431, and transmits vibrations from the vibration module 50, 150, 250, 350, 450, and 550 to the hanger body 31, 231, and 431.

The vibration module 50, 150, 250, 350, 450, and 550 may be disposed between the interior frame 11*a* and the exterior frame 11*b*. The interior frame 11*a* on the upper side may be recessed downward to form the configuration space 11*s*, and the vibration module 50, 150, 250, 350, 450, and 550 may be disposed in the configuration space 11*s*.

The vibration module 50, 150, 250, 350, 450, and 550 may be located above the treatment space 10*s*. The vibration module 50, 150, 250, 350, 450, and 550 may be disposed above the hanger body 31, 231, and 431.

Referring to FIGS. 3*a* to 4*d*, the vibration module 150 and 250 according to the first and second exemplary embodiments is configured in such a way as to linearly reciprocate in a predetermined vibration direction (+X, −X). The elastic member 60 is configured to elastically deform or regain its elasticity when the vibration module 150 and 250 linearly reciprocates. The position of the vibration module 150 and 250 relative to the hanger body 231 is fixed. The hanger driving unit 258 connects and holds together the vibration module 150 and 250 and the hanger body 231. The vibration module 150 and 250 and the hanger body 231 vibrate as a single unit.

The vibration module 150 and 250 may be configured to reciprocate only within a predetermined distance range. For example, the frame 10 or the supporting member 270 may comprise a limit portion that can come into contact with the vibration module 150 and 250, so as to restrict the range of reciprocating motion of the vibration module 150 and 250. In another example, the elastic force of the elastic member 60 increases as the vibration module 150 and 250 moves, thus limiting the range of movement (vibration) of the vibration module 150 and 250.

Referring to FIGS. 5*a* to 7*d*, a predetermined center axis Oc is preset on the vibration module 350, 450, and 550 according to the third to fifth exemplary embodiments. The vibration module 350, 450, and 550 is configured in such a way as to rotate and reciprocate around a predetermined center axis Oc where the position relative to the frame 10 is fixed. The supporting member 470 and 570 rotatably supports the vibration module 350, 450, and 550. The hanger body 431 and the vibration module 350, 450, and 550 are connected on a predetermined connection axis Oh spaced apart from the center axis Oc. The hanger driving unit 458 and 558 rotates and reciprocates, integrally with the vibration module 150 and 250, and the protruding portion 458*a* and 558*a* makes relative motion in the front-back direction (+Y, −Y) along the slit 431*bh* formed in the hanger body 431, thereby transmitting excitation force Fo(t) to the vibration module 350, 450, and 550 only in the vibration direction (+X, −X). The elastic member 60 is configured to elastically deform or regain its elasticity when the vibration module 350, 450, and 550 rotates and reciprocates.

The vibration module 350, 450, and 550 may be configured to rotate only within a predetermined angular range. For example, the frame 10 or the supporting member 470 and 570 may comprise a limit portion that can come into contact with the vibration module 350, 450, and 550, so as to restrict the range of rotation of the vibration module 350, 450, and 550. In another example, the elastic force of the elastic member 60 increases as the vibration module 350, 450, and 550 rotates, thus limiting the range of rotation of the vibration module 350, 450, and 550.

The vibration module 50, 150, 250, 350, 450, and 550 may comprise a vibrating body 251, 451, and 551 configured to move with respect to the frame 10. The vibrating body 251, 451, and 551 may form the outer appearance of the vibration module 50, 150, 250, 350, 450, and 550.

The vibrating body 251, 451, and 551 supports the motor 52. The vibrating body 251, 451, and 551 and the hanger driving unit 258, 458, and 558 are fixed to each other. The vibrating body 251, 451, and 551 supports a weight shaft 54. The vibrating body 251, 451, and 551 supports a first eccentric portion 55 and a second eccentric portion 56. The vibrating body 251, 451, and 551 may accommodate the first eccentric portion 55 and the second eccentric portion 56 in it.

The vibration module 50, 150, 250, 350, 450, and 550 comprises at least one eccentric portion 55 or 55 and 56 that rotates around at least one predetermined rotational axis Ow or Ow1 and Ow2 in such a way that the weight is off-center.

In the first to third exemplary embodiment with reference to FIG. 3*a*, FIG. 3*b*, FIG. 5*a*, and FIG. 5*b*, the vibration module 150 and 350 comprises an eccentric portion 55 that rotates around the rotational axis Ow in such a way that the weight is off-center.

In the second, fourth, and fifth exemplary embodiments with reference to FIGS. 4*a* to 4*d* and FIGS. 6*a* to 7*d*, the vibration module 250, 450, and 550 comprises a first eccentric portion 55 that rotates around the first rotational axis Ow and Ow1 in such a way that the weight is off-center, and a second eccentric portion 56 that rotates around a predetermined second rotational axis Ow and Ow2, which is the same as or parallel to the first rotational axis Ow and Ow1, in such a way that the weight is off-center. This can efficiently reduce the vibrations generated in the direction (+Y, −Y) intersecting the vibration direction (+X, −X). The vibration module 250 and 450 according to the second and fourth exemplary embodiments comprises a first eccentric portion 55 and second eccentric portion 56 that rotate around the same rotational axis Ow in such a way that the weight is off-center. The vibration module 55 according to the fifth exemplary embodiment comprises a first eccentric portion 55 that rotates around the first rotational axis Ow1 in such a way that the weight is off-center, and a second eccentric portion 56 that rotates around the second rotational axis Ow2, which is different from the first rotational axis Ow2 in such a way that the weight is off-center.

The eccentric portion 55 and 56 may be supported by the vibrating body 51, 251, 451, and 551. At least one eccentric portion 55 or 55 and 56 may be rotatably supported by at least one weight shaft 54 or 554*a* and 554*b* disposed on the vibrating body 51, 251, 451, and 551. The at least one eccentric portion 55 or 55 and 56 according to the first to fourth exemplary embodiments may be rotatably supported by one weight shaft 54. The first eccentric portion 55 and second eccentric portion 56 according to the fifth exemplary embodiment may be rotatably supported by a first weight shaft 554*a* and a second weight shaft 554*b*, respectively.

The eccentric portion 55 and 56 comprises a rotating portion 55*b*, 56*b*, 555*b*, and 556*b* that rotates around the rotational axis Ow, Ow1, and Ow2 in contact with a transmitting portion 53 and 553. The rotating portion 55*b*, 56*b*, 555*b*, and 556*b* receives torques from the transmitting portion 53 and 553. The rotating portion 55*b*, 56*b*, 555*b*, and 556*b* may be formed entirely in the shape of a cylinder around the corresponding rotational axis Ow, Ow1, and Ow2.

The eccentric portion 55 and 56 comprises a weight member 55*a*, 56*a*, 555*a*, and 556*a* fixed to the corresponding rotating portion 55*b*, 56*b*, 555*b*, and 556*b*. The weight member 55*a*, 56*a*, 555*a*, and 556*a* rotates integrally with the corresponding rotating portion 55*b*, 56*b*, 555*b*, and 556*b*. The weight member 55*a*, 56*a*, 555*a*, and 556*a* is made of a material with a specific gravity higher than that of the corresponding rotating portion 55*b*, 56*b*, 555*b*, and 556*b*. The weight member 55*a*, 56*a*, 555*a*, and 556*a* is placed on one side of the corresponding rotational axis, and causes the weight of the corresponding eccentric portion 55 and 56 to be off-centered. The weight member 55*a*, 56*a*, 555*a*, and 556*a* may be formed entirely in the shape of a column whose base is semi-circular.

The vibration module 50, 150, 250, 350, 450, and 550 may comprise a motor 52 and 552 that generates torque for at least one eccentric portion 55 or 55 and 56. The motor 52 and 552 is disposed on the vibrating body 251, 451, and 551. The motor 52 and 552 comprises a rotating motor shaft 52*a* and 552*a*. The motor shaft 52*a* and 552*a* transmits torque to the transmitting portion 53 and 553.

The vibration module 50, 150, 250, 350, 450, and 550 may comprise a transmitting portion 53 and 553 that transmits the torque of the motor 52 to at least one eccentric portion 55 or 55 and 56. The transmitting portion 53 and 553 is disposed on the vibrating body 251, 451, and 551. The transmitting portion 53 and 553 may comprise a gear, belt, and/or pulley.

The vibration module 50, 150, 250, 350, 450, and 550 comprises a hanger driving unit 258, 458, and 558 that connects the vibrating body 251, 451, and 551 and the hanger body 31, 231, and 431. The hanger driving unit 258, 458, and 558 is configured to connect the vibration module 50, 150, 250, 350, 450, and 550 and the hanger body 31, 231, and 431. The hanger driving unit 258, 458, and 558 transmits the vibration of the vibration module 50, 150, 250, 350, 450, and 550 to the hanger body 31, 231, and 431. The hanger driving unit 258, 458, and 558 may transmit the vibration of the vibrating body 251, 451, and 551 to the hanger body 31, 231, and 431, along the connection axis Oh.

The vibration module 50, 150, 250, 350, 450, and 550 comprises an elastic member locking portion 259, 459, and 559 on which one end of the elastic member 60, 260, 460, and 560 is locked. The elastic member locking portion 259, 459, and 559 may be disposed on the vibrating body 251, 451, and 551. The elastic member locking portion 259, 459, and 559 may apply pressure to the elastic member 60, 260, 460, and 560 or receive elastic force from the elastic member 60, 260, 460, and 560, when the vibration module 50, 150, 250, 350, 450, and 550 moves.

Hereinafter, terms and reference numerals related to the operating mechanism of the vibration module 50, 150, 250, 350, 450, and 550 will be described below with reference to FIGS. 2 to 7*d*.

The vibration direction (+X, −X) refers to a preset direction in which the hanger body 31, 231, and 431 reciprocates. In this exemplary embodiment, the left-right direction is preset as the vibration direction (+X, −X).

The "center axis Oc, rotational axis Ow, Ow1, and Ow2, and connection axis Oh" mentioned throughout the present disclosure are imaginary axes used to describe the present disclosure, and do not designate actual components of the apparatus.

The rotational axis Ow, Ow1, and Ow2 refers to an imaginary straight line through the center of rotation of the corresponding eccentric portion 55 and 56. The rotational axis Ow, Ow1, and Ow2 maintains a fixed position relative to the vibration module 251, 451, and 551. That is, even when the vibrating body 251, 451, and 551 moves, the rotational axis Ow, Ow1, and Ow2 moves integrally with the vibrating body 251, 451, and 551 and maintains the position relative to the vibrating body 251, 451, and 551. The rotational axis Ow, Ow1, and Ow2 may extend vertically.

To provide the function of the rotational axis Ow, Ow1, and Ow2, the weight shaft 54, 554*a*, and 554*b* disposed on the rotational axis Ow, Ow1, and Ow2 may be provided as in this exemplary embodiment. To provide the function of the rotational axis Ow, Ow1, and Ow2, in another exemplary embodiment, a projection protruding along the rotational axis Ow, Ow1, and Ow2 may be formed on either the eccentric portion 55 and 56 or the vibrating body 251, 451, and 551, and a groove with which the projection rotatably engages may be formed in the other.

The rotational axis Ow, Ow1, and Ow2 may be disposed perpendicular to the vibration direction (+X, −X). The first rotational axis Ow1 and the second rotational axis Ow2 may be disposed perpendicular to the vibration direction (+X, −X).

The connection axis Oh refers to an imaginary straight line through the point at which excitation force Fo(t) is applied to the hanger body 251, 451, and 551 by the vibration generated by the vibration module 50, 150, 250, 350, 450, and 550. The connection axis Oh may be defined as a straight line that passes through the point of action of excitation force Fo(t) and extends vertically. The connection axis Oh maintains a fixed position relative to the vibrating body 251, 451, and 551. That is, even when the vibrating body 251, 451, and 551 moves, the connection axis Oh moves integrally with the vibrating body 251, 451, and 551 and maintains the position relative to the vibrating body 251, 451, and 551.

In the third to fifth exemplary embodiments with reference to FIGS. 5*a* to 7*d*, the center axis Oc refers to an imaginary straight line through the center of rotation of the vibration module 350, 450, and 550. The center axis Oc is an imaginary straight line that maintains a fixed position relative to the frame 10. The center axis Oc may extend vertically.

To provide the function of the center axis Oc, a center axial portion 475 and 575 protruding along the center axis Oc may be formed on the supporting member 70, and a central groove 551*h* or hole with which the center axial portion 475 and 575 rotatably engages may be formed in the vibrating body 451 and 551, as in this exemplary embodiment. To provide the function of the center axis Oc, in another exemplary embodiment, a projection protruding along the center axis Oc may be formed on the vibrating body 451 and 551, and a groove with which the projection rotatably engages may be formed in the supporting member 470 and 570.

In the third to fifth exemplary embodiments with reference to FIGS. 5*a* to 7*d*, the rotational axis Ow, Ow1, and Ow2 and the center axis Oc are placed apart in parallel with each other. This allows the vibration module 350, 450, and 550 to efficiently rotate and vibrate by the centrifugal force F1 and F2 caused by the rotation of the eccentric portion 55 and 56.

In the third to fifth exemplary embodiments with reference to FIGS. 5*a* to 7*d*, the connection axis Oh and the center axis Oc are placed apart in parallel with each other. The vibration module 350, 450, and 550 and the hanger body 31 and 431 are connected together so that the rotating and reciprocating motion (arc motion) of the vibration module 350, 450, and 550 is converted into the linear reciprocating motion of the hanger body 31 and 431.

In the third to fifth exemplary embodiments with reference to FIGS. 5*a* to 7*d*, the circumferential direction DI refers to the direction of a perimeter around the center axis Oc, and encompasses the clockwise direction DI1 and the counterclockwise direction DI2. The clockwise direction DI1 and the counterclockwise direction DI2 are defined as viewed from one of the extension directions (+Z, −Z) of the center axis Oc. Also, the diametrical direction Dr refers to a direction across the center axis Oc, and encompasses the centrifugal direction Dr1 and the mesial direction Dr2. The centrifugal direction Dr1 refers to a direction away from the center axis Oc, and the mesial direction Dr2 refers to a direction toward the center axis Oc.

In the third to fifth exemplary embodiments, when the centrifugal force F1 with respect to the rotational axis Ow and Ow1 caused by the rotation of the eccentric portion 55 is directed in the circumferential direction DI, the centrifugal force F1 causes a rotation of the vibration module 350, 450, and 550 on the center axis Oc.

In the third to fifth exemplary embodiments, when the centrifugal force F1 with respect to the rotational axis Ow and Ow1 caused by the rotation of the eccentric portion 55 is directed in the diametrical direction Dr, the centrifugal force F1 causes no rotation of the vibration module 350, 450, and 550 on the center axis Oc.

In the fourth and fifth exemplary embodiments, when the centrifugal force F1 with respect to the rotational axis Ow and Ow1 caused by the rotation of the first eccentric portion 55 is directed in the circumferential direction DI, the centrifugal force F1 cause a rotation of the vibration module 450 and 550 on the center axis Oc, and, when the centrifugal force F2 with respect to the rotational axis Ow and Ow2 caused by the rotation of the second eccentric portion 56 is directed in the circumferential direction DI, the centrifugal force F2 causes a rotation of the vibration module 450 and 550 on the center axis Oc.

In the fourth and fifth exemplary embodiments, when the centrifugal force F1 with respect to the rotational axis Ow and Ow1 caused by the rotation of the first eccentric portion 55 is directed in the diametrical direction Dr, the centrifugal force F1 causes no rotation of the vibration module 450 and 550 on the center axis Oc, and, when the centrifugal force F2 with respect to the rotational axis Ow and Ow2 caused by the rotation of the second eccentric portion 56 is directed in the diametrical direction Dr, the centrifugal force F2 causes no rotation of the vibration module 450 and 550 on the center axis Oc.

FIGS. 3*a* to 7*d* illustrate the center m, m1, and m2 of mass of the eccentric portion 55 and 56, the radius r, r1, and r2 of rotation of the center of mass m, m1, and m2 with respect to the corresponding rotational axis Ow, Ow1, and Ow2, and the angular speed w of the eccentric portion 55 and 56 around the corresponding rotational axis Ow, Ow1, and Ow2.

Also, FIGS. 5*a* to 7*d* illustrate the distance A, A1, and A2 between the center axis Oc and the rotational axis Ow, Ow1, and Ow2, the distance B between the center axis Oc and the connection axis Oh, and the angle θ of rotation of the vibration module 350, 450, and 550 around the center axis Oc.

FIGS. 3*a* to 7*d* illustrate the direction of the centrifugal force F1 of the eccentric portion 55 with respect to the rotational axis Ow and Ow1, and FIGS. 4*a* to 4*d* and FIGS. 6*a* to 7*d* illustrate the direction of the centrifugal force F2 of the eccentric portion 56 with respect to the rotational axis Ow and Ow2 as well. The centrifugal forces F1 and F2 are applied to the vibration module 50, 150, 250, 350, 450, and 550.

The excitation force Fo(t) is a force applied to the hanger body 31, 231, and 431 by the centrifugal forces F1 and F2, which refers to an external force along the vibration direction (+X, −X) with respect to time t. In this exemplary embodiment, the formula $Fo(t)=Fo\cdot\cos wt$ is satisfied.

In the first and third exemplary embodiments (see FIG. 3*a*, FIG. 3*b*, FIG. 5*a*, and FIG. 5*b*) in which one eccentric portion 55 is provided, the magnitude of the centrifugal force F1 is $m\cdot r\cdot w^2$. The centrifugal force F1 is exerted on the vibration module 150 and 350, and the point of action of the centrifugal force F1 is positioned on the rotational axis Ow.

In the second, fourth, and fifth exemplary embodiments (see FIGS. 4*a* to 4*d* and FIGS. 6*a* to 7*d*) in which two eccentric portions 55 and 56 are provided, the magnitude of the centrifugal force F1 is $m1\cdot r1\cdot w^2$, and the magnitude of the centrifugal force F2 is $m2\cdot r2\cdot w^2$. The centrifugal forces F1 and F2 are exerted on the vibration module 250, 450, and the points of action of the centrifugal forces F1 and F2 are positioned on the rotational axis Ow and Ow1 and rotational axis Ow and Ow2, respectively.

In the second, fourth, and fifth exemplary embodiments, the centrifugal force F1 and the centrifugal force F2 are set to reinforce each other when they generate an excitation force Fo(t) in the vibration direction (+X, −X).

In the second, fourth, and fifth exemplary embodiments, the centrifugal force F1 and the centrifugal force F2 are set to offset each other when they generate no excitation force Fo(t) in the vibration direction (+X, −X). In this case, the centrifugal force F1 and the centrifugal force F2 act in opposite directions and are exerted on the same line of action, and therefore the sum of the centrifugal forces F1 and F2 is equal to the difference between the magnitude of the centrifugal force F1 and the magnitude of the centrifugal force F2. Thus, at least one of the centrifugal forces F1 and F2 is offset by the other.

Here, it is desirable that the centrifugal force F1 and the centrifugal force F2 are set to "completely offset" each other when they generate no excitation force Fo(t) in a predetermined vibration direction (+X, −X). To this end, it is desirable that the scalar quantity $m1\cdot r1$ and the scalar quantity $m2\cdot r2$ are set equal. In an example, they may be preset to meet the two conditions $r1=r2$ and $m1=m2$. In another example, even if the radius r1 of rotation and the radius r2 of rotation are different and the mass m1 and the mass m2 are different, $m1\cdot r1$ and $m2\cdot r2$ may be set equal so that the centrifugal force F1 and centrifugal force F2 in the intersecting direction (+Y, −Y) completely offset each other.

In the second, fourth, and fifth exemplary embodiments, the first eccentric portion 55 and the second eccentric portion 56 may be configured to rotate at the same angular speed w. This allows for periodic reinforcement and offsetting of the centrifugal forces F1 and F2 caused by the rotation of the first eccentric portion 55 and second eccentric portion 56.

Here, the angular speed refers to a scalar which only has magnitude but no direction of rotation, which is different from angular velocity which is a vector having both direction of rotation and magnitude. That is, if the angular speed w of the first eccentric portion 55 and the angular speed w of the second eccentric portion 56 are equal, this does not mean that they rotate in the same direction. In the second and fourth exemplary embodiments, even if the angular speed w of the first eccentric portion 55 and the angular speed w of the second eccentric portion 56 are equal, the first eccentric portion 55 and the second eccentric portion 56 rotate in opposite directions of rotation. In the fifth exemplary embodiment, the angular speed w of the first eccentric portion 55 and the angular speed w of the second eccentric portion 56 are equal and rotate in the same direction of rotation.

In the second, fourth, and fifth exemplary embodiments, i) the distance A and A1 between the first rotational axis Ow and Ow1 of the first eccentric portion 55; and ii) the center axis Oc and the distance A and A2 between the second rotational axis Ow and Ow2 of the second eccentric portion 56 may be set equal.

In the second, fourth, and fifth exemplary embodiments, the first rotational axis Ow and Ow1 and the second rotational axis Ow and Ow2 may be spaced apart from the center axis Oc in the same direction or in opposite directions. The center axis Oc, first rotational axis Ow1, and second rotational axis Ow2 are disposed to intersect an imaginary straight line at a right angle.

In the second and fourth exemplary embodiments, the first rotational axis Ow and the second rotational axis Ow are spaced apart from the center axis Oc in the same direction.

In the fifth exemplary embodiment, the first rotational axis Ow1 and the second rotational axis Ow2 are spaced apart from the center axis Oc in opposite directions. This allows the vibration module 550 to be off-centered to one side of the center axis Oc, thereby reducing the risk of putting stress on the structure.

Hereinafter, referring to FIGS. 3*a* to 7*d*, the excitation force Fo(t) for each exemplary embodiment can be calculated as follows. Here, the excitation force Fo(t) is calculated on the presumption that the eccentric portion 55 and 56 rotates at a specific angular speed w.

In the first and second exemplary embodiments with reference to FIGS. 3*a* to 4*d*, when the centrifugal forces F1 and F2 with respect to the corresponding rotational axis Ow caused by the rotation of the eccentric portion 55 and 56 are directed in the vibration direction (+X, −X), the centrifugal forces F1 and F2 cause a linear motion of the vibration module 150 and 250 in the vibration direction (+X, −X). On the other hand, when the centrifugal forces F1 and F2 with respect to the corresponding rotational axis Ow caused by the rotation of the eccentric portion 55 and 56 are directed in a direction (+Y, −Y) intersecting the vibration direction (+X, −X), the centrifugal forces F1 and F2 cause no linear motion of the vibration module 150 and 250 in the vibration direction (+X, −X).

In the third to fifth exemplary embodiments with reference to FIGS. 5*a* to 7*d*, when the centrifugal forces F1 and F2 with respect to the corresponding rotational axis Ow, Ow1, and Ow2 caused by the rotation of the eccentric portion 55 and 56 are directed in the circumferential direction DI, the centrifugal forces F1 and F2 cause a rotation of the vibration module 350, 450, and 550 on the center axis Oc. On the other hand, when the centrifugal force F1 with respect to the corresponding rotational axis Ow, Ow1, and Ow2 caused by the rotation of the eccentric portion 55 and 56 are directed in the diametrical direction Dr, the centrifugal forces F1 and F2 cause no rotation of the vibration module 350, 450, and 550 on the center axis Oc.

Figure 3A:
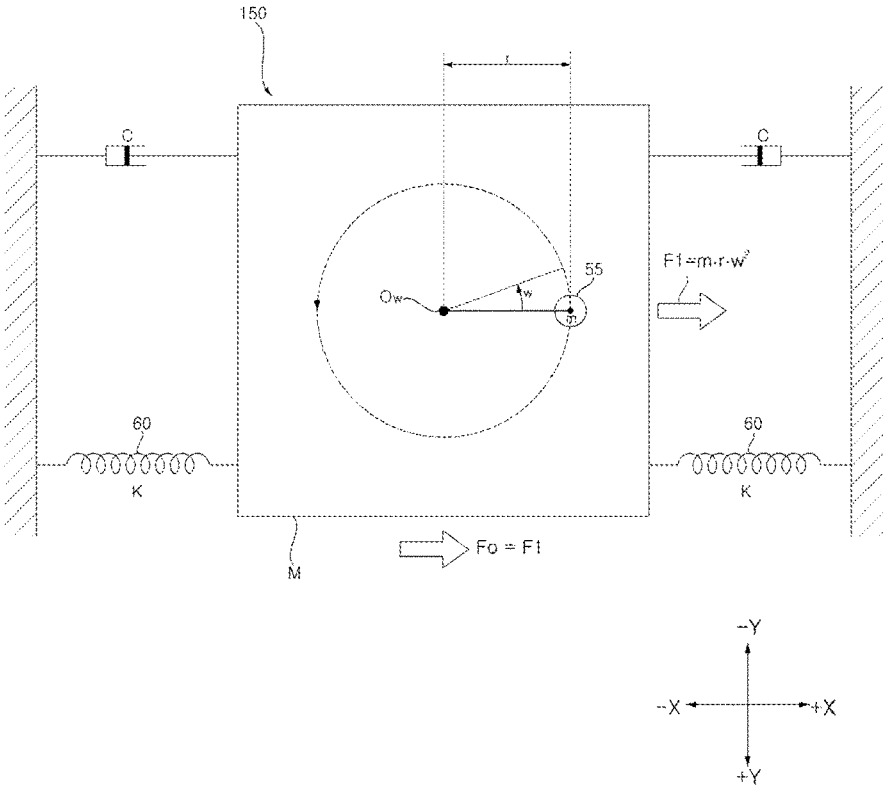
Figure 3B:
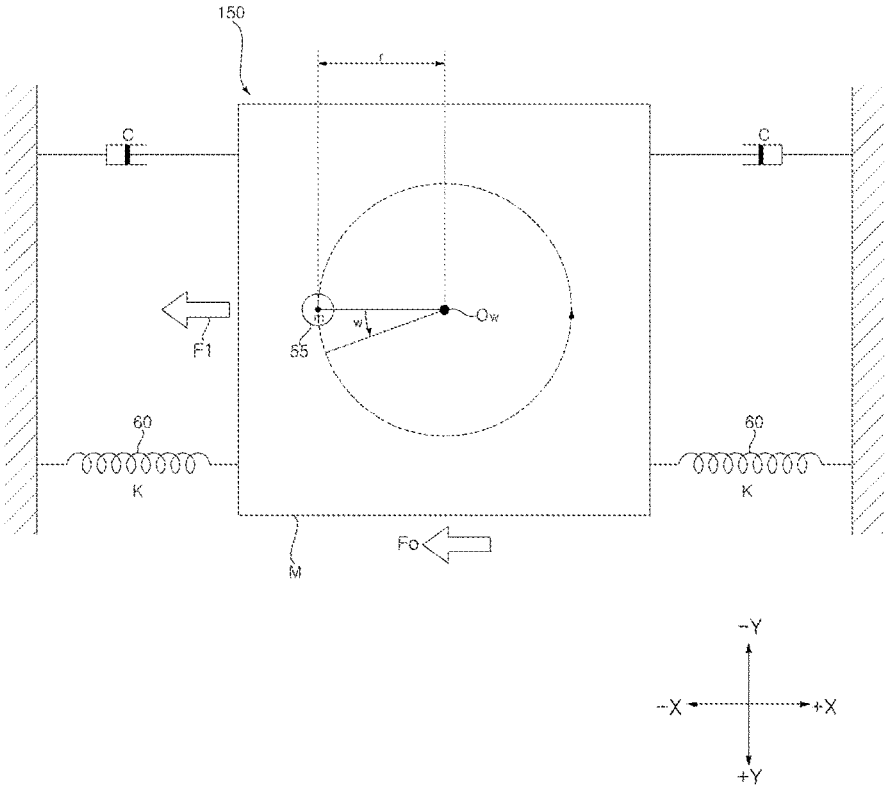

Hereinafter, the first exemplary embodiment with reference to FIGS. 3*a* and 3*b* shows the angular momentum of 180-degree rotation of the eccentric portion 55 rotating at a constant angular speed w. Since the vibration module 150 vibrates integrally with the hanger body 31, the excitation fore Fo(t) can be calculated as the force in the vibration direction (+X, −X) caused by the centrifugal force F1.

Referring to FIG. 3*a*, the excitation force Fo(t) acting on the vibration module 150 in the +X axis direction, caused by the centrifugal force F1, has the maximum value Fo. Here, the excitation force Fo is F1 in the +X axis direction.

Referring to FIG. 3*b*, the excitation force Fo(t) acting on the vibration module 150 in the −X axis direction, caused by the centrifugal force F1, has the maximum value Fo. Here, the excitation force Fo is F1 in the −X axis direction.

Accordingly, the excitation force Fo(t) according to the first exemplary embodiment is given by the following Mathematical Formula 1:

Mathematical Formula 1

$$Fo(t)=F1\cdot\cos wt=m\cdot r\cdot w^2\cdot\cos wt \quad \text{[Formula 1]}$$

Figure 4A:
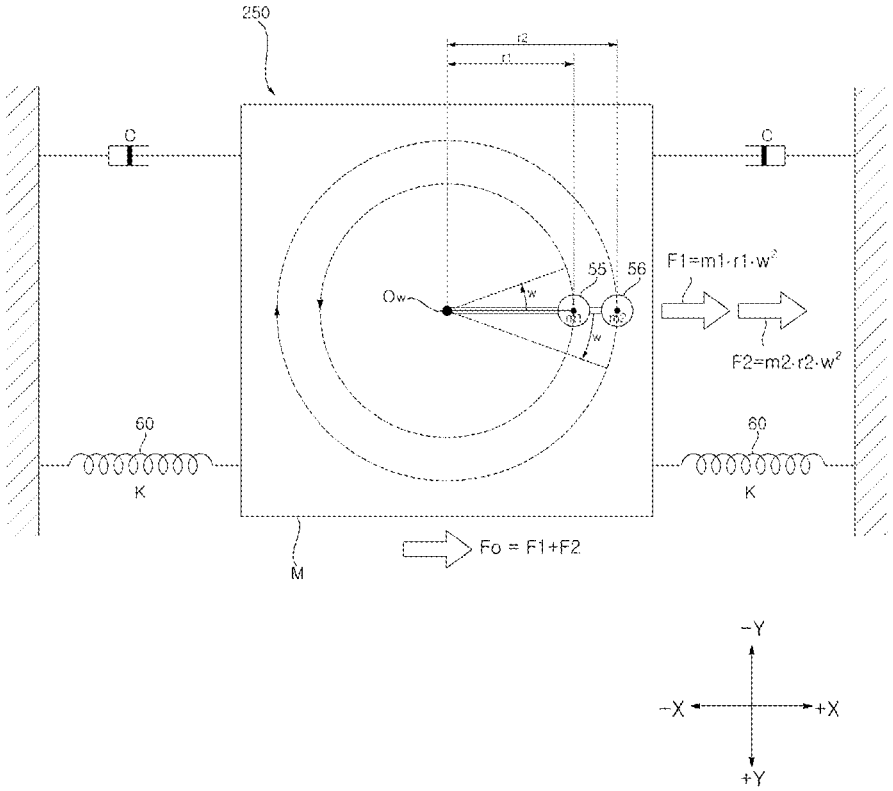
FIGS. 4*a* to 4*d* are views showing the operating principle of the vibration module 250 according to a second exemplary embodiment.
Figure 4B:
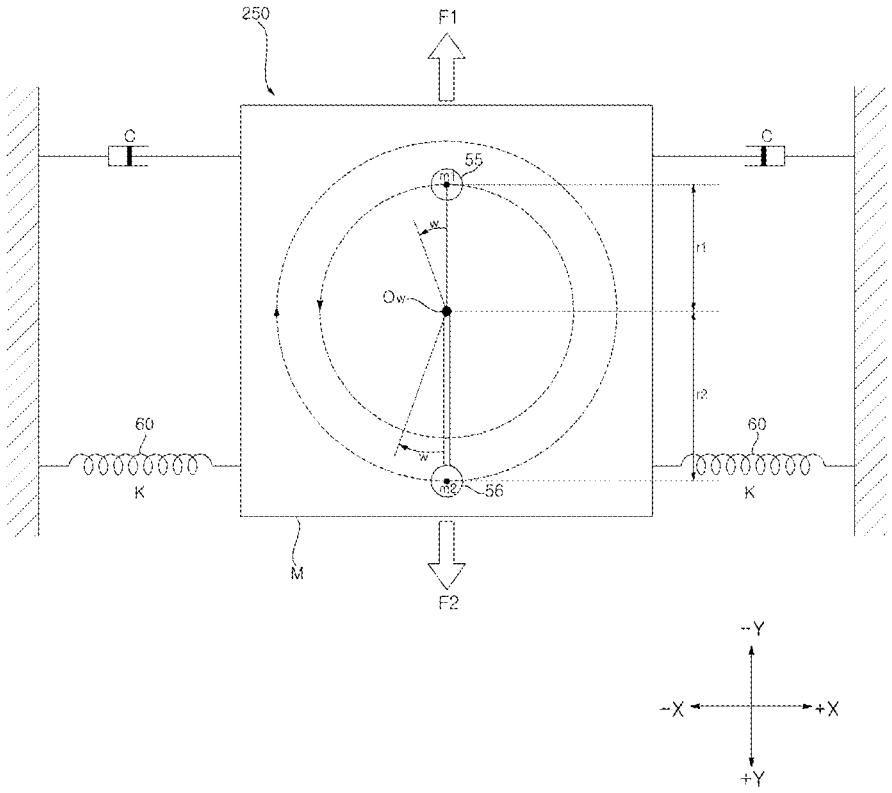

Hereinafter, the second exemplary embodiment with reference to FIGS. 4*a* and 4*b* shows the angular momentum of 90-degree rotation of the first eccentric portion 55 and second eccentric portion 56 rotating at the same constant angular speed w. Since the vibration module 250 vibrates integrally with the hanger body 31, the excitation fore Fo(t) can be calculated as the sum of the centrifugal force F1 and centrifugal force F2 in the vibration direction (+X, −X).

Figure 4C:
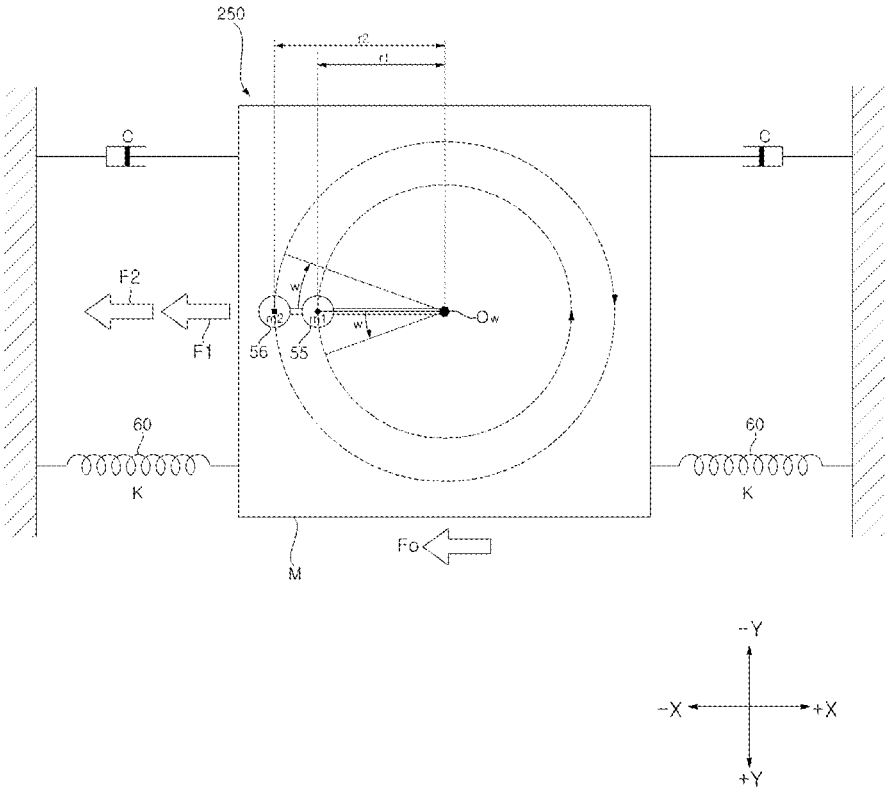

Referring to FIG. 4*a* and FIG. 4*c*, the centrifugal force F1 and the centrifugal force F2 are set to reinforce each other when exerted on the vibration module 250 in the vibration direction (+X, −X). In this case, the excitation force Fo in the vibration direction (+X, −X) caused by the centrifugal force F1 and centrifugal force F2 is F1+F2.

Figure 4D:
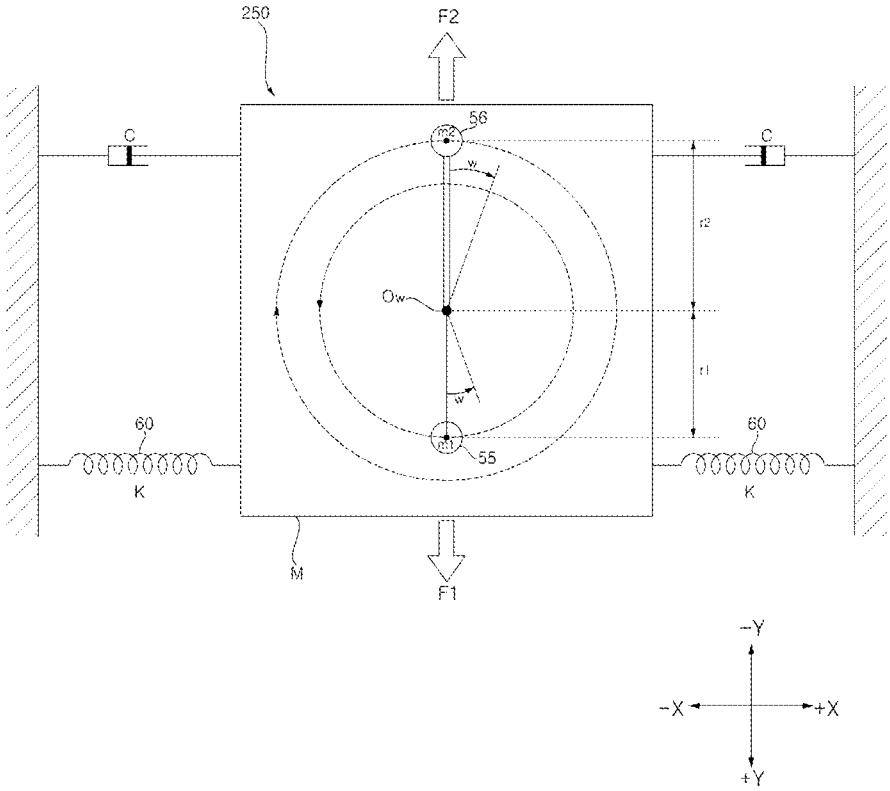

Referring to FIG. 4*b* and FIG. 4*d*, the centrifugal force F1 and the centrifugal force F2 are set to be directed in opposite directions when exerted on the vibration module 250 in the intersecting direction (+Y, −Y). In this case, the excitation force Fo(t) in the vibration direction (+X, −X) caused by the centrifugal force F1 and centrifugal force F2 is zero. Also, the excitation force in the intersecting direction (+Y, −Y) caused by the centrifugal force F1 and centrifugal force F2 is |F1−F2|. Preferably, the excitation force in the intersecting direction (+Y, −Y) caused by the centrifugal force F1 and centrifugal force F2 is preset to zero.

Referring to FIG. 4*a*, the centrifugal force F1 and the centrifugal force F2 reinforce each other and act on the vibration module 250 in the +X axis direction. The excitation force transmitted to the hanger body 31 along the connection axis Oh has the maximum value Fo in the +X axis direction. Here, the excitation force Fo is F1+F2 in the +X axis direction.

Referring to FIG. 4*b*, the centrifugal force F1 and the centrifugal force F2 do not act on the vibration module 250 in the vibration direction (+X, −X). Also, the centrifugal force F1 and centrifugal force F2 acting in opposite directions offset each other. The excitation force in the vibration direction (+X, −X) transmitted to the hanger body 31 along the connection axis Oh is zero.

Referring to FIG. 4*c*, the centrifugal force F1 and the centrifugal force F2 reinforce each other and act on the vibration module 250 in the −X axis direction. The excitation force transmitted to the hanger body 31 along the connection axis Oh has the maximum value Fo in the −X axis direction. Here, the excitation force Fo is F1+F2 in the −X axis direction.

Referring to FIG. 4*d*, the centrifugal force F1 and the centrifugal force F2 do not act on the vibration module 250 in the vibration direction (+X, −X). Also, the centrifugal force F1 and centrifugal force F2 acting in opposite directions offset each other. The excitation force Fo in the vibration direction (+X, −X) transmitted to the hanger body 31 along the connection axis Oh is zero.

Accordingly, the excitation force Fo(t) according to the second exemplary embodiment is given by the following Mathematical Formula 2:

Mathematical Formula 2

$$Fo(t)=(F1+F2)\cdot\cos wt=(m1\cdot r1+m2\cdot r2)\cdot w^2\cdot\cos wt \quad \text{[Formula 2]}$$

where, if m1r1=m2r2, the formula $Fo(t)=2\cdot m1\cdot r1\cdot w^2\cdot\cos wt$ is satisfied.

Figure 5A:
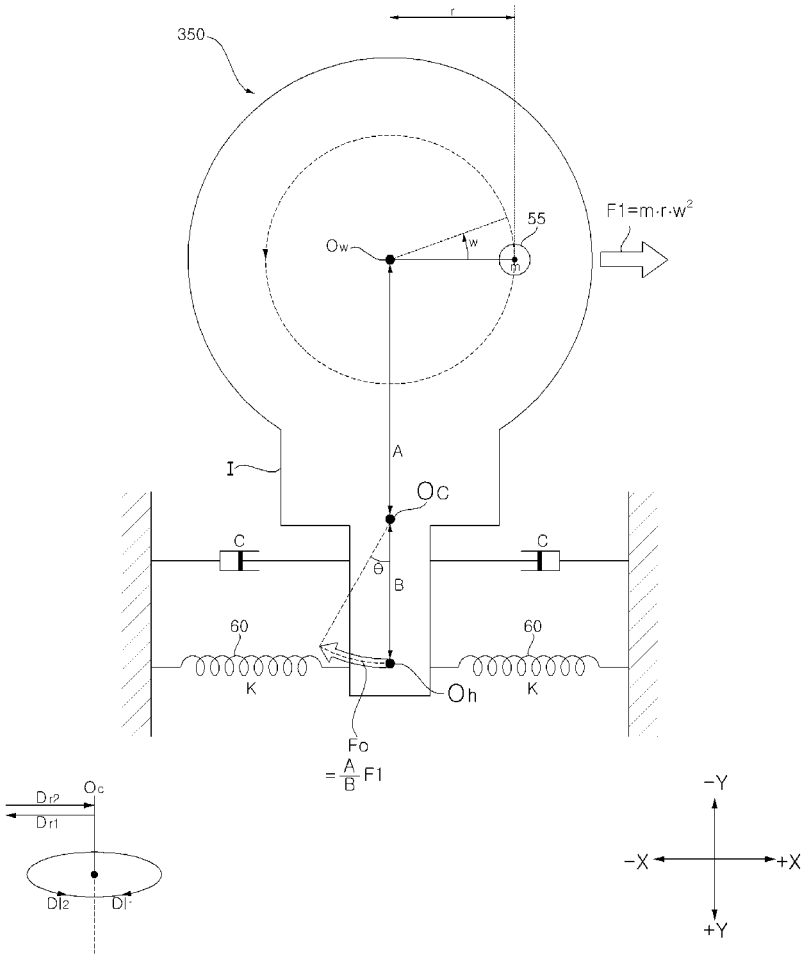
FIGS. 5*a* and 5*b* are views showing the operating principle of the vibration module 450 according to a third exemplary embodiment.
Figure 5B:
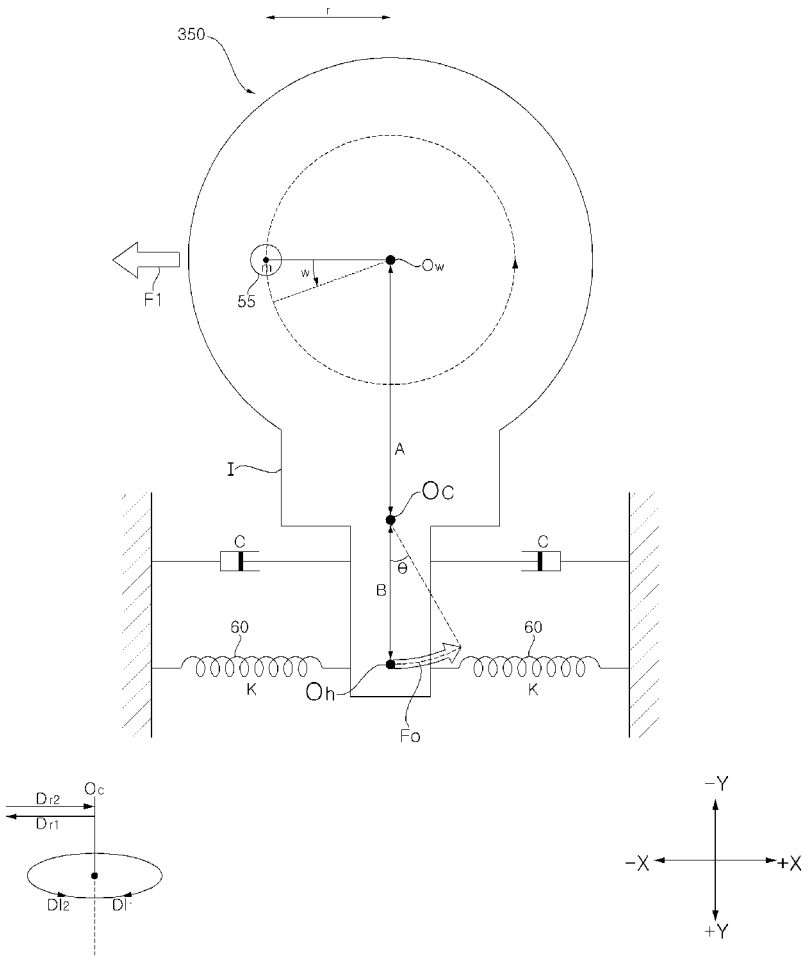

Hereinafter, the third exemplary embodiment with reference to FIGS. 5*a* and 5*b* shows the angular momentum of 180-degree rotation of the eccentric portion 55 rotating at a constant angular speed w. Since the vibration module 350 rotates around the center axis Oc, the excitation fore Fo(t) can be calculated by converting the centrifugal force F1 into an external force with a point of action on the connection axis Oh, taking the moment arm lengths A and B into account.

Referring to FIG. 5*a*, the eccentric portion 55 generates a centrifugal force F1 with respect to the rotational axis Ow in the clockwise direction DI1. Thus, the vibration module 350 has a rotational moment generated in the clockwise direction DI1, and the excitation force transmitted to the hanger body 31 along the connection axis Oh has the maximum value Fo in the −X axis direction. Here, the excitation force Fo is $$\frac{A}{B}\cdot F1$$

in the −X axis direction.

Referring to FIG. 5*b*, the eccentric portion 55 generates a centrifugal force F1 with respect to the rotational axis Ow in the counterclockwise direction DI2. Thus, the vibration module 350 has a rotational movement generated in the counterclockwise direction DI2, and the excitation force transmitted to the hanger body 31 along the connection axis Oh has the maximum value Fo in the +X axis direction. Here, the excitation force Fo is $$\frac{A}{B}\cdot F1$$

in the +X axis direction.

Accordingly, the excitation force Fo(t) according to the third exemplary embodiment is given by the following Mathematical Formula 3:

Mathematical Formula 3

$$Fo(t) = \frac{A}{B}\cdot F1\cdot\cos wt = \frac{A}{B}\cdot m\cdot r\cdot w^2\cdot\cos wt \quad \text{[Formula 3]}$$

Hereinafter, the fourth exemplary embodiment with reference to FIGS. 6*a* to 6*d* shows the angular momentum of 90-degree rotation of the first eccentric portion 55 and second eccentric portion 56 rotating at the same constant angular speed w. Since the vibration module 450 rotates around the center axis Oc, the excitation fore Fo can be calculated by converting the sum of the centrifugal force F1 and centrifugal force F2 into an external force with a point of action on the connection axis Oh, taking the moment arm lengths A and B into account.

Figure 6A:
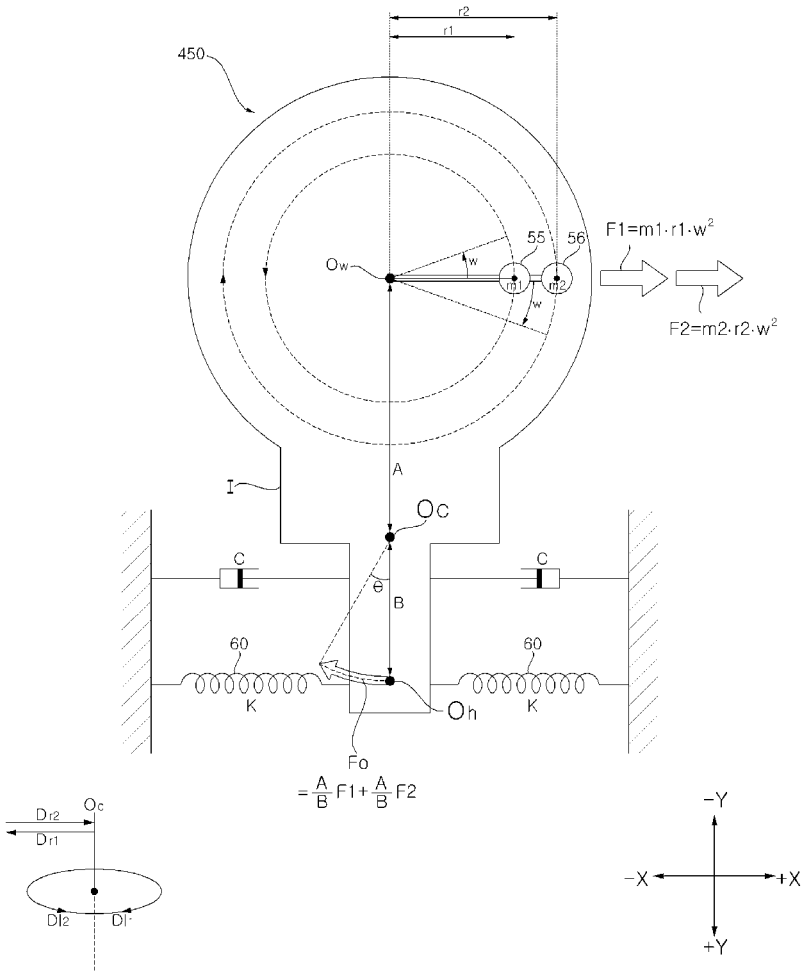
FIGS. 6*a* to 6*d* are views showing the operating principle of the vibration module 250 according to a fourth exemplary embodiment.
Figure 6B:
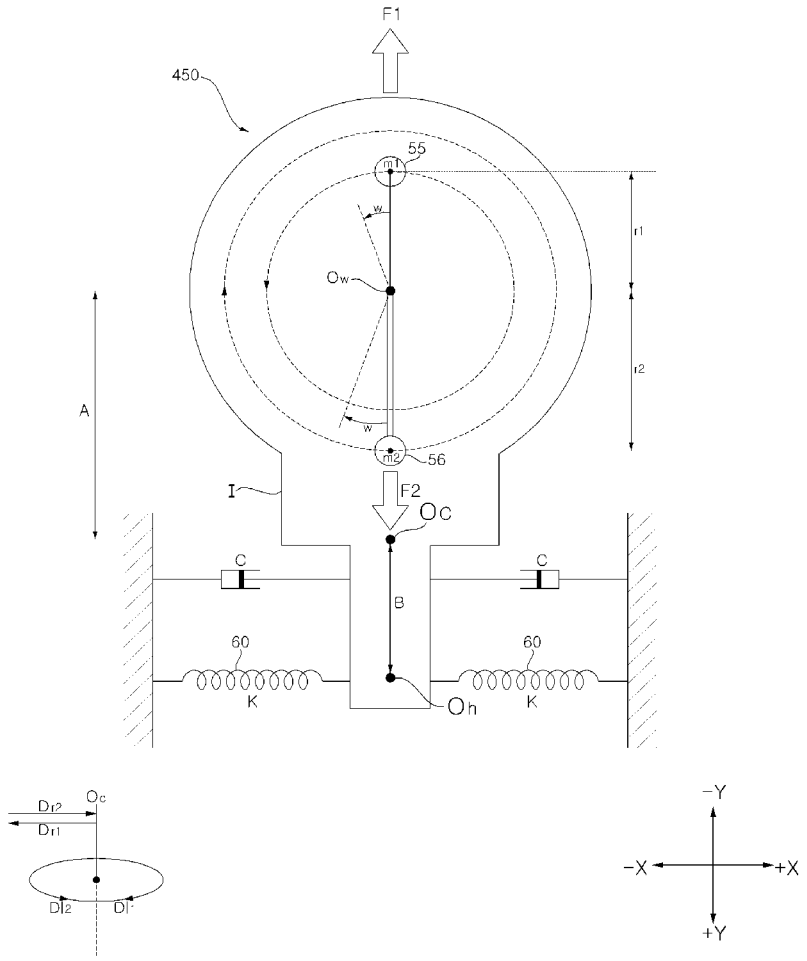
Figure 6C:
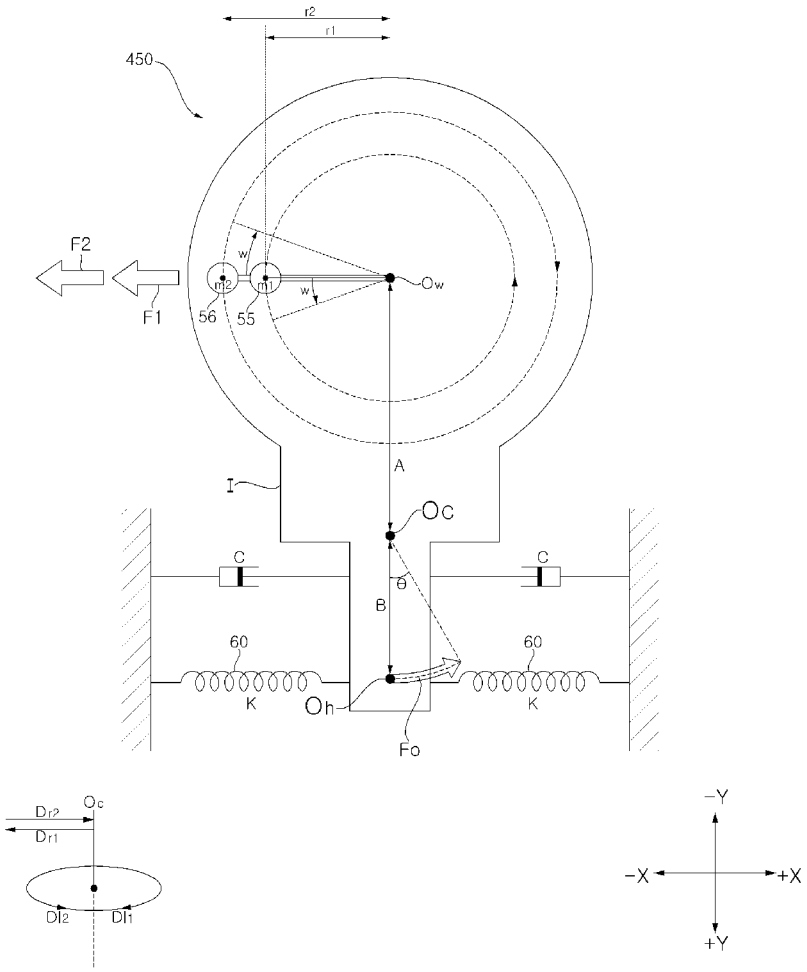

Referring to FIG. 6*a* and FIG. 6*c*, the centrifugal force F1 and the centrifugal force F2 are set to reinforce each other when they generate a torque around the center axis Oc of the vibration module 450. In this case, the moment (A·F1+A·F2) caused by the centrifugal force F1 and centrifugal force F2 is equal to the moment (B·Fo) caused by the excitation force Fo. Thus, Fo becomes $$\frac{A}{B}\cdot F1 + \frac{A}{B}\cdot F2.$$

Figure 6D:
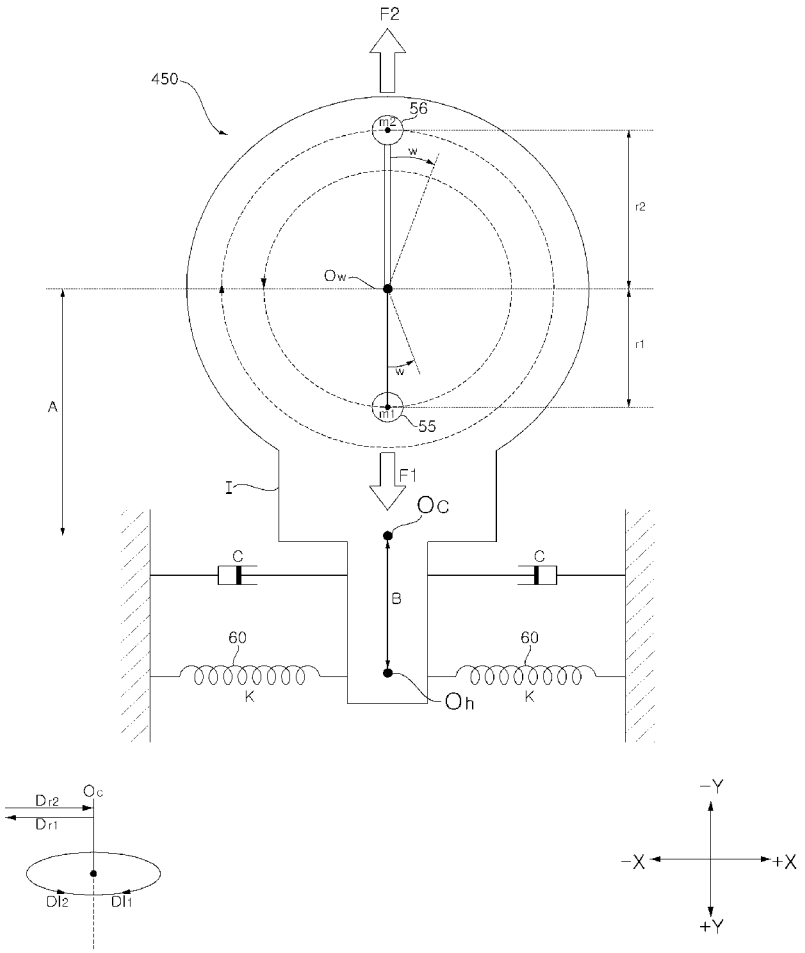

Referring to FIG. 6*b* and FIG. 6*d*, the centrifugal force F1 and the centrifugal force F2 are set to be directed in opposite directions when they generate no torque around the center axis Oc of the vibration module 450. In this case, the excitation force Fo(t) in the vibration direction (+X, −X) caused by the centrifugal force F1 and centrifugal force F2 is zero. Also, the excitation force in the intersecting direction (+Y, −Y) caused by the centrifugal force F1 and centrifugal force F2 is |F1−F2|. Preferably, the excitation force in the intersecting direction (+Y, −Y) caused by the centrifugal force F1 and centrifugal force F2 is preset to zero.

Referring to FIG. 6*a*, when the first eccentric portion 55 generates a centrifugal force F1 with respect to the first rotational axis Ow in the clockwise direction DI1, the second eccentric portion 56 generates a centrifugal force F2 with respect to the second rotational axis Ow in the clockwise direction DI1. Thus, the vibration module 450 has a rotational moment generated in the clockwise direction DI1, and the excitation force transmitted to the hanger body 31 along the connection axis Oh has the maximum value Fo in the −X axis direction. Here, the excitation force Fo is $$\frac{A}{B}\cdot(F1 + F2)$$

in the −X axis direction.

Referring to FIG. 6*b*, when the first eccentric portion 55 generates a centrifugal force F1 with respect to the first rotational axis Ow in the centrifugal direction Dr1, the second eccentric portion 56 generates a centrifugal force F2 with respect to the second rotational axis Ow in the mesial direction Dr2. Thus, the centrifugal force F1 and the centrifugal force F2 generate no torque for the vibration module 450. The excitation force transmitted to the hanger body 31 along the connection axis Oh is zero.

Referring to FIG. 6*c*, when the first eccentric portion 55 generates a centrifugal force F1 with respect to the first rotational axis Ow in the counterclockwise direction DI2, the second eccentric portion 56 generates a centrifugal force F2 with respect to the second rotational axis Ow in the counterclockwise direction DI2. Thus, the vibration module 450 has a rotational moment generated in the counterclockwise direction DI2, and the excitation force transmitted to the hanger body 31 along the connection axis Oh has the maximum value Fo in the +X axis direction. Here, the excitation force Fo is $$\frac{A}{B}\cdot(F1 + F2)$$

in the +X axis direction.

Referring to FIG. 6*d*, when the first eccentric portion 55 generates a centrifugal force F1 with respect to the first rotational axis Ow in the mesial direction Dr2, the second eccentric portion 56 generates a centrifugal force F2 with respect to the second rotational axis Ow in the centrifugal direction Dr1. Thus, the centrifugal force F1 and the centrifugal force F2 generate no torque for the vibration module 450. The excitation force transmitted to the hanger body 31 along the connection axis Oh is zero.

Accordingly, the excitation force Fo(t) according to the fourth exemplary embodiment is given by the following Mathematical Formula 4:

Mathematical Formula 4

$$Fo(t) = \frac{A}{B}\cdot(F1+F2)\cdot\cos wt = \frac{A}{B}\cdot(m1\cdot r1+m2\cdot r2)\cdot w^2\cdot\cos wt \quad \text{[Formula 4]}$$

where, if m1r1=m2r2, the formula $$Fo(t) = 2\cdot\frac{A}{B}\cdot m1\cdot r1\cdot w^2\cdot\cos wt$$

is satisfied.

Hereinafter, the fifth exemplary embodiment with reference to FIGS. 7*a* to 7*d* shows the angular momentum of 90-degree rotation of the first eccentric portion 55 and second eccentric portion 56 rotating at the same constant angular speed w. Since the vibration module 550 rotates around the center axis Oc, the excitation fore Fo can be calculated by converting the sum of the centrifugal force F1 and centrifugal force F2 into an external force with a point of action on the connection axis Oh, taking the moment arm lengths A1, A2, and B into account.

Figure 7A:
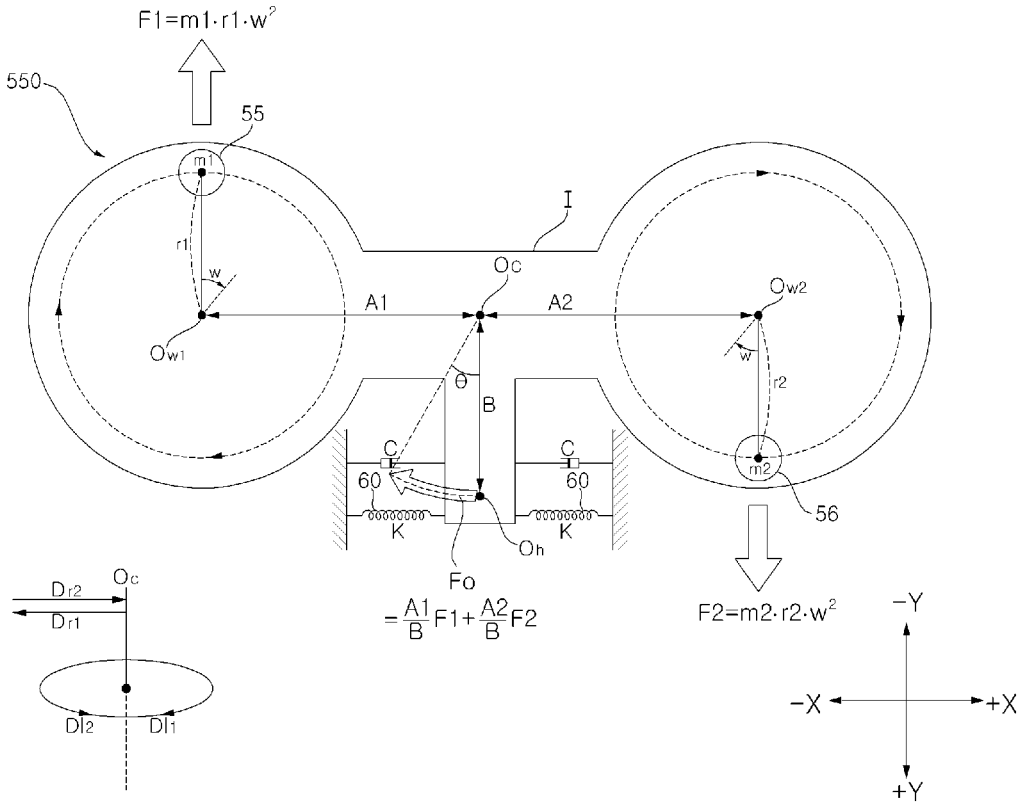
Figure 7B:
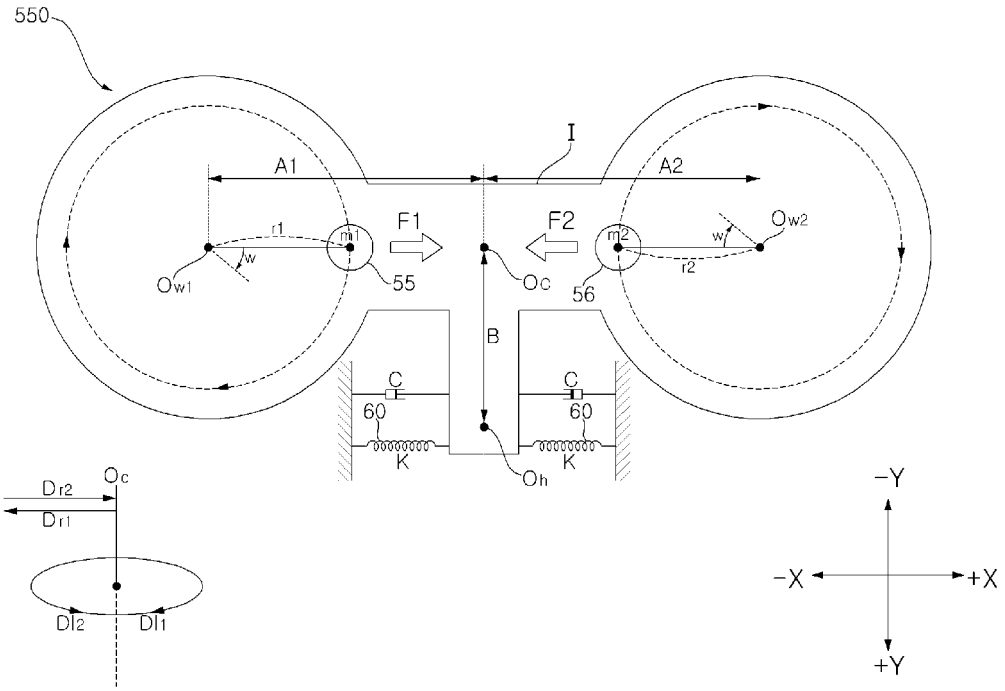
Figure 7C:
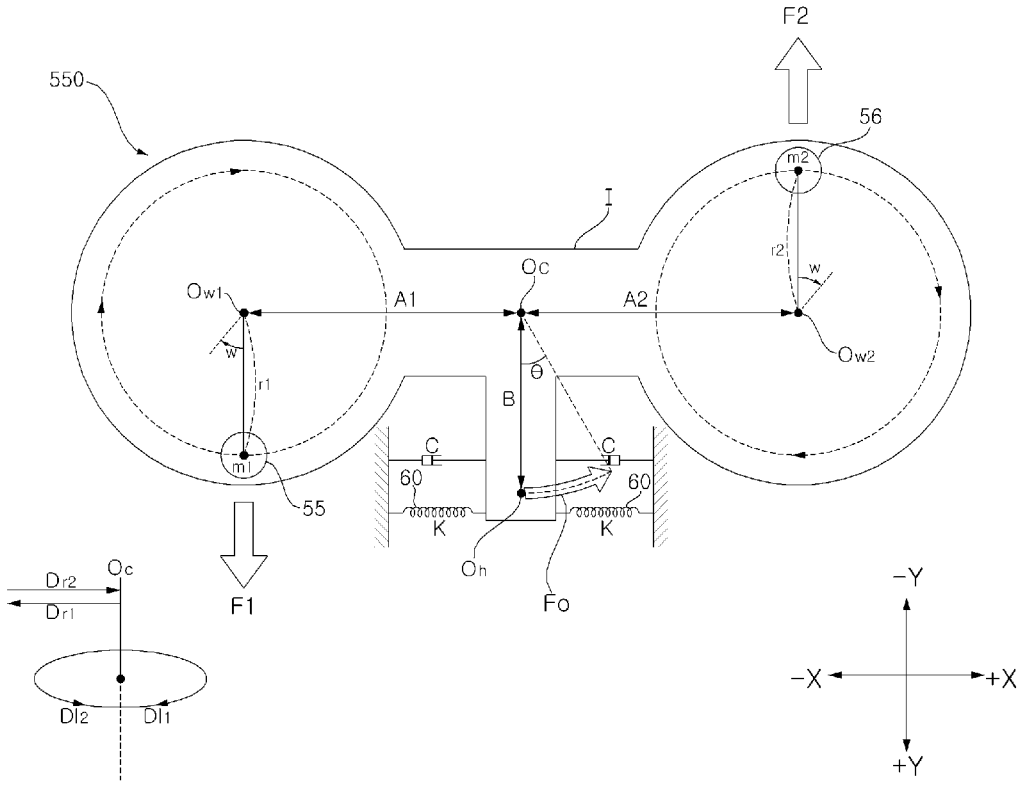

Referring to FIG. 7*a* and FIG. 7*c*, the centrifugal force F1 and the centrifugal force F2 are set to reinforce each other when they generate a torque around the center axis Oc of the vibration module 550. In this case, the moment (A1·F1+A2·F2) caused by the centrifugal force F1 and centrifugal force F2 is equal to the moment (B·Fo) caused by the excitation force Fo. Thus, Fo becomes $$\frac{A1}{B}\cdot F1+\frac{A2}{B}\cdot F2.$$

Figure 7D:
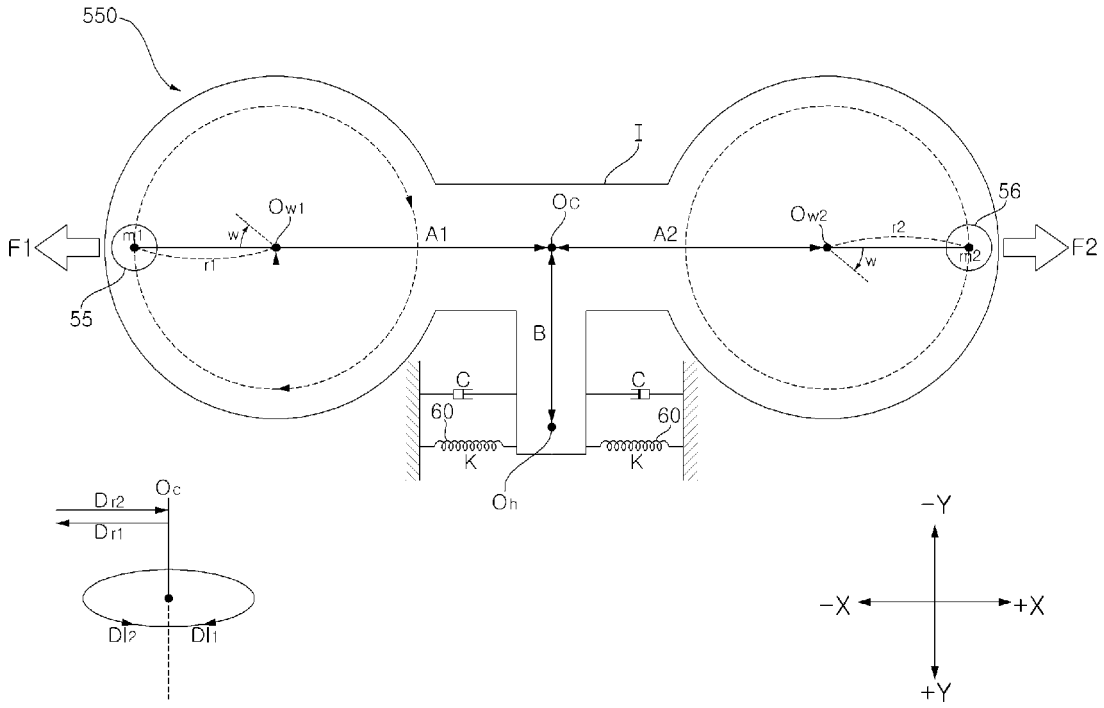

Referring to FIG. 7*b* and FIG. 7*d*, the centrifugal force F1 and the centrifugal force F2 are set to be directed in opposite directions when they generate no torque around the center axis Oc of the vibration module 550. In this case, the excitation force Fo(t) in the vibration direction (+X, −X) caused by the centrifugal force F1 and centrifugal force F2 is zero. Also, the excitation force in the intersecting direction (+Y, −Y) caused by the centrifugal force F1 and centrifugal force F2 is |F1−F2|. Preferably, the excitation force in the intersecting direction (+Y, −Y) caused by the centrifugal force F1 and centrifugal force F2 is preset to zero.

Referring to FIG. 7*a*, when the first eccentric portion 55 generates a centrifugal force F1 with respect to the first rotational axis Ow1 in the clockwise direction DI1, the second eccentric portion 56 generates a centrifugal force F2 with respect to the second rotational axis Ow2 in the clockwise direction DI1. Thus, the vibration module 550 has a rotational moment generated in the clockwise direction DI1, and the excitation force transmitted to the hanger body 31 along the connection axis Oh has the maximum value Fo in the −X axis direction. Here, the excitation force Fo is $$\frac{A1}{B}\cdot F1+\frac{A2}{B}\cdot F2$$

in the −X axis direction.

Referring to FIG. 7*b*, when the first eccentric portion 55 generates a centrifugal force F1 with respect to the first rotational axis Ow1 in the mesial direction Dr2, the second eccentric portion 56 generates a centrifugal force F2 with respect to the second rotational axis Ow2 in the mesial direction Dr2. Thus, the centrifugal force F1 and the centrifugal force F2 generate no torque for the vibration module 550. The excitation force transmitted to the hanger body 31 along the connection axis Oh is zero.

Referring to FIG. 7*c*, when the first eccentric portion 55 generates a centrifugal force F1 with respect to the first rotational axis Ow1 in the counterclockwise direction DI2, the second eccentric portion 56 generates a centrifugal force F2 with respect to the second rotational axis Ow2 in the counterclockwise direction DI2. Thus, the vibration module 550 has a rotational moment generated in the counterclockwise direction DI2, and the excitation force transmitted to the hanger body 31 along the connection axis Oh has the maximum value Fo in the +X axis direction. Here, the excitation force Fo is $$\frac{A1}{B}\cdot F1+\frac{A2}{B}\cdot F2$$

in the +X axis direction.

Referring to FIG. 7*d*, when the first eccentric portion 55 generates a centrifugal force F1 with respect to the first rotational axis Ow in the centrifugal direction Dr1, the second eccentric portion 56 generates a centrifugal force F2 with respect to the second rotational axis Ow2 in the centrifugal direction Dr1. Thus, the centrifugal force F1 and the centrifugal force F2 generate no torque for the vibration module 550. The excitation force transmitted to the hanger body 31 along the connection axis Oh is zero.

Accordingly, the excitation force Fo(t) according to the fifth exemplary embodiment is given by the following Mathematical Formula 5:

Mathematical Formula 5

$$Fo(t) = \left(\frac{A1}{B}\cdot F1+\frac{A2}{B}\cdot F2\right)\cdot\cos wt = \left(\frac{A1}{B}\cdot m1\cdot r1+\frac{A2}{B}\cdot m2\cdot r2\right)\cdot w^2\cdot\cos wt \quad \text{[Formula 5]}$$

where, if m1r1=m2r2 and A1=A2, the equation $$Fo(t) = 2\cdot\frac{A1}{B}\cdot m1\cdot r1\cdot w^2\cdot\cos wt$$

is satisfied.

Hereinafter, referring to FIGS. 2 to 7*d*, an equation of forced vibration caused by excitation force Fo(t) and its solution will be described below. The equation of forced vibration caused by excitation force Fo(t) can be expressed by a second-order ordinary differential equation using the following Mathematical Formula 6. Here, the value to be obtained is the position x(t) of the connection axis Oh in the vibration direction (+X, −X) with respect to time t.

Mathematical Formula 6

$$p1 \cdot \frac{d^2x}{dt^2} + p2 \cdot \frac{dx}{dt} + p2 \cdot x = Fo(t) = Fo \cdot \cos wt \quad \text{[Formula 6]}$$

where p1, p2, and p3 are constants greater than zero.

A transient solution x1(t) for Mathematical Formula 6 can be expressed by the following Mathematical Formula 7.

Mathematical Formula 7

$$x1(t)=x_h(t)+x_p(t) \quad \text{[Formula 7]}$$

where $x_h(t)$ is a general solution, and $x_p(t)$ is a particular solution.

The general solution $x_h(t)$ to Mathematical Formula 7 is a solution determined only by the constants p1, p2, and p3, and, as is well known, the general solution $x_h(t)$ converges to 0 when the time t diverges to infinity ∞. Also, the particular solution $x_p(t)$ to Mathematical Formula 7 is a solution determined by the constants p1, p2, and p3 and excitation force Fo(t) in Mathematical Formula 6.

The transient solution x1(t) is a solution that even includes a very transient phenomenon occurring in an initial time period starting from the origin time (t=0), during which the vibration module 50, 150, 250, 350, 450, and 550 starts operating, which will not be taken into the present disclosure.

What is to be taken into the present disclosure is a steady-state solution x2(t), which is a solution for which the general solution $x_h(t)$ is approximated to zero while already in operation. The steady-state solution x2(t) to Mathematical Formula 6 is given by the following Mathematical Formula 8:

Mathematical Formula 8

$$x2(t)=x_p(t) \quad \text{[Formula 8]}$$

Hereinafter, the solution x(t) to Mathematical Formula 6 denotes the stead-state solution x2(t) to Mathematical Formula 8.

The solution x(t) to Mathematical Formula 6 is affected by the excitation force Fo(t), and the excitation force Fo(t) in the present disclosure takes the form of Fo·cos wt. Thus, the solution x(t) to Mathematical Formula 6 is given by the following Mathematical Formula 9 according to a well-known method of solving a second-order ordinary differential equation.

Mathematical Formula 9

$$x(t) = a \cdot \cos wt + b \cdot \sin wt = X(w) \cdot \cos(wt - \phi) \quad \text{[Formula 9]}$$

where $$a = Fo \cdot \frac{p1 \cdot (w_n^2 - w^2)}{p1^2 \cdot (w_n^2 - w^2)^2 \cdot p2^2},$$

$$b = Fo \cdot \frac{w \cdot p2}{p1^2 \cdot (w_n^2 - w^2)^2 + w^2 \cdot p2^2},$$

$$w_n = \sqrt{\frac{p3}{p1}},$$

$$X(w) = \sqrt{a^2 + b^2} = \frac{Fo}{\sqrt{p1^2 \cdot (w_n^2 - w^2)^2 + w^2 \cdot p2^2}},$$

$$\phi = \tan^{-1}\frac{b}{a}$$

where X(w) represents the amplitude X(w) in the vibration direction (+X, −X) of the hanger body 33 in a steady state caused by a certain angular speed w. Also, Ø represents the phase difference Ø between the excitation force Fo(t) and the solution x(t).

Also, $w_n$ may represent natural angular speed $w_n$, and $$\frac{w_n}{2\pi}$$

may represent natural frequency.

Assuming that the coefficient p2 is zero, a resonance occurs when the angular speed w approaches the natural angular speed $w_n$.

In reality, the coefficient p2 may have a value greater than zero. If the following Mathematical Formula 10 is satisfied according to a solution to an already-known vibration equation, the amplitude X(w) has the maximum value (peak value) $X(w_{max})$ when the angular speed w of the eccentric portion 55 and 56 has a certain value $w_{max}$ near the natural angular speed $w_n$. As p1·p3 becomes larger than $p2^2/2$, the peak shape of the amplitude X(w) becomes more distinct and the peak value $X(w_{max})$ becomes larger, as in the graph of FIG. 2. According to a well-known solving method, the peak value $X(w_{max})$ is finite if p2>0. Also, the value $w_{max}$ is given as a single value according to a well-known solving method if p2>0, increases as p2 decreases, and approaches the natural angular speed $w_n$ as p2 gets closer to 0.

Mathematical Formula 10

$$p1 \cdot p3 \geq \frac{p2^2}{2}$$

Meanwhile, if Mathematical Formula 10 is not satisfied $$\left(p1 \cdot p3 < \frac{p2^2}{2}\right),$$

the peak value is not present, and the amplitude X(w) decreases monotonously as w increases.

In the present disclosure, it is preferable that Mathematical Formula 10 be satisfied. Through this, it becomes easier to control the frequency $$\frac{w}{2\pi}$$

and amplitude X(w) of the hanger body 31 in various ways.

Hereinafter, equations of forced vibration according to the exemplary embodiments and various properties thereof will be described below with reference to FIGS. 3*a* to 7*d*.

The equations of forced vibration according to the exemplary embodiments use the property that the excitation force Fo(t) is equal to the sum of inertia force, damping force, and elastic force. Here, the damping force may be generated by structural factors of the hanger module 30 and vibration module 50 and/or clothes hung on the hanger body 31.

Although FIGS. 3*a* to 7*d* conceptually show the damping coefficient c for convenience, the damping coefficient c, in reality, is seen as being applied to the movement of the position x in the vibration direction (+X, −X) along the connection axis Oh.

Although FIGS. 3*a* to 7*d* conceptually show the elastic modulus k for convenience, the elastic modulus k, in reality, may be a tensile or compressive elastic modulus applied to the movement of the position x in the vibration direction (+X, −X) along the connection axis Oh, or a torsional elastic modulus applied to the angle Θ of rotation of the vibration module 50 around the center axis Oc. Hereinafter, in the first to fourth exemplary embodiments, the calculations are based on the assumption that the elastic modulus k is the tensile or compressive elastic modulus, and in the fifth exemplary embodiment, the calculation is based on the assumption that the elastic modulus k is the torsional elastic modulus. Here, the tensile or compressive elastic modulus refers to the elastic modulus for elastic force proportional to tensile or compressive length x, and the torsional elastic modulus refers to the elastic modulus for elastic force proportional to the angle Θ of rotation of the vibration module 350, 450, and 550.

The values of the coefficients p1, p2, and p3 in Mathematical Formula 6 are obtained by comparing the vibration equations of Mathematical Formulae 11, 12, 13, 14, and 15 for the exemplary embodiments to be described later with the above Mathematical Formula 6. As stated above, the excitation force Fo(t) for each exemplary embodiment is obtained as in the above Mathematical Formulae 1 to 5.

For each exemplary embodiment, the solution x(t) and amplitude X(w) can be obtained by substituting the obtained coefficients p1, p2, and p3 and the obtained excitation force Fo(t) into Mathematical Formula 9 and Mathematical Formula 10 (see Mathematical Formula 9), and the condition for the peak value H(wmax) can be found (see Mathematical Formula 10).

Hereinafter, the condition for (i) equation of forced vibration, (ii) amplitude X(w), (iii) natural angular speed $w_n$, and (iv) peak value in the first exemplary embodiment with reference to FIGS. 3*a* and 3*b* is given by the following Mathematical Formula 11:

Mathematical Formula 11

[Formula 11]

(i) Equation of motion: $M \cdot \frac{d^2x}{dt^2} + c \cdot \frac{dx}{dt} + k \cdot x = Fo(t) = m \cdot r \cdot w^2 \cdot \cos wt$ (ii) Amplitude: $X(w) = \frac{m \cdot r \cdot w^2}{\sqrt{M^2 \cdot (w_n^2 - w^2)^2 + w^2 \cdot c^2}} = \frac{m \cdot r \cdot w^2}{\sqrt{(k - M \cdot w^2)^2 + w^2 \cdot c^2}}$ (iii) Natural angular speed: $w_n = \sqrt{\frac{k}{M}}$ (iv) Condition for peak value: $M \cdot k \geq \frac{c^2}{2}$ where m is the mass of the eccentric portion 55, r is the radius of rotation from the center of mass of the eccentric portion 55 on the rotational axis Ow, M is the mass of the vibration module 150 and hanger body 31 moving in the vibration direction (+X, −X), k is the tensile or compressive elastic modulus of the elastic member 60 in the vibration direction (+X, −X), and c is the damping coefficient in the vibration direction (+X, −X). For reference, $$M \cdot \frac{d^2x}{dt^2}$$

is inertia force, $$c \cdot \frac{dx}{dt}$$

is damping force, and k·x is elastic force.

Hereinafter, the condition for (i) equation of forced vibration, (ii) amplitude X(w), (iii) natural angular speed $w_n$, and (iv) peak value in the second exemplary embodiment with reference to FIGS. 4*a* to 4*d* is given by the following Mathematical Formula 12:

Mathematical Formula 12

[Formula12]

(i) Equation of motion: $M \cdot \frac{d^2x}{dt^2} + c \cdot \frac{dx}{dt} + k \cdot x = Fo(t) = (m1 \cdot r1 + m2 \cdot r2) \cdot w^2.$ (ii) Amplitude: $X(w) = \frac{(m1 \cdot r1 + m2 \cdot r2) \cdot w^2}{\sqrt{M^2 \cdot (w_n^2 - w^2)^2 + w^2 \cdot c^2}} = \frac{(m1 \cdot r1 + m2 \cdot r2) \cdot w^2}{\sqrt{(k - M \cdot w^2)^2 + w^2 \cdot c^2}}$ (iii) Natural angular speed: $w_n = \sqrt{\frac{k}{M}}$ (iv) Condition for peak value: $M \cdot k \geq \frac{c^2}{2}$ where m1 is the mass of the first eccentric portion 55, m2 is the mass of the second eccentric portion 56, r1 is the radius of rotation from the center of mass of the first eccentric portion 55 on the rotational axis Ow, r2 is the radius of rotation from the center of mass of the second eccentric portion 56 on the rotational axis Ow, M is the mass of the vibration module 250 and hanger body 31 moving in the vibration direction (+X, −X), k is the tensile or compressive elastic modulus of the elastic member 60 in the vibration direction (+X, −X), and c is the damping coefficient in the vibration direction (+X, −X). If m1r1=m2r2, the amplitude $$X(w) = \frac{2 \cdot m1 \cdot r1 \cdot w^2}{\sqrt{M^2 \cdot (w_n^2 - w^2)^2 + w^2 \cdot c^2}} = \frac{2 \cdot m1 \cdot r1 \cdot w^2}{(k - M \cdot w^2)^2 + w^2 \cdot c^2}$$

is satisfied.

Hereinafter, the condition for (i) equation of forced vibration, (ii) amplitude X(w), (iii) natural angular speed $w_n$, and (iv) peak value in the third exemplary embodiment with reference to FIGS. 5*a* and 5*b* is given by the following Mathematical Formula 13:

Mathematical Formula 13

(i) Equation of motion: $$B\cdot M\cdot\frac{d^2x}{dt^2}+I\cdot\frac{d^2\theta}{dt^2}+B\cdot c\cdot\frac{dx}{dt}+B\cdot k\cdot x=B\cdot Fo(t)=B\cdot\frac{A}{B}\cdot m\cdot r\cdot w^2\cdot\cos wt \quad \text{[Formula 13]}$$

Approximately, $$\theta=\frac{x}{B},$$

$$\frac{d\theta}{dt}=\frac{1}{B}\cdot\frac{dx}{dt},$$

and $$\frac{d^2\theta}{dt^2}=\frac{1}{B}\cdot\frac{d^2x}{dt^2}$$

are derived. Substituting these gives $$\left(B\cdot M+\frac{I}{B}\right)\cdot\frac{d^2x}{dt^2}+B\cdot c\cdot\frac{dx}{dt}+B\cdot k\cdot x=A\cdot m\cdot r\cdot w^2\cdot\cos wt$$

Multiplying both sides by B results in $$(B^2\cdot M+I)\cdot\frac{d^2x}{dt^2}+B^2\cdot c\cdot\frac{dx}{dt}+B^2\cdot k\cdot x=A\cdot B\cdot m\cdot r\cdot w^2\cdot\cos wt$$

(ii) Amplitude: $$X(w)=\frac{A\cdot B\cdot m\cdot r\cdot w^2}{\sqrt{(B^2\cdot M+I)^2\cdot(w_n^2-w^2)^2+w^2\cdot(B^2\cdot c)^2}}=\frac{A\cdot B\cdot m\cdot r\cdot w^2}{\sqrt{((k-M\cdot w^2)^2\cdot B^2-I\cdot w^2)^2+w^2\cdot(B^2\cdot c)^2}}$$

(iii) Natural angular speed: $$w_n=\sqrt{\frac{k}{\left(M+\frac{I}{B^2}\right)}}$$

(iv) Condition for peak value: $$k\cdot\left(M+\frac{I}{B^2}\right)\geq\frac{c^2}{2}$$

where A is the distance between the center axis Oc and the rotational axis Ow, B is the distance between the center axis Oc and the connection axis Oc, m is the mass of the eccentric portion 55, r is the radius of rotation from the center of mass of the eccentric portion 55 on the rotational axis Ow, I is the moment M of inertia of the vibration module 350 around the center axis Oc, M is the mass of the hanger body 31 moving in the vibration direction (+X, −X), k is the tensile or compressive elastic modulus of the elastic member 60 in the vibration direction (+X, −X), and c is the damping coefficient in the vibration direction (+X, −X). For reference, $I\cdot d^2\theta/dt^2\theta$ is rotational inertia.

Hereinafter, the condition for (i) equation of forced vibration, (ii) amplitude X(w), (iii) natural angular speed $w_n$, and (iv) peak value in the fourth exemplary embodiment with reference to FIGS. 6*a* to 6*d* is given by the following Mathematical Formula 14:

Mathematical Formula 14

(i) Equation of motion: $$B\cdot M\cdot\frac{d^2x}{dt^2}+I\cdot\frac{d^2\theta}{dt^2}+B\cdot c\cdot\frac{dx}{dt}+B\cdot k\cdot x=B\cdot Fo(t)=B\cdot\frac{A}{B}\cdot(m1\cdot r1+m2\cdot r2)\cdot w^2\cdot\cos wt \quad \text{[Formula 14]}$$

Approximately, $$\theta=\frac{x}{B},$$

$$\frac{d\theta}{dt}=\frac{1}{B}\cdot\frac{dx}{dt},$$

and $$\frac{d^2\theta}{dt^2}=\frac{1}{B}\cdot\frac{d^2x}{dt^2}$$

are derived. Substituting these gives $$\left(B\cdot M+\frac{I}{B}\right)\cdot\frac{d^2x}{dt^2}+B\cdot c\cdot\frac{dx}{dt}+B\cdot k\cdot x=A\cdot(m1\cdot r1+m2\cdot r2)\cdot w^2\cdot\cos wt$$

Multiplying both sides by B results in $$(B^2\cdot M+I)\cdot\frac{d^2x}{dt^2}+B^2\cdot c\cdot\frac{dx}{dt}+B^2\cdot k\cdot x=A\cdot B\cdot(m1\cdot r1+m2\cdot r2)\cdot w^2\cdot\cos wt$$

(ii) Amplitude: $$X(w)=\frac{A\cdot B\cdot(m1\cdot r1+m2\cdot r2)\cdot w^2}{\sqrt{(B^2\cdot M+I)^2\cdot(w_n^2-w^2)^2+w^2\cdot(B^2\cdot c)^2}}=\frac{A\cdot B\cdot(m1\cdot r1+m2\cdot r2)\cdot w^2}{\sqrt{((k-M\cdot w^2)^2\cdot B^2-I\cdot w^2)^2+w^2\cdot(B^2\cdot c)^2}}$$

(iii) Natural angular speed: $$w_n=\sqrt{\frac{k}{\left(M+\frac{I}{B^2}\right)}}$$

(iv) Condition for peak value: $$\left(M+\frac{I}{B^2}\right)\cdot k\geq\frac{c^2}{2}$$

where A is the distance between the center axis Oc and the rotational axis Ow, B is the distance between the center axis Oc and the connection axis Oc, m1 is the mass of the first eccentric portion 55, m2 is the mass of the second eccentric portion 56, r1 is the radius of rotation from the center of mass of the first eccentric portion 55 on the rotational axis Ow, r2 is the radius of rotation from the center of mass of the second eccentric portion 56 on the rotational axis Ow, I is the moment M of inertia of the vibration module 450 around the center axis Oc, M is the mass of the hanger body 31 moving in the vibration direction (+X, −X), k is the tensile or compressive elastic modulus of the elastic member 60 in the vibration direction (+X, −X), and c is the damping coefficient in the vibration direction (+X, −X). If m1r1=m2r2, the amplitude $$X(w)=\frac{2\cdot A\cdot B\cdot m1\cdot r1\cdot w^2}{\sqrt{(B^2\cdot M+I)^2\cdot(w_n^2-w^2)^2+w^2\cdot(B^2\cdot c)^2}}=$$

-continued $$\frac{2\cdot A\cdot B\cdot m1\cdot r1\cdot w^2}{\sqrt{((k-M\cdot w^2)\cdot B^2-I\cdot w^2)^2+w^2\cdot(B^2\cdot c)^2}}$$

is satisfied.

Hereinafter, the condition for (i) equation of forced vibration, (ii) amplitude X(w), (iii) natural angular speed $w_n$, and (iv) peak value in the fifth exemplary embodiment with reference to FIGS. 7*a* to 7*d* is given by the following Mathematical Formula 15:

Mathematical Formula 15

[Formula 15]

(i) Equation of motion: $B\cdot M\cdot\frac{d^2x}{dt^2}+I\cdot\frac{d^2\theta}{dt^2}+B\cdot c\cdot\frac{dx}{dt}+\dot{k}\cdot\theta=B\cdot Fo(t)=B\cdot\left(\frac{A1}{B}\cdot m1\cdot r1+\frac{A2}{B}\cdot m2\cdot r2\right)\cdot w^2\cdot\cos wt$ Approximately, $$\theta=\frac{x}{B},\quad \frac{d\theta}{dt}=\frac{1}{B}\cdot\frac{dx}{dt},\quad \text{and}\ \frac{d^2\theta}{dt^2}=\frac{1}{B}\cdot\frac{d^2x}{dt^2}$$

are derived. Substituting these gives $$\left(B\cdot M+\frac{I}{B}\right)\cdot\frac{d^2x}{dt^2}+B\cdot c\cdot\frac{dx}{dt}+\frac{\dot{k}}{B}\cdot x=(A1\cdot m1\cdot r1+A2\cdot m2\cdot r2)\cdot w^2\cdot\cos wt$$

Multiplying both sides by B results in $$(B^2\cdot M+I)\cdot\frac{d^2x}{dt^2}+B^2\cdot c\cdot\frac{dx}{dt}+\dot{k}\cdot x=B\cdot(A1\cdot m1\cdot r1+A2\cdot m2\cdot r2)\cdot w^2\cdot\cos wt$$

(ii) Amplitude: $X(w)=\frac{B\cdot(A1\cdot m1\cdot r1+A2\cdot m2\cdot r2)\cdot w^2}{\sqrt{(B^2\cdot M+I)^2\cdot(w_n^2-w^2)^2+w^2\cdot(B^2\cdot c)^2}}=\frac{B\cdot(A1\cdot m1\cdot r1+A2\cdot m2\cdot r2)\cdot w^2}{\sqrt{(\dot{k}-(B^2\cdot M+I)\cdot w^2)^2+w^2\cdot(B^2\cdot c)^2}}$ (iii) Natural angular speed: $w_n=\sqrt{\frac{k}{(B^2\cdot M+I)}}$ (iv) Condition for peak value: $\left(\frac{M}{B^2}+\frac{I}{B^4}\right)\cdot\dot{k}\geq\frac{c^2}{2}$ where A1 is the distance between the center axis Oc and the first rotational axis Ow1, A2 is the distance between the center axis Oc and the second rotational axis Ow2, B is the distance between the center axis Oc and the connection axis Oc, m1 is the mass of the first eccentric portion 55, m2 is the mass of the second eccentric portion 56, r1 is the radius of rotation from the center of mass of the first eccentric portion 55 on the first rotational axis Ow1, r2 is the radius of rotation from the center of mass of the second eccentric portion 56 on the second rotational axis Ow2, I is the moment M of inertia of the vibration module 550 around the center axis Oc, M is the mass of the hanger body 31 moving in the vibration direction (+X, −X), k is the torsional elastic modulus of the elastic member 60 with respect to the angle θ of rotation, and c is the damping coefficient in the vibration direction (+X, −X). If m1r1=m2r2 and A1=A2, the amplitude $$X(w)=\frac{2\cdot A1\cdot B\cdot m1\cdot r1\cdot w^2}{\sqrt{(B^2\cdot M+I)^2\cdot(w_n^2-w^2)^2+w^2\cdot(B^2\cdot c)^2}}=\frac{2\cdot A1\cdot B\cdot m1\cdot r1\cdot w^2}{\sqrt{(\dot{k}(B^2\cdot M+I)\cdot w^2)^2+w^2\cdot(B^2\cdot c)^2}}$$

is satisfied.

Hereinafter, referring to FIG. 2, an example of a graph is given which shows the amplitude X(w) vs. angular speed of the hanger body 33 in a steady state. The clothes treatment apparatus 1 according to this exemplary embodiment is configured in such a way that the angular speed w of the eccentric portion 55 and 56 is changeable. The control part may change and control the angular speed of the eccentric portion 55 and 56. This means that there are two or more preset angular speeds w that allow the vibrating motion of the vibration module 50, 150, 250, 350, 450, and 550 to reach a steady state. Specifically, the clothes treatment apparatus 1 is configured in such a way as to provide two or more different steady states by changing the angular speed w of the eccentric portion 55 and 56.

To this end, the clothes treatment apparatus 1 is configured in such a way that the two or more different angular speeds w are maintained for a predetermined time or longer. Here, the predetermined time may be preset to a sufficient period of time to reach the steady state. For example, the predetermined time may be around 5 seconds.

Figure 2:
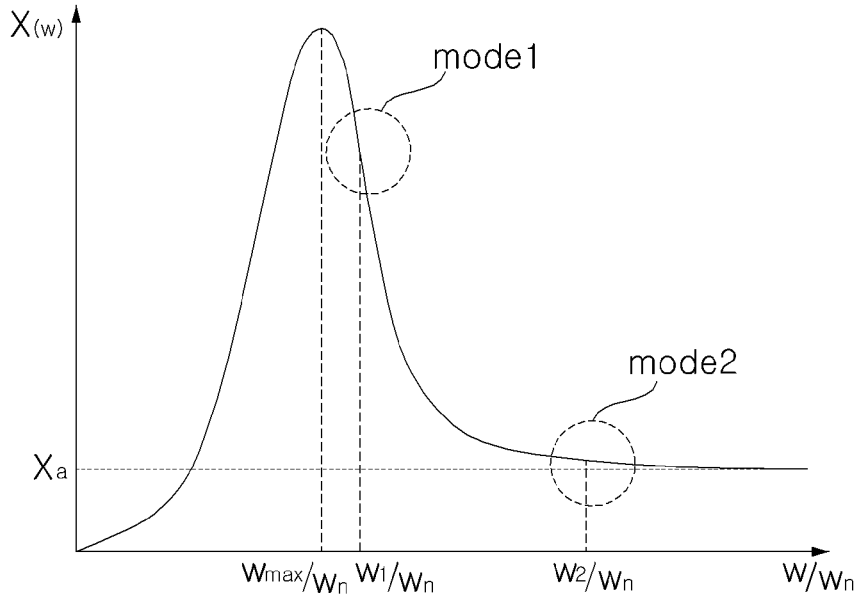
FIG. 2 is a graph and conceptual diagram showing how the amplitude X(w) of the hanger body 31 changes with the angular speed w of the eccentric portion of the vibration module 50 of FIG. 1.
Figure 2:
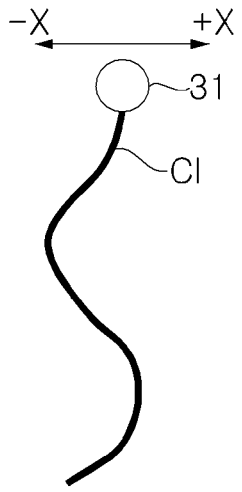
Figure 2:
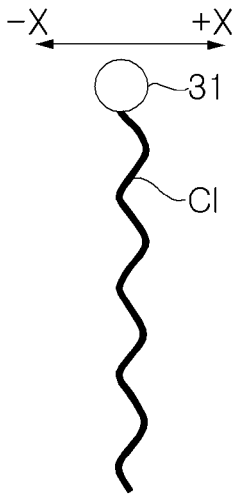
Figure 2:
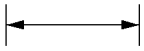
Figure 2:
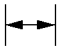
Figure 2:
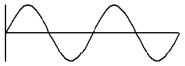
Figure 2:
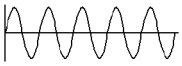

Referring to FIG. 2, the clothes treatment apparatus 1 is configured to perform a first mode mode1 in which the vibration frequency $$\frac{w1}{2\pi}$$

of the hanger body 31 is relatively low and the amplitude X(w1) is relatively large and a second mode mode2 in which the vibration frequency $$\frac{w2}{2\pi}$$

of the hanger body 31 is relatively high and the amplitude X(w2) is relatively small, by changing and controlling the angular speed w of the eccentric portion 55 and 56. Through this, the motion of the hanger body 31 may be varied. For example, clothes may be vibrated slowly with a large amplitude X(w) through the first mode mode1, or clothes may be vibrated fast, rather than being shaken off, with a small amplitude X(w) through the second mode mode2.

In the first mode mode1, the first angular speed w1 of the eccentric portion 55 and 56 is maintained for a predetermined time or longer, and, in the second mode mode2, the second angular speed w2 of the eccentric portion 55 and 56 is maintained for a predetermined time or longer. The second angular speed w2 is preset to be higher than the first angular speed w1.

It is desirable that the vibration frequency $$\frac{w1}{2\pi}$$

for the first mode mode1 is preset to be closer to the natural vibration frequency $$\frac{w2}{2\pi}$$

than the vibration frequency $$\frac{w_n}{2\pi}$$

for the second mode mode2. In the first and second exemplary embodiments, the vibration frequency $$\frac{w1}{2\pi}$$

for the first mode mode1 is preset to be closer to $$\frac{1}{2\pi}\cdot\sqrt{\frac{k}{M}}$$

than the vibration frequency $$\frac{w2}{2\pi}$$

for the second mode mode2, with reference to Mathematical Formulae 11 and 12. In the third to fifth exemplary embodiments, the vibration frequency $$\frac{w1}{2\pi}$$

for the first mode mode1 is preset to be closer to $$\sqrt{\frac{k}{\left(M+\frac{I}{B^2}\right)}} \text{ or } \sqrt{\frac{k}{(B^2\cdot M+I)}}$$

than the vibration frequency $$\frac{w2}{2\pi}$$

for the second mode mode2, with reference to Mathematical Formulae 13 to 15. Through this, the first mode mode1 allows for larger amplitude, and the second mode mode2 allows for high vibration frequency without stress on items.

Referring to FIG. 2, it is desirable that the amplitude of vibration of the hanger body 31 in a steady state is preset to have a peak value $X(w_{max})$ when the angular speed w has a specific value $w_{max}$ greater than zero. To this end, a condition for the peak value needs to be satisfied with reference to Mathematical Formula 11 to Mathematical Formulae 15.

Referring to the above Mathematical Formulae 11 and 12 according to the first and second exemplary embodiments, the clothes treatment apparatus 1 is configured to provide the peak value $X(w_{max})$, since M and k are preset to satisfy $$M\cdot k > \frac{c^2}{2}$$

even if c is assumed to have the maximum value by taking into account the maximum/minimum range and error range (safety value) of clothes that can be hung on the hanger body 31 and 231.

Referring to the above Mathematical Formulae 13 to 15 according to the third to fifth exemplary embodiments, the clothes treatment apparatus 1 is configured to provide the peak value $X(w_{max})$, since I and k are preset to satisfy a predetermined value (determined by I, M, k, and B)

$$> \frac{c^2}{2}$$

even if c is assumed to have the maximum value by taking into account the maximum/minimum range and error range (safety value) of clothes that can be hung on the hanger body 31 and 431.

Meanwhile, in the third to fifth exemplary embodiments, referring to Mathematical Formulae 13 to 15, it can be seen that, the greater the distance A, A1, and A2, the larger the amplitude, even with the same angular speed w. As the distance B approaches zero, the numerator of X(w) approaches zero, which requires the distance B to be equal to or greater than a predetermined value. However, since the numerator of X(w) also increases as the value B increases, it is desirable that the distance A, A1, and A2 between the center axis Oc and the rotational axis Ow, Ow1, and Ow2 is greater than the distance between the center axis Oc and the connection axis Oh, in order to efficiently obtain a larger amplitude X(w) with the same angular speed w.

Furthermore, theoretical and experimental results suggest that it is more desirable that the ratio A/B of the distance A between the center axis and the rotational axis to the distance B between the center axis Oc and the connection axis Oh is equal to or greater than 2.6. Here, the maximum value of the ratio A/B is limited by the frame 10. That is, the distance A is not greater than a certain value since the vibration module is disposed within the cabinet.

Hereinafter, structural examples of several exemplary embodiments of the present disclosure will be described below with reference to FIGS. 8 to 24. They are merely structural examples according to several exemplary embodiments of the present discourse, and structural implementations of the present disclosure are not limited to the following examples. Also, although the following examples are structural examples of the second, fourth, and fifth exemplary embodiments, those skilled in the art may readily implement the first and third exemplary embodiments based on these examples, so the disclosure of the structural examples of the first and third exemplary embodiments will be omitted.

Figure 15:
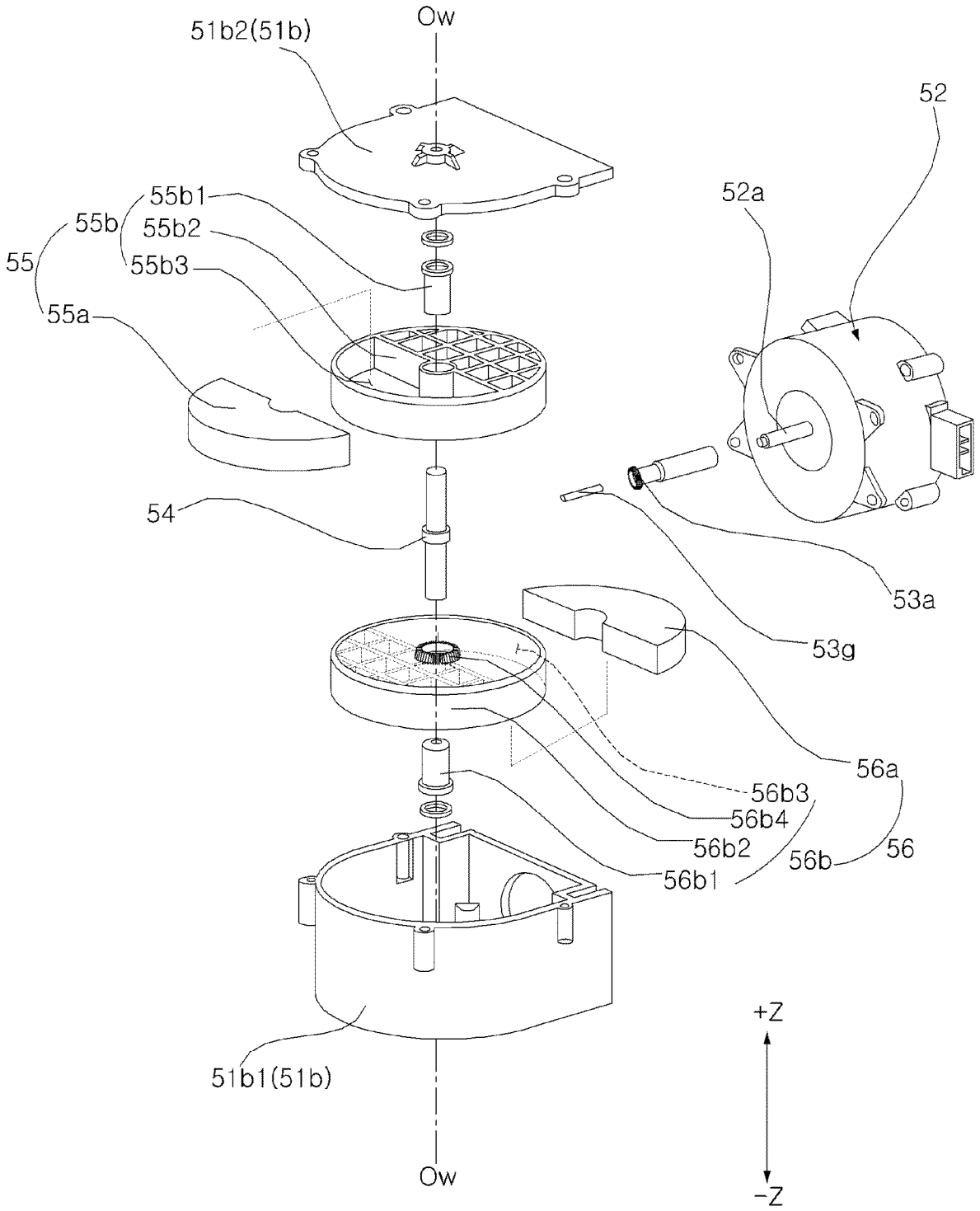
FIG. 15 is an exploded perspective view of an operating structure of the first eccentric portion 55 and second eccentric portion 56 of the vibration module 250 and 450 of FIGS. 8 to 14.
Figure 16:
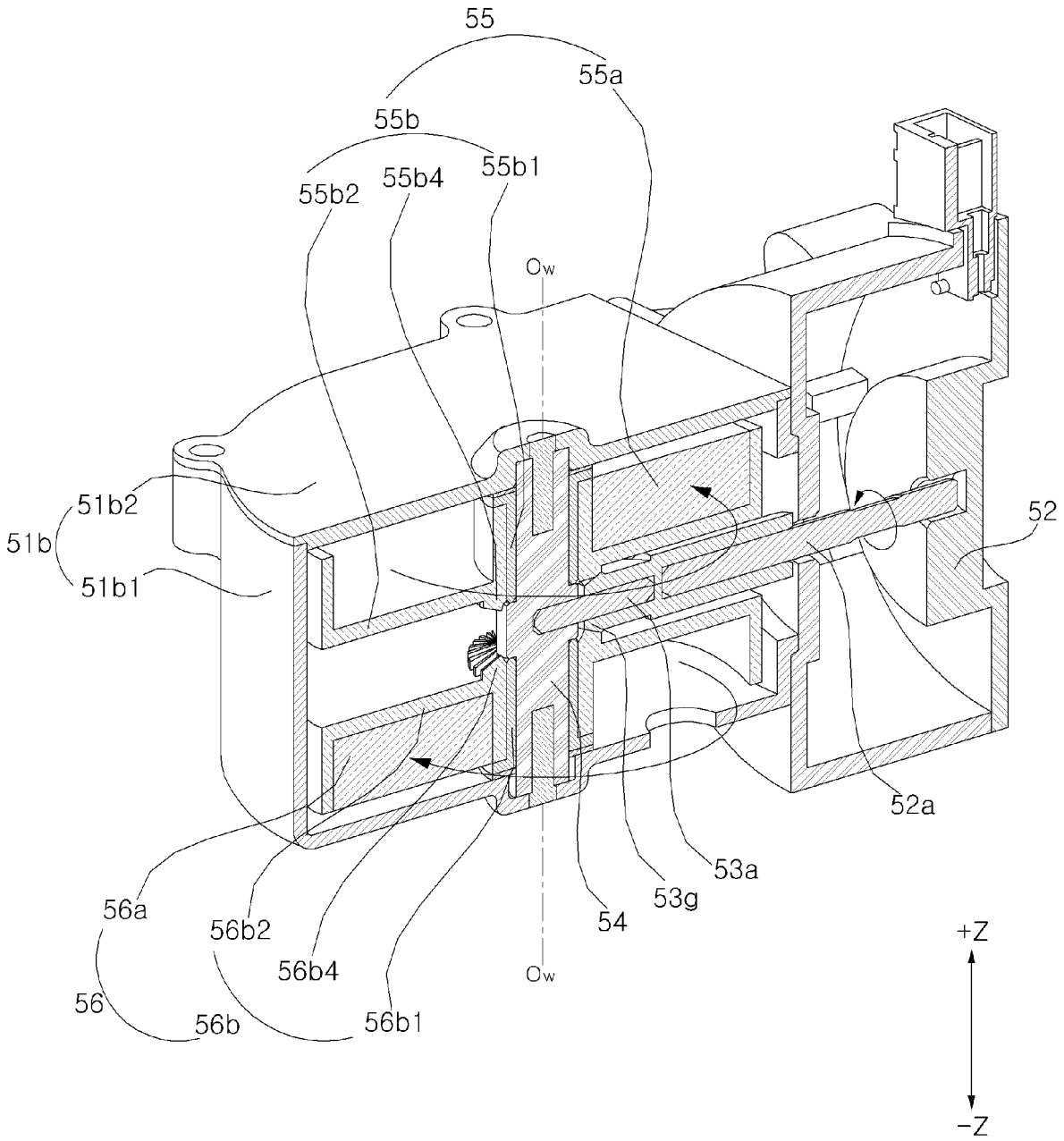
FIG. 16 is a vertical cross-sectional view of the elements of FIG. 15 in an assembled state.
Figure 17:
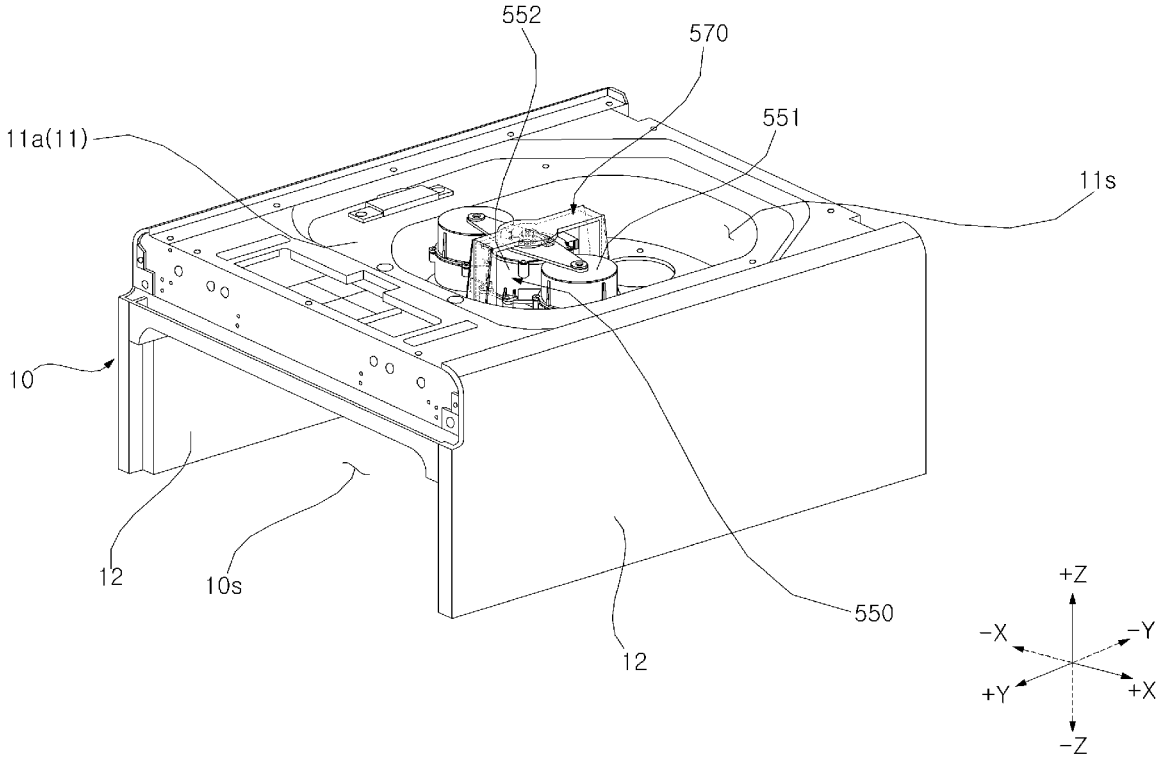
FIG. 17 is a partial perspective view showing a structural example of the vibration module 550, elastic member 560, and supporting member 570 according to the fifth exemplary embodiment in FIGS. 7*a* to 7*d*, from which the exterior frame 11*b* is omitted.
Figure 18:
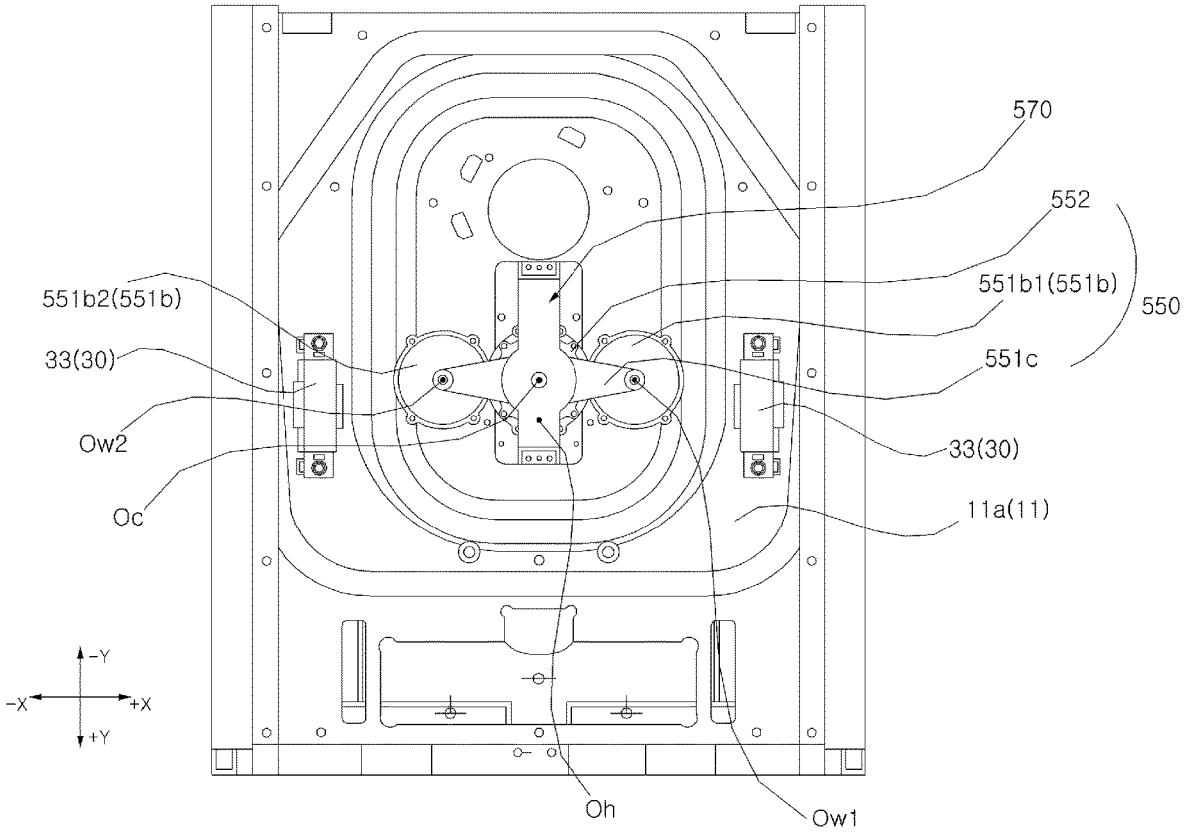
FIG. 18 is a top elevation view of the structural example of FIG. 17.

Referring to FIGS. 15 and 16, a structural example common to the second and fourth exemplary embodiments will be described below.

The vibration module 350 and 450 comprises a vibrating body 251 and 451 configured to move with respect to the frame 10. The vibration module 250 and 450 comprises a weight shaft 54 providing function the rotational axis Ox and first and second eccentric portions 55 and 56 rotating around the weight shaft 54.

The first eccentric portion 55 comprises a first rotating portion 55*b* rotating around the rotational axis Ow in contact with the transmitting portion 53. The first rotating portion 55*b* may comprise a center portion 55*b*1 that makes rotatable contact with the weight shaft 54. The weight shaft 54 is placed to penetrate the center portion 55*b*1. The center portion 55*b*1 extends along the rotational axis Ow. The center portion 55*b*1 has a center hole along the rotational axis Ow.

The first rotating portion 55*b* may comprise a peripheral portion 55*b*2 mounted to the center portion 55*b*1. The center portion 55*b*1 is placed to penetrate the peripheral portion 55*b*2. The peripheral portion 55*b*2 may be formed entirely in the shape of a cylinder that extends along the rotational axis Ow. A mounting groove 55*b*3 where the first weight member 55*a* rests may be formed in the peripheral portion 55*b*2. The mounting groove 55*b*3 may be formed in such a way that its top is open. A centrifugal side of the mounting groove 55*b*3 around the rotational axis Ow may be blocked. The peripheral portion 55*b*2 and the first weight member 55*a* rotate as a single unit.

The first eccentric portion 55 comprises a toothed portion 55*b*4 that receives torque by meshing with a bevel gear 53*a*. The toothed portion 55*b*4 is formed on the underside of the peripheral portion 55*b*2. The toothed portion 55*b*4 is placed on the perimeter around the rotational axis Ow.

The first eccentric portion 55 comprises a first weight member 55*a* fixed to the first rotating portion 55*b*. The first weight member 55*a* rotates integrally with the first rotating portion 55*b*. The first weight member 55*a* is made of a material with a higher specific gravity than the first rotating portion 55*b*.

The first weight member 55*a* is placed on one side around the rotational axis Ow, and causes the weight of the first eccentric portion 55 to be off-centered.

The second eccentric portion 56 comprises a second rotating portion 56*b* rotating around the rotational axis Ow in contact with the transmitting portion 53. The second rotating portion 56*b* may comprise a center portion 56*b*1 that makes rotatable contact with the weight shaft 54. The weight shaft 54 is placed to penetrate the center portion 56*b*1. The center portion 56*b*1 extends along the rotational axis Ow. The center portion 56*b*1 has a center hole along the rotational axis Ow. The center portion 56*b*1 may be formed in the shape of a pipe.

The second rotating portion 56*b* may comprise a peripheral portion 56*b*2 mounted to the center portion 56*b*1. The center portion 56*b*1 is placed to penetrate the peripheral portion 56*b*2. The peripheral portion 56*b*2 may be formed entirely in the shape of a cylinder that extends along the rotational axis Ow. A mounting groove 56*b*3 where the second weight member 56*a* rests may be formed in the peripheral portion 56*b*2. The mounting groove 56*b*3 may be formed in such a way that its bottom is open. A centrifugal side of the mounting groove 56*b* around the rotational axis Ow may be blocked. The peripheral portion 56*b*2 and the second weight member 56*a* rotate as a single unit.

The second eccentric portion 56 comprises a toothed portion 56*b*4 that receives torque by meshing with the bevel gear 53*a*. The toothed portion 56*b*4 is formed on the topside of the peripheral portion 56*b*2. The toothed portion 56*b*4 is placed on the perimeter around the rotational axis Ow.

The second eccentric portion 56 comprises a second weight member 56*a* fixed to the second rotating portion 56*b*. The second weight member 56*a* rotates integrally with the second rotating portion 56*b*. The second weight member 56*a* is made of a material with a higher specific gravity than the second rotating portion 56*b*.

The second weight member 56*a* is placed on one side around the rotational axis Ow, and causes the weight of the second eccentric portion 56 to be off-centered.

The first eccentric portion 55 and the second eccentric portion 56 may be arranged along the center axis Oc, spaced apart from each other. The first eccentric portion 55 and the second eccentric portion 56 may be placed to face each other. The first eccentric portion 55 may be placed above the second eccentric portion 56.

Referring to FIG. 5, when the motor shaft 52*a* and the bevel gear 53*a* rotate in one direction, the first eccentric portion 55 and the second eccentric portion 56 rotate in opposite directions.

One weight shaft 54 is fixed to the vibrating body 251 and 451. The upper and lower ends of the weight shaft 54 may be fixed to a weight casing 51*b*. The weight shaft 54 may be placed to penetrate the first eccentric portion 55 and the second eccentric portion 56.

The vibrating body 251 and 451 may comprise a weight casing 51*b* accommodating the first eccentric portion 55 and the second eccentric portion 56 in it. The weight casing 51*b* may comprise a first part 51*b*1 forming an upper portion and a second part 51*b*2 forming a lower portion. The second part 51*b*1 may form an inner space forming the bottom surface and peripheral surface, and the first part 51*b*1 may cover the top of the inner space. The weight casing 51*b* may be attached to the motor 52. A hole through which the motor shaft 52*a* is inserted may be formed in one side of the weight casing 51*b*.

The motor shaft 52*a* is inserted and protrudes between the first eccentric portion 55 and the second eccentric portion 56. The motor shaft 52*a* is connected to the transmitting portion 53.

The transmitting portion 53 comprises a bevel gear 53*a* that rotates integrally with the motor shaft 52*a*. The bevel gear 53*a* has a plurality of gear teeth arranged along the perimeter of the motor shaft 52*a*. The bevel gear 53*a* is placed between the first eccentric portion 55 and the second eccentric portion 56.

The transmitting portion 53 may comprise a transmission shaft 53*g* that rotatably supports the bevel gear 53*a*. The transmission shaft 53*g* may be supported by the weight shaft 54. One end of the transmission shaft 53*g* may be fixed to the weight shaft 54, and the other end may be inserted into the center of the bevel gear 53*a*.

A description of the elements common to the second and fourth exemplary embodiments is the same as what has been described above. Hereinafter, a description will given, focusing on the elements different for the second and fourth exemplary embodiments.

Hereinafter, structural examples of the vibration module 250, elastic member 260, and supporting member 270 according to the second exemplary embodiment will be described with reference to FIGS. 8 to 10. The vibrating body 251 according to the second exemplary embodiment is fixed to the hanger body 231 and moves integrally with the hanger body 231.

The weight casing 51*b* may be disposed in front of the motor 52. The motor shaft 52*a* may protrude forward.

The hanger driving unit 258 connects and holds the vibrating body 251 and the hanger body 231 together. The hanger driving unit 258 is fixed to the vibrating body 251. The hanger driving unit 258 may protrude and extend downward from the vibrating body 251, so that the lower end is fixed to the hanger body 231. The lower end of the hanger driving unit 258 is fixed to the hanger driven unit 231*b*. The hanger driving unit 258 vibrates integrally with the hanger driven unit 231*b*.

Referring to FIG. 9, the connection axis Oh is disposed between the rotational axis Ow and the center Mm of mass of the motor 52. When viewed from the extension direction (top) of the rotational axis Ow, the hanger driving unit 258 is fixed to the hanger body 231, in a position between the center Mm of mass of the motor 52 and the first rotational axis Ow1.

When the vibration module 250 reciprocates to the left and right, the elastic member 260 may be elastically deformed by the elastic member locking portion 259, or the restoring force of the elastic member 260 is transmitted to the elastic member locking portion 259. The elastic member locking portion 259 is disposed on the weight casing 51*b*.

The elastic member locking portion 259 may comprise a first locking portion 259*a* on which one end of the first elastic member 60*a* is locked. The first locking portion 259*a* may be formed on one side (+X) of the weight casing 51*b*. The elastic member locking portion 259 may comprise a second locking portion 259*b* on which one end of the second elastic member 60*b* is locked. The second locking portion 259*b* may be formed on the other side (−X) of the weight casing 51*b*.

The elastic member 260 may be disposed between the vibration module 250 and the supporting member 270. One end of the elastic member 260 is locked on the vibration module 250, and the other end is locked on an elastic member mounting portion 277 of the supporting member 270. The elastic member 260 may comprise a tension spring and/or a compression spring. A pair of elastic members 60*a* and 60*b* may be disposed on both sides of the connection axis Oh in the vibration direction (+X, −X).

A plurality of elastic members 60*a* and 60*b* may be provided. The elastic members 60*a* and 60*b* may be configured to elastically deform when the vibration module 250 moves to one side in the vibration direction (+X, −X) and regain their elasticity when it moves to the other side. The elastic members 60*a* and 60*b* may be configured to elastically deform when the hanger body 231 moves to one side in the vibration direction (+X, −X) and regain their elasticity when it moves to the other side.

The first elastic member 60*a* is disposed on one side (+X) of the vibrating body 251. One end of the first elastic member 60*a* may be locked on the first locking portion 259*a*, and the other end may be locked on a first mounting portion 277*a* of the supporting member 270. The first elastic member 60*a* may comprise a spring that elastically deforms in the vibration direction (+X, −x) and regains its elasticity.

The second elastic member 60*b* is disposed on the other side (−X) of the vibrating body 251. One end of the second elastic member 60*b* may be locked on the second locking portion 259*b*, and the other end may be locked on a second mounting portion 277*b* of the supporting member 270. The second elastic member 60*b* may comprise a spring that elastically deforms in the vibration direction (+X, −x) and regains its elasticity.

The supporting member 270 comprises an elastic member mounting portion 277 where one end of the elastic member 260 is fixed. The elastic member mounting portion 277 is fixed to the frame 10. The elastic member mounting portion 277 may be fixed to the interior frame 11*a*. The first mounting portion 277*a* and the second mounting portion 277*b* are placed apart from each other, in opposite directions with respect to the connection axis Oh.

The supporting member 270 may further comprise a module guide 278 that allows the vibration module 250 to move in the vibration direction (+X, −X) but restricts the movement in a direction (+Y, −Y) intersecting the vibration direction (+X, −X). The module guide 278 may make contact with the hanger driving unit 258 and guide the hanger driving unit 258 in the vibration direction (+X, −X). The module guide 278 may be disposed between the pair of mounting portions 277*a* and 477*b*. The module guide 278 may be disposed under the vibrating body 251. The module guide 278 may be formed in the shape of a horizontal plate. The module guide 278 is fixed to the frame 10.

Hereinafter, the configuration of the vibration module 450, elastic member 460, and supporting member 470 according to the fourth exemplary embodiment will be described with reference to FIGS. 11 to 14. The vibrating body 451 according to the fourth exemplary embodiment is configured to be rotatable around the center axis Oc.

In the fourth exemplary embodiment, the weight casing 51*b* is placed apart from the center axis Oc in the centrifugal direction Dr1. The weight casing 51*b* and the hanger driving unit 458 may be placed apart from each other, in opposite directions with respect to the center axis Oc. The connection axis Oh and the rotational axis Ow may be placed apart from each other, in opposite directions with respect to the center axis Oc. The motor 52 may be disposed between the center axis Oc and the rotational axis Ow. The motor shaft 52*a* may protrude in the centrifugal direction Dr1. The motor shaft 52*a* may protrude in the −Y axis direction.

The vibrating body 451 may comprise a base casing 451*d* rotatably supported by the center axial portion 475. The center axial portion 475 is placed to penetrate the base casing 451*d*. A bearing B is interposed between the center axial portion 475 and the base casing 451*d*. The base casing 451*d* is disposed between the weight casing 51*b* and an elastic member mount 451*c*.

The vibrating body 451 may comprise a motor supporting portion 451*e* supporting the motor 52. The motor supporting portion 451*e* may support the bottom end of the motor. The motor supporting portion 451*e* may be disposed between the weight casing 51*b* and the base casing 451*d*.

The vibrating body 451 may comprise an elastic member mount 451*c* on which one end of the elastic member 460 is locked. When the vibration module 450 rotates and vibrates, the elastic member mount 451*c* applies pressure on the elastic member 460 or receive restoring force from the elastic member 460.

The elastic member mount 451*c* may be disposed on one end of the vibrating body 451 in the centrifugal direction Dr1. The elastic member mount 451*c* may connect and extend between the center axis Oc and the connection axis Oh. The elastic member mount 451*c* may extend in the centrifugal direction Dr1 and therefore have a distal end. The elastic member mount 451*c* is disposed on the other side of the first and second rotational axes Ow with respect to the center axis Oc. The elastic member mount 451*c* may be fixed to the base casing 451*d*. The elastic member mount 451*c*, base casing 451*d*, and motor supporting portion 451*e* may be formed as a single unit.

In the fourth exemplary embodiment, the motor 52 may be placed apart from the center axis Oc. The motor 52 may be disposed between the center axis Oc and the first and second rotational axes Ow. The motor 52 has a motor shaft 52*a* placed perpendicular to the center axis Oc. The motor shaft 52*a* may protrude from the motor in the centrifugal direction Dr1.

The hanger driving unit 458 is connected to the hanger body 431, in a position where it is spaced part from the center axis Oc. The hanger driving unit 458 may be configured to be connected to the hanger body 431 on the outside, in a position where it is spaced apart from the center axis Oc.

The hanger driving unit 458 may comprise a protruding portion 458*a* that protrudes along the connection axis Oh. The protruding portion 458*a* protrudes downward from the hanger driving unit 458. The protruding portion 458*a* protrudes along the connection axis Oh. The hanger driving unit 458 may comprise a connecting rod 458*a* and 458*b* comprising the protruding portion 458*a*. The connecting rod 458*a* and 458*b* may be configured as a separate member. One end 458*a* of the connecting rod 458*a* and 458*b* may be inserted into a slit 431*bh* of the hanger driven unit 431*b*. The connecting rod 458*a* and 458*b* converts the rotating motion of the vibration module 450 to reciprocate the hanger body 431.

The connecting rod 458*a* and 458*b* is fixed to the vibrating body 451. The upper end of the connecting rod 458*a* and 458*b* may be fixed to the vibrating body 451. The connecting rod 458*a* and 458*b* rotates integrally with the vibrating body 451. The connecting rod 458*a* and 458*b* may be disposed on the connection axis Oh. The connecting rod 458*a* and 458*b* may transmit the torque of the vibrating body 451 to the hanger body 431.

The connecting rod 458*a* and 458*b* may comprise a vertical extension 458*b* which extends in an up-down direction. The vertical extension 458*b* may extend along the connection axis Oh. The upper end of the vertical extension 458*b* may be fixed to the elastic member mount 451*c*. The connecting rod 458*a* and 458*b* comprises the protruding portion 458*a* formed at the distal end of the vertical extension 458*b*. The protruding portion 458*a* is disposed on the lower end of the vertical extension 458*b*.

The vibration module 450 comprises an elastic member locking portion 459 on which one end of the elastic member 460 is locked. When the vibration module 450 rotates around the center axis Oc, the elastic member 460 is elastically deformed by the elastic member locking portion 459, or the restoring force of the elastic member 460 is transmitted to the elastic member locking portion 459. The elastic member locking portion 459 is disposed on the elastic member mount 451*c*.

The elastic member locking portion 459 may comprise a first locking portion 459*a* on which one end of the first elastic member 60*a* is locked. The first locking portion 459*a* may be formed on one side (+X) of the elastic member mount 451*c*. The elastic member locking portion 459 may comprise a second locking portion 459*b* on which one end of the second elastic member 60*b* is locked. The second locking portion 459*b* may be formed on the other side (−X) of the elastic member mount 451*c*.

The elastic member 460 may be disposed between the vibration module 450 and the supporting member 470. One end of the elastic member 460 is locked on the vibration module 450, and the other end is locked on an elastic member mounting portion 477 of the supporting member 470. The elastic member 460 may comprise a tension spring and/or a compression spring. A pair of elastic members 60*a* and 60*b* may be disposed on both sides of the connection axis Oh in the vibration direction (+X, −X). The elastic member 460 may be placed apart from the center axis Oc.

A plurality of elastic members 60*a* and 60*b* may be provided. The elastic members 60*a* and 60*b* each may be configured to elastically deform when the vibration module 450 moves in either the clockwise direction DI1 or the counterclockwise direction DI2 and regain their elasticity when it moves in the other direction. The elastic members 60*a* and 60*b* may be configured to elastically deform when the hanger body 431 moves to one side in the vibration direction (+X, −X) and regain their elasticity when it moves to the other side.

The first elastic member 60*a* is disposed on one side (+X) of the vibrating body 451. One end of the first elastic member 60*a* may be locked on the first locking portion 459*a*, and the other end may be locked on a first mounting portion 477*a* of the supporting member 470. The first elastic member 60*a* may comprise a spring that elastically deforms in the vibration direction (+X, −X) and regains its elasticity.

The second elastic member 60*b* is disposed on the other side (−X) of the vibrating body 451. The elastic member mount 451*c* is disposed between the first elastic member 60*a* and the second elastic member 60*b*. One end of the second elastic member 60*b* may be locked on the second locking portion 459*b*, and the other end may be locked on a second mounting portion 477*b* of the supporting member 470. The second elastic member 60*b* may comprise a spring that elastically deforms in the vibration direction (+X, −X) and regains its elasticity.

The supporting member 470 may comprise a center axial portion 475 protruding along the center axis Oc. The center axial portion 475 may protrude upward from a center axis supporting portion 476. The center axial portion 475 is inserted into a hole formed in the vibrating body 451. The center axial portion 475 rotatably supports the vibrating body 451 through a bearing B.

The supporting member 470 may comprise a center axial supporting portion 476 to which the center axial portion 475 is fixed. The center axial supporting portion 476 may be located a distance below the vibrating body 451. The center axial supporting portion 476 is fixed to the frame 10.

The supporting member 470 comprises an elastic member mounting portion 477 where one end of the elastic member 460 is fixed. The elastic member mounting portion 477 is fixed to the frame 10. The elastic member mounting portion 477 may be fixed to the interior frame 11*a*. The first mounting portion 477*a* and the second mounting portion 477*b* are placed apart from each other, in opposite directions with respect to the connection axis Oh.

Hereinafter, the configuration of the vibration module 550, elastic member 560, and supporting member 570 according to the fifth exemplary embodiment will be described with reference to FIGS. 17 to 24. The vibrating body 551 according to the fifth exemplary embodiment is configured to be rotatable around the center axis Oc.

The vibrating body 551 may comprise a weight casing 551*b* containing the first eccentric portion 55 and the second eccentric portion 56 in it. The weight casing 551*b* may form the outer appearance of an upper portion of the vibration module 50. The upper ends of the weight shafts 554*a* and 554*b* are fixed to the weight casing 551*b*. The weight casing 551*b* comprises a first part 551*b*1 covering the top of the first eccentric portion 55 and a second part 551*b*2 covering the top of the second eccentric portion 56. The upper end of the first weight shaft 554*a* is fixed to the first part 551*b*1. The upper end of the second weight shaft 554*b* is fixed to the second part 551*b*2.

The vibrating body 551 may comprise a base casing 551*d* forming the outer appearance of a lower portion. The lower ends of the weight shafts 554*a* and 554*b* are fixed to the base casing 551*d*. The first eccentric portion 55 and the second eccentric portion 56 are disposed between the weight casing 551*b* and the base casing 551*d*. The first eccentric portion 55 is disposed between the first part 551*b*1 and the base casing 551*d*. The second eccentric portion 56 is disposed between the second part 551*b*2 and the base casing 551*d*.

The vibrating body 551 may comprise a motor supporting portion 551*e* supporting the motor 552. The motor supporting portion 551*e* may support the bottom end of the motor 552. The motor supporting portion 551*e* is disposed between the first part 551*b*1 and the second part 551*b*2. The motor shaft 552*a* may be placed to penetrate the motor supporting portion 551*e*. The motor supporting portion 551*e* may be fixed to the weight casing 551*b*, and may be formed integrally with the weight casing 551*b*.

The vibrating body 551 may comprise an elastic member mount 551*c* on which one end of at least one elastic member 560 is locked. The elastic member mount 551*cd* may be disposed in the upper portion of the vibrating body 551. The elastic member mount 551*c* may be fixed to the upper ends of the first part 551*b*1 and second part 551*b*2. The elastic member mount 551*c* may be placed to run across the center axis Oc. The center axial portion 575 may be placed to penetrate the elastic member mount 551*c*.

The vibrating body 551 may have a central groove 551*h* or hole into which the center axial portion 575 is inserted. The central groove 551*h* may be formed on the upper side and/or lower side of the vibrating body 551. In this exemplary embodiment, the central groove 551*h* is formed in the elastic member mount 551*c*. A bearing B1 is placed in the central groove 551*h*, so that the vibrating body 551 may be rotatably supported on the center axial portion 575.

The motor 552 may be disposed on the center axis Oc. The motor 52 is disposed between the first eccentric portion 55 and the second eccentric portion 56. The motor 552 has a motor shaft 552*a* disposed on the center axis Oc. The motor shaft 552 may protrude downward and be connected to the transmitting portion 553.

The transmitting portion 553 comprises a center transmitting portion 553*c* that rotates integrally with the motor shaft 552*a*. The center transmitting portion 553*c* may be fixed to the motor shaft 552*a*. The transmitting portion 553 may comprise a first transmitting portion 553*a* comprising a gear or belt for transmitting the torque of the center transmitting portion 553*c* to the first eccentric portion 55. The transmitting portion 553 may comprise a second transmitting portion 553*b* comprising a gear or belt for transmitting the torque of the center transmitting portion 553*c* to the second eccentric portion 56.

The first weight shaft 554*a* and the second weight shaft 554*b* are formed as separate members. The first weight shaft 554*a* is disposed on the first rotational axis Ow1. The second weight shaft 554*b* is disposed on the second rotational axis Ow2. The first weight shaft 554*a* and the second weight shaft 554*b* are placed in opposite directions with respect to the center axis Oc. The first weight shaft 554*a* and the second weight shaft 554*b* are placed symmetrically with respect to the center axis Oc. The first weight shaft 554*a* and the second weight shaft 554*b* are fixed to the vibrating body 5551. The first weight shaft 554*a* is placed to penetrate the first rotating portion 555*b*. The second weight shaft 554*b* is placed to penetrate the second rotating portion 556*b*.

The first eccentric portion 55 and the second eccentric portion 56 are placed in opposite directions with respect to the center axis Oc. The first eccentric portion 55 and the second eccentric portion 56 may be placed to face each other horizontally. The first eccentric portion 55 may be disposed on one side (+X) in the vibration direction (+X, −X), and the second eccentric portion 56 may be disposed on the other side (−X).

The first eccentric portion 55 may comprise a first weight member 555*a* and a first rotating portion 555*b*. The first rotating portion 555*b* may comprise a center portion 555*b*1 that makes rotatable contact with the first weight shaft 554*a*. The first weight shaft 554*a* is placed to penetrate the center portion 555*b*1. The center portion 555*b*1 extends along the first rotational axis Ow1. The center portion 555*b*1 has a center hole along the first rotational axis Ow1.

The first rotating portion 555*b* may comprise a peripheral portion 555*b*2 mounted to the center portion 555*b*1. The center portion 555*b*1 is placed to penetrate the peripheral portion 555*b*2. The peripheral portion 555*b*2 may be formed entirely in the shape of a cylinder that extends along the first rotational axis Ow1. A mounting groove 555*b*3 where the first weight member 555*a* rests may be formed in the peripheral portion 555*b*2. The mounting groove 555*b*3 may be formed in such a way that its top is open. A centrifugal side of the mounting groove 555*b*3 around the first rotational axis Ow1 may be blocked. The peripheral portion 555*b*2 and the first weight member 555*a* rotate as a single unit.

The second eccentric portion 56 may comprise a second weight member 556*a* and a second rotating portion 556*b*. The second rotating portion 556*b* may comprise a center portion 556*b*1 that makes rotatable contact with the second weight shaft 554*a*. The second weight shaft 554*a* is placed to penetrate the center portion 556*b*1. The center portion 556*b*1 extends along the second rotational axis Ow2. The center portion 556*b*1 has a center hole along the second rotational axis Ow2.

The second rotating portion 556*b* may comprise a peripheral portion 556*b*2 mounted to the center portion 556*b*1. The center portion 556*b*1 is placed to penetrate the peripheral portion 556*b*2. The peripheral portion 556*b*2 may be formed entirely in the shape of a cylinder that extends along the second rotational axis Ow2. A mounting groove 556*b*3 where the second weight member 556*a* rests may be formed in the peripheral portion 556*b*2. The mounting groove 556*b*3 may be formed in such a way that its top is open. A centrifugal side of the mounting groove 556*b*3 around the second rotational axis Ow2 may be blocked. The peripheral portion 556*b*2 and the second weight member 556*a* rotate as a single unit.

The transmitting portion 553 comprises a gear type center transmitting portion 553*c*. The center axis Oc may run across the center of the center transmitting portion 553*c*. The center transmitting portion 553*c* may comprise a spur gear. The transmitting portion 553 may comprise a first transmitting portion 553*a* that rotates by meshing with the center transmitting portion 553*c*. The first transmitting portion

553*a* may comprise a spun gear. The transmitting portion 553 may comprise a second transmitting portion 553*b* that rotates by meshing with the center transmitting portion 553*c*. The second transmitting portion 553*b* may comprise a spun gear.

The transmitting portion 553 comprises a first transmission shaft 553*f* providing a rotational axis function to the first transmitting portion 553*a*. The first transmission shaft 553*f* may be fixed to the vibrating body 551. Also, the transmitting portion 553 comprises a second transmission shaft 553*g* providing a rotational axis function to the second transmitting portion 553*b*. The second transmission shaft 553*g* may be fixed to the vibrating body 551.

The first eccentric portion 55 comprises a toothed portion 555*b*4 that receives torque by meshing with the first transmitting portion 553*a*. The toothed portion 555*b*4 is formed along the perimeter of the peripheral portion 555*b*2. Torque from the motor shaft 552*a* is transmitted sequentially to the center transmitting portion 553*c*, the first transmitting portion 553*a*, and then the toothed portion 555*b*4.

The second eccentric portion 56 comprises a toothed portion 556*b*4 that receives torque by meshing with the second transmitting portion 553*b*. The toothed portion 556*b*4 is formed along the perimeter of the peripheral portion 556*b*2. Torque from the motor shaft 552*a* is transmitted sequentially to the center transmitting portion 553*c*, the second transmitting portion 553*b*, and then the toothed portion 556*b*4.

Figure 11:
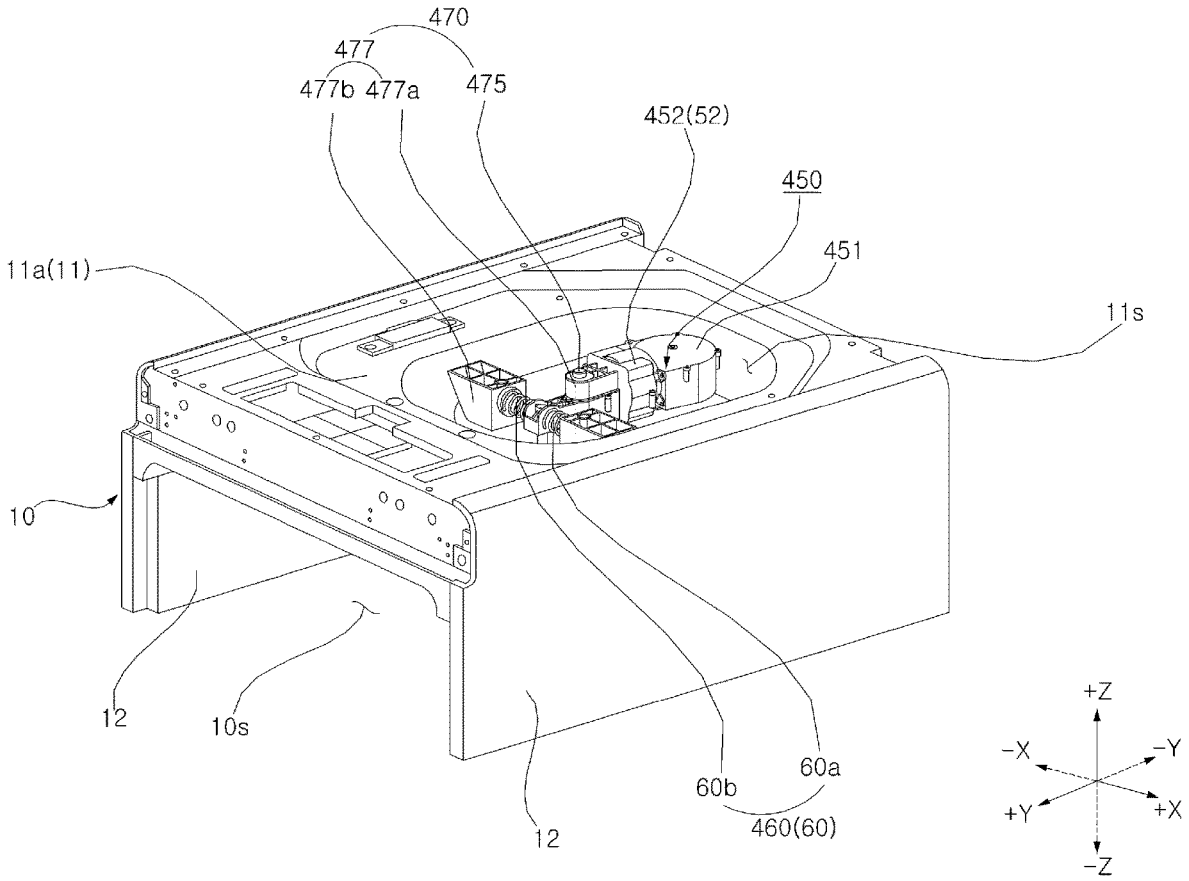
FIG. 11 is a partial perspective view showing a structural example of the vibration module 450, elastic member 460, and supporting member 470 according to the fourth exemplary embodiment in FIGS. 6*a* to 6*d*, from which the exterior frame 11*b* is omitted.
Figure 12:
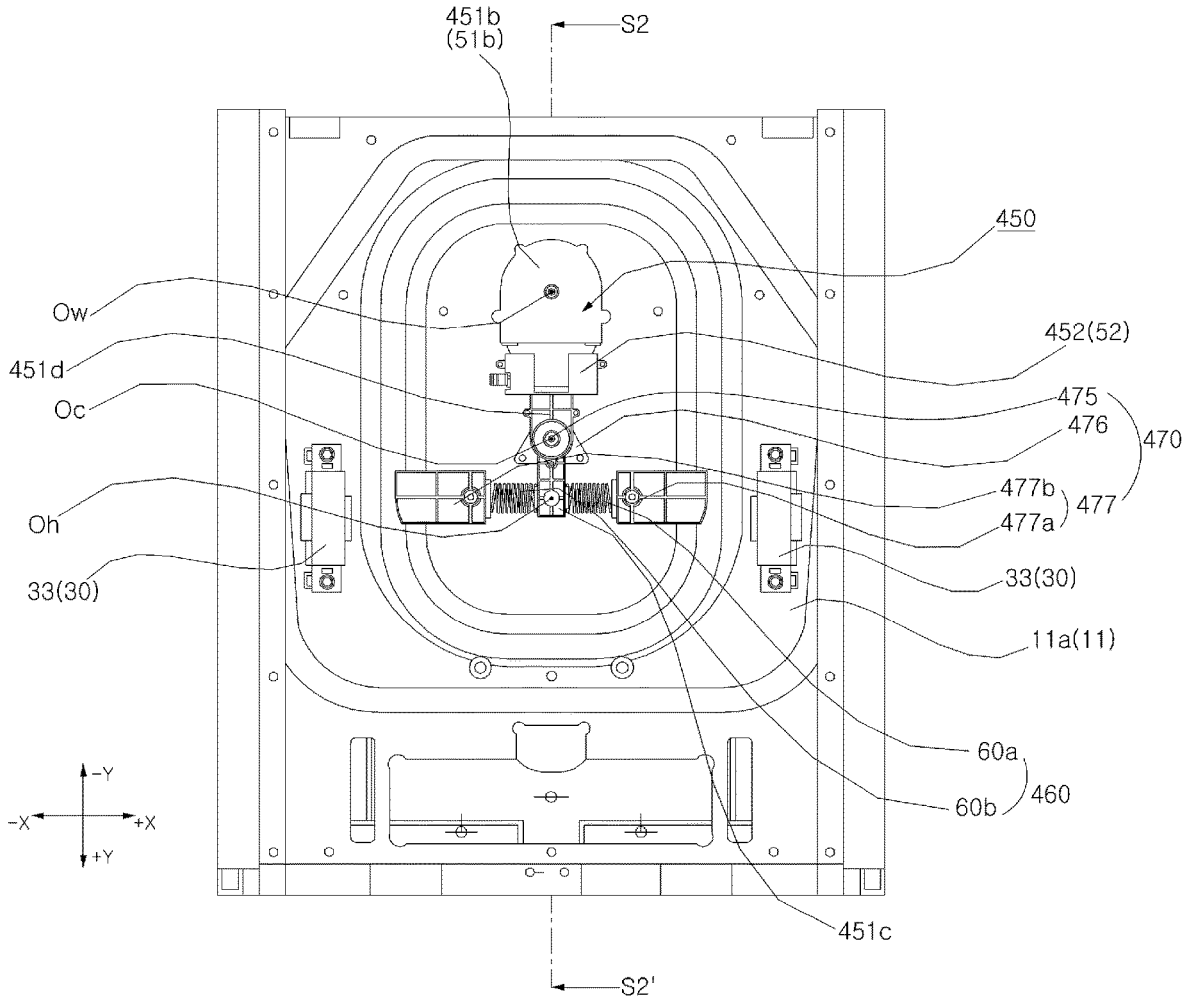
FIG. 12 is a top elevation view of the structural example of FIG. 11.
Figure 24:
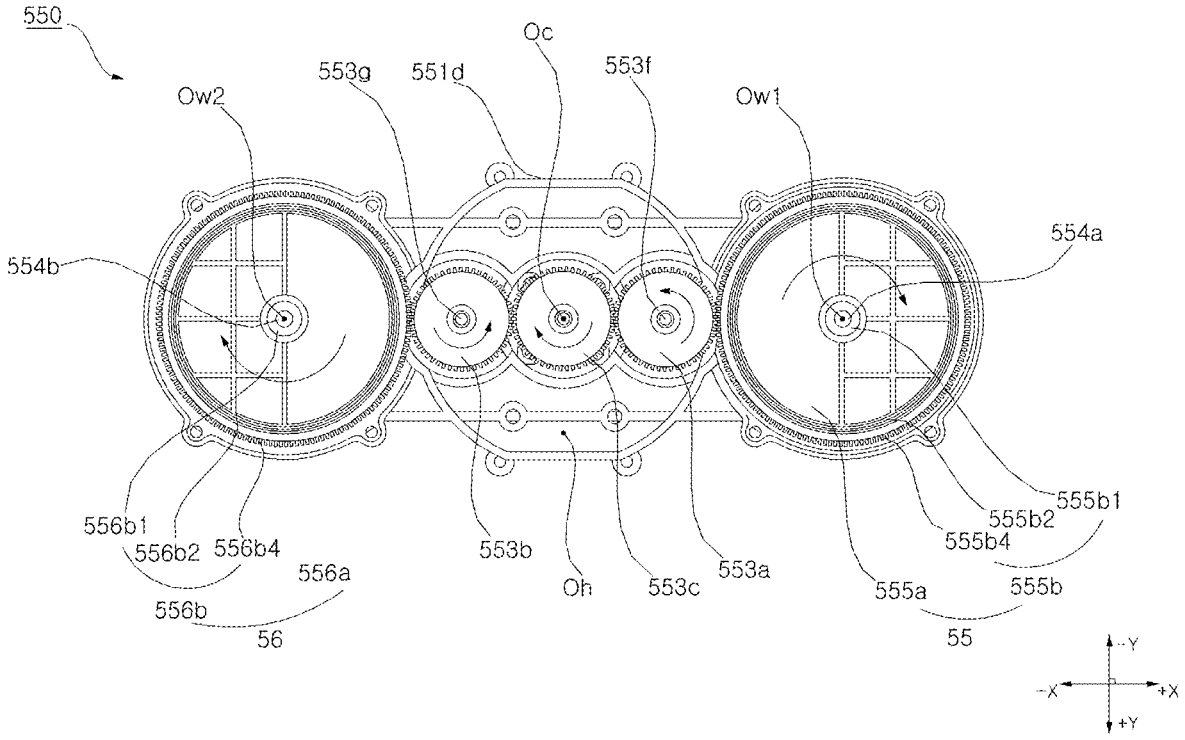
FIG. 24 is an elevation view of the transmitting portion 553, first eccentric portion 55, and second eccentric portion 56 of FIG. 23 when viewed from above.

Taking FIG. 24 as an example, when the center transmitting portion 553*c* rotates clockwise, the first transmitting portion 553*a* and the second transmitting portion 553*b* rotate counterclockwise, and the first eccentric portion 55 and the second eccentric portion 56 rotate clockwise. FIG. 11 depicts the positions of the center axis Oc, first rotational axis Ow1, second rotational axis Ow2, and connection axis Oh.

The hanger driving unit 558 comprises a rotating projection 558*c* fixed to the vibrating body 551. The upper end of the rotating projection 558*c* may be fixed to the lower side of the vibrating body 551. The rotating projection 558*c* rotates integrally with the vibrating body 551. The rotating projection 558*c* is placed to penetrate a lower supporting portion 571 along the center axis Oc. A bearing B2 may be interposed between the rotating projection 558*c* and the lower supporting portion 571, thus rotatably supporting the rotating projection 558*c* by the lower supporting portion 571. The rotating projection 558*c* may transmit the torque of the vibrating body 551 to the connecting rod 558*a* and 558*b*.

The hanger driving unit 558 comprises a connecting rod 558*a* and 558*b* that transmits the torque of the vibration module 50 to the hanger body 431. The connecting rod 558*a* and 558*b* is fixed to the rotating projection 558*c*, and rotates integrally with the rotating projection 558*c*. The connecting rod 558*a* and 558*b* may be fixed to the lower end of the rotating projection 558*c*. The connecting rod 558*a* and 558*b* comprises a centrifugal extension 558*b* which extends from the rotating projection 558*c* in the centrifugal direction Dr1. The distal end of the centrifugal extension 558*b* along the mesial direction Dr2 is fixed to the rotating projection 558*c*. The connecting rod 558*a* and 558*b* comprises the protruding portion 558*a* protruding along the connection axis Oh. The protruding portion 558*a* may protrude downward from the distal end of the centrifugal extension 558*b* along the centrifugal direction Dr1.

The vibration module 50 comprise an elastic member locking portion 559 on which one end of the elastic member 560 is locked. When the vibration module 50 rotates around the center axis Oc, the elastic member 560 is elastically deformed by the elastic member locking portion 559, or the restoring force of the elastic member 560 is transmitted to the elastic member locking portion 559. The elastic member locking portion 559 may be fixedly placed on the vibrating body 551.

The elastic member locking portion 559 may comprise a first locking portion 559*a* on which one end of the first elastic member 60*a* is locked. The first locking portion 559*a* may be formed on the upper side of the elastic member mount 551*c*. The elastic member locking portion 559 may comprise a second locking portion (not shown) on which one end of the second elastic member 60*b* is locked. The second locking portion is formed on the lower side of the base casing 551*d*. The elastic member locking portion 559 may comprise a third locking portion (not shown) on which one end of a third elastic member 60*c* is locked. The third locking portion may be formed on the connecting rod 558*a* and 558*b*.

The elastic member 560 may be disposed between the vibration module 50 and the supporting member 570. One end of the elastic member 560 is locked on the vibration module 50, and the other end is locked on an elastic member mounting portion 577 of the supporting member 570. The elastic member 560 may comprise a torsional spring.

A plurality of elastic members 60*a*, 60*b*, and 60*c* may be provided. The elastic members 60*a*, 60*b*, and 60*c* each may be configured to elastically deform when the vibration module 50 rotates in either the clockwise direction DI1 or the counterclockwise direction and regain its elasticity when it rotates in the other direction.

The first elastic member 60*a* is disposed on the upper side of the vibration module 50. One end of the first elastic member 60*a* may be locked on the first locking portion 559*a*, and the other end may be locked on a first mounting portion 577*a* of the supporting member 570. The first elastic member 60*a* may comprise a torsional spring disposed around the perimeter of the center axial portion 575.

The second elastic member 60*b* is disposed on the lower side of the vibration module 50. One end of the second elastic member 60*b* may be locked on the second locking portion of the vibration module 50, and the other end may be locked on a second mounting portion 577*b* of the supporting member 570. The second elastic member 60*b* may comprise a torsional spring disposed around the perimeter of the rotating projection 558*c*.

The third elastic member 60*c* is disposed under the lower supporting portion 571. The third elastic member 60*c* may be disposed between the lower supporting portion 571 and the connecting rod 558*a* and 558*b*. One end of the third elastic member 60*c* may be locked on the third locking portion of the vibration module 50, and the other end may be locked on a third mounting portion (not shown) of the supporting member 570.

The supporting member 570 comprises a lower supporting portion 571 disposed on the lower side of the vibrating body 551. The lower supporting portion 571 may be formed in the shape of a horizontal plate. The lower supporting portion 571 has a hole formed on the center axis Oc, and the rotating projection 558*c* penetrates through the hole. The bearing B2 is placed in the hole of the lower supporting portion 571, thereby rotatably supporting the rotating projection 558*c*.

The supporting member 570 comprises an upper supporting portion 572 disposed on the upper side of the vibrating body 551. The upper supporting portion 572 may be formed in the shape of a horizontal plate. The supporting member 570 comprises a center axial portion 575 protruding from the upper supporting portion 572 along the center axis Oc. The center axial portion 575 may protrude downward from the underside of the upper supporting portion 572. The lower end of the center axial portion 575 is inserted into a central groove 551*h* of the vibrating body 551. The center axial portion 575 rotatably supports the vibrating body 551 via the bearing B1.

The supporting member 570 comprises a vertical extension 573 that extends by connecting the lower supporting portion 571 and the upper supporting portion 572. The vertical extension 573 extends in an up-down direction. A pair of vertical extensions 573 may be disposed on either end of the upper supporting portion 572. The upper supporting portion 572 may be fixed to the lower supporting portion 571 by the vertical extension 573.

The supporting member 570 comprises an elastic member mounting portion 577 on which one end of the elastic member 560 is locked. The first mounting portion 577*a* is fixedly placed on the underside of the upper supporting portion 572. The second mounting portion 577*b* is fixedly placed on the topside of the lower supporting portion 571. The third mounting portion is fixedly placed on the underside of the lower supporting portion 571.

What is claimed is:

1. A clothes treatment apparatus comprising:
- a cabinet;
- a hanger body configured to move along a predetermined vibration direction of the cabinet and provided to hang clothes or clothes hangers;
- a vibration module that is connected to the hanger body to transmit vibrations and generate the vibrations along the vibration direction, wherein the vibration module includes:
  - at least one eccentric portion that rotates around each predetermined rotational axis of the at least one eccentric portion in such a way that each weight of the at least one eccentric portion is off-center; and
  - a motor that rotates the at least one eccentric portion and changes an angular speed of the at least one eccentric portion; and
- at least one elastic member that exerts an elastic force on the vibration module when the vibration module vibrates,
- wherein, based on a speed of motor, the vibration frequency and the amplitude of the vibration module is changeable.

2. The clothes treatment apparatus of claim 1, wherein two or more different angular speeds of the at least one eccentric portion are maintained for a predetermined time or longer.

3. The clothes treatment apparatus of claim 1, wherein the clothes treatment apparatus is configured to perform a first mode in which the vibration frequency $$\frac{w1}{2\pi}$$

of the hanger body is relatively low and the amplitude is relatively large and a second mode in which the vibration frequency $$\frac{w2}{2\pi}$$

of the hanger body is relatively high and the amplitude is relatively small, by changing and controlling the speed of the motor.

4. The clothes treatment apparatus of claim 3, wherein the vibration frequency $$\frac{w1}{2\pi}$$

for the first mode is preset to be closer to the natural vibration frequency $$\frac{w_n}{2\pi}$$

than the vibration frequency $$\frac{w2}{2\pi}$$

for the second mode.

5. The clothes treatment apparatus of claim 1, wherein the amplitude of vibration of the hanger body in a steady state is preset to have a peak value when the angular speed has a specific value greater than zero.

6. The clothes treatment apparatus of claim 1, wherein one end of the elastic member is fixed to the vibration module, and the clothes treatment apparatus further comprises a supporting member fixed to the cabinet, to which the other end of the elastic member is fixed.

7. The clothes treatment apparatus of claim 1, wherein the at least one elastic member comprises:
- a first elastic member that elastically deforms when the vibration module moves to one side in the vibration direction; and
- a second elastic member that elastically deforms when the vibration module moves to the other side.

8. The clothes treatment apparatus of claim 1, wherein the at least one eccentric portion comprises:
- a first eccentric portion that rotates around a predetermined first rotational axis in such a way that the weight is off-center; and
- a second eccentric portion that rotates around a predetermined second rotational axis, which is the same as or parallel to the first rotational axis, in such a way that the weight is off-center.

9. The clothes treatment apparatus of claim 8, wherein the vibration module is configured in such a way as to rotate around a predetermined center axis where the position relative to the cabinet is fixed, and the first rotational axis and the second rotational axis are placed apart from each other, in opposite directions with respect to the center axis.

10. The clothes treatment apparatus of claim 1, wherein the hanger body is configured to move with respect to the cabinet in the vibration direction, and the elastic member is configured to elastically deform or regain elasticity when the hanger body moves in the vibration direction.

11. The clothes treatment apparatus of claim 1, wherein the vibration module is configured in such a way as to linearly reciprocate in the vibration direction, and the elastic member is configured to elastically deform or regain elasticity when the vibration module linearly reciprocates.

12. The clothes treatment apparatus of claim 11, wherein the clothes treatment apparatus is configured to perform a first mode in which the vibration frequency $$\frac{w1}{2\pi}$$

of the hanger body is relatively low and the amplitude is relatively large and a second mode in which the vibration frequency $$\frac{w2}{2\pi}$$

of the hanger body is relatively high and the amplitude is relatively small, by changing and controlling the speed of the motor, wherein the vibration frequency $$\frac{w1}{2\pi}$$

for the first mode is preset to be closer to $$\frac{1}{2\pi}\cdot\sqrt{\frac{k}{M}}$$

than the vibration frequency $$\frac{w2}{2\pi}$$

for the second mode, where M is the mass of the vibration module and hanger body, and k is the tensile or compressive elastic modulus of the elastic member in the vibration direction.

13. The clothes treatment apparatus of claim 12, wherein the amplitude of vibration of the hanger body in a steady state is preset to have a peak value when the angular speed has a specific value greater than zero.

14. The clothes treatment apparatus of claim 11, wherein the elastic member comprises a compression spring or tensile spring.

15. The clothes treatment apparatus of claim 1, wherein the vibration module is configured in such a way as to rotate and reciprocate around a predetermined center axis where the position relative to the cabinet is fixed, each of the rotational axis and the center axis are placed apart in parallel with each other, the hanger body and the vibration module are connected on a predetermined connection axis spaced apart from the center axis, and the elastic member is configured to elastically deform or regain elasticity when the vibration module rotates and reciprocates.

16. The clothes treatment apparatus of claim 15, wherein the clothes treatment apparatus is configured to perform a first mode in which the vibration frequency $$\frac{w1}{2\pi}$$

of the hanger body is relatively low and the amplitude is relatively large and a second mode in which the vibration frequency $$\frac{w2}{2\pi}$$

of the hanger body is relatively high and the amplitude is relatively small, by changing and controlling the speed of the motor, wherein the vibration frequency $$\frac{w1}{2\pi}$$

for the first mode is preset to be closer to $$\sqrt{\frac{k}{\left(M+\frac{I}{B^2}\right)}} \text{ or } \sqrt{\frac{k}{(B^2\cdot M+I)}}$$

than the vibration frequency $$\frac{w2}{2\pi}$$

for the second mode, where I is the moment of inertia of the vibration module around the center axis, M is the mass of the hanger body, B is the distance between the center axis and the connection axis, and k is the tensile or compressive elastic modulus of the elastic member in the vibration direction (+X, −X), and is the torsional elastic modulus of the elastic member with respect to the angle θ of rotation.

17. The clothes treatment apparatus of claim 16, wherein the amplitude of vibration of the hanger body in a steady state is preset to have a peak value when the angular speed has a specific value greater than zero.

18. The clothes treatment apparatus of claim 15, wherein the distance between the center axis and each of the rotational axis is greater than the distance between the center axis and the connection axis.

19. The clothes treatment apparatus of claim 18, wherein the ratio AB of the distance between the center axis and each of the rotational axis to the distance B between the center axis and the connection axis is equal to or greater than 2.6.

20. The clothes treatment apparatus of claim 15, wherein the elastic member comprises a torsional spring.

* * * * *